US011179610B2

(12) United States Patent
Sargent et al.

(10) Patent No.: US 11,179,610 B2
(45) **Date of Patent: *Nov. 23, 2021**

(54) GOLF CLUB HEAD

(71) Applicant: Taylor Made Golf Company, Inc, Carlsbad, CA (US)

(72) Inventors: Nathan T. Sargent, Oceanside, CA (US); Joseph Reeve Nielson, Vista, CA (US); Christopher John Harbert, Carlsbad, CA (US); Todd P. Beach, Encinitas, CA (US); Brian Bazzel, Carlsbad, CA (US); Mark Vincent Greaney, Vista, CA (US); Christian Reber Wester, San Diego, CA (US); Craig Richard Slyfield, San Diego, CA (US); Kraig Alan Willett, Fallbrook, CA (US)

(73) Assignee: TAYLOR MADE GOLF COMPANY, INC., Carlsbad, CA (US)

( * ) Notice: Subject to any disclaimer, the term of this patent is extended or adjusted under 35 U.S.C. 154(b) by 40 days.

This patent is subject to a terminal disclaimer.

(21) Appl. No.: 16/102,627

(22) Filed: Aug. 13, 2018

(65) Prior Publication Data

US 2019/0046846 A1 Feb. 14, 2019

Related U.S. Application Data

(63) Continuation of application No. 14/789,838, filed on Jul. 1, 2015, now Pat. No. 10,046,212.

(Continued)

(51) Int. Cl.

*A63B 53/06* (2015.01)
*A63B 60/04* (2015.01)

(Continued)

(52) U.S. Cl.

CPC ..... *A63B 53/06* (2013.01); *A63B 53/0466* (2013.01); *A63B 60/04* (2015.10);

(Continued)

(58) Field of Classification Search

CPC ..... A63B 53/0466; A63B 53/06; A63B 60/04; A63B 2053/0491–0495

(Continued)

(56) References Cited

U.S. PATENT DOCUMENTS 6,123,627 A 9/2000 Antonious
6,525,157 B2 2/2003 Cozewith et al.

(Continued)

FOREIGN PATENT DOCUMENTS

GB 20747 9/1909

*Primary Examiner* — Laura Davison

(74) *Attorney, Agent, or Firm* — Kunzler Bean & Adamson

(57) ABSTRACT

A golf club head comprises a body having a face, a crown and a sole together defining an interior cavity. The body having a channel located on the sole and extending generally from a heel end of the body to a toe end of the body. A weight member movably positioned within the channel such that a position of the weight member within the channel is able to be adjusted, thereby adjusting a location of a center of gravity of the body. Additionally, adjustment of the weight member provides a maximum x-axis adjustment range of the position of the center of gravity (Max ΔCGx) that is greater than 2 mm and a maximum z-axis adjustment range of the center of gravity (Max ΔCGz) that is less than 2 mm.

22 Claims, 51 Drawing Sheets

FIG. 22B

Related U.S. Application Data

(60) Provisional application No. 62/141,160, filed on Mar. 31, 2015, provisional application No. 62/065,552, filed on Oct. 17, 2014, provisional application No. 62/020,972, filed on Jul. 3, 2014.

(51) Int. Cl.
*A63B 53/04* (2015.01)
*A63B 53/02* (2015.01)

(52) U.S. Cl.
CPC ..... *A63B 53/022* (2020.08); *A63B 53/045* (2020.08); *A63B 53/0433* (2020.08); *A63B 53/0437* (2020.08); *A63B 53/0454* (2020.08); *A63B 2053/0491* (2013.01)

(58) Field of Classification Search
USPC ..... 473/334–336
See application file for complete search history.

(56) References Cited

U.S. PATENT DOCUMENTS 6,663,503 B1 12/2003 Kenmi
6,773,360 B2 8/2004 Willett et al.
6,800,038 B2 10/2004 Willet et al.
6,824,475 B2 11/2004 Bumett et al.
6,997,820 B2 2/2006 Willett et al.
7,140,974 B2 11/2006 Chao et al.
7,166,040 B2 1/2007 Hoffman et al.
7,186,190 B1 3/2007 Beach et al.
7,214,142 B2 5/2007 Meyer
7,267,620 B2 9/2007 Chao et al.
7,407,447 B2 8/2008 Beach et al.
7,419,441 B2 9/2008 Hoffman et al.
7,513,296 B1 4/2009 Yu et al.
7,628,707 B2 12/2009 Beach et al.
7,731,603 B2 6/2010 Beach et al.
7,744,484 B1 6/2010 Chao
7,775,905 B2 8/2010 Beach et al.
7,850,546 B2 12/2010 Chao
7,862,452 B2 1/2011 Chao et al.
7,871,340 B2 1/2011 Chao et al.
7,874,936 B2 1/2011 Chao
7,874,937 B2 1/2011 Chao
7,887,431 B2 2/2011 Beach et al.
7,887,440 B2 2/2011 Wright et al.
RE42,544 E 7/2011 Chao et al.
7,985,146 B2 7/2011 Lin et al.
8,012,038 B1 9/2011 Beach et al.
8,012,039 B2 9/2011 Greaney et al.
8,025,587 B2 9/2011 Beach et al.
8,163,119 B2 4/2012 Chao
8,192,303 B2 6/2012 Ban
8,235,844 B2 8/2012 Albertsen et al.
8,241,143 B2 8/2012 Albertsen et al.
8,241,144 B2 8/2012 Albertsen et al.
8,298,096 B2 10/2012 Stites et al.
8,444,505 B2 5/2013 Beach et al.
8,608,591 B2 12/2013 Chao et al.
8,696,491 B1 4/2014 Myers
8,734,271 B2 5/2014 Beach et al.
8,771,097 B2 7/2014 Bennett et al.
9,056,230 B2 * 6/2015 Golden ..... A63B 53/0466
9,162,120 B2 10/2015 Jertson et al.
9,168,435 B1 10/2015 Boggs
9,174,096 B2 11/2015 Sargent
9,259,625 B2 2/2016 Sargent
9,278,262 B2 3/2016 Sargent
9,561,413 B2 * 2/2017 Nielson ..... A63B 53/02
9,962,584 B2 * 5/2018 Nielson ..... A63B 53/02
10,046,212 B2 * 8/2018 Sargent ..... A63B 53/0466
10,293,225 B2 * 5/2019 Sargent ..... A63B 60/04
10,300,356 B2 * 5/2019 Mata ..... A63B 53/06
2002/0160854 A1 10/2002 Beach
2008/0261715 A1 10/2008 Carter
2010/0075773 A1 3/2010 Casati
2010/0144461 A1 6/2010 Ban
2010/0234125 A1 * 9/2010 Aoyama ..... A63B 53/0466
473/324
2011/0275451 A1 11/2011 Chao et al.
2011/0312437 A1 * 12/2011 Sargent ..... A63B 53/02
473/335
2012/0083361 A1 4/2012 Beach et al.
2012/0199282 A1 8/2012 Caho
2012/0220387 A1 8/2012 Beach et al.
2013/0130831 A1 5/2013 Morales
2014/0080617 A1 3/2014 Llewellyn
2014/0113742 A1 4/2014 Zimmerman et al.
2015/0031468 A1 1/2015 Matsunaga et al.
2015/0038258 A1 2/2015 Beach et al.
2015/0297961 A1 10/2015 Voshall
2015/0306473 A1 10/2015 Breier
2015/0321055 A1 11/2015 Golden
2016/0008687 A1 1/2016 Sargent et al.
2016/0136490 A1 5/2016 Sargent et al.

* cited by examiner

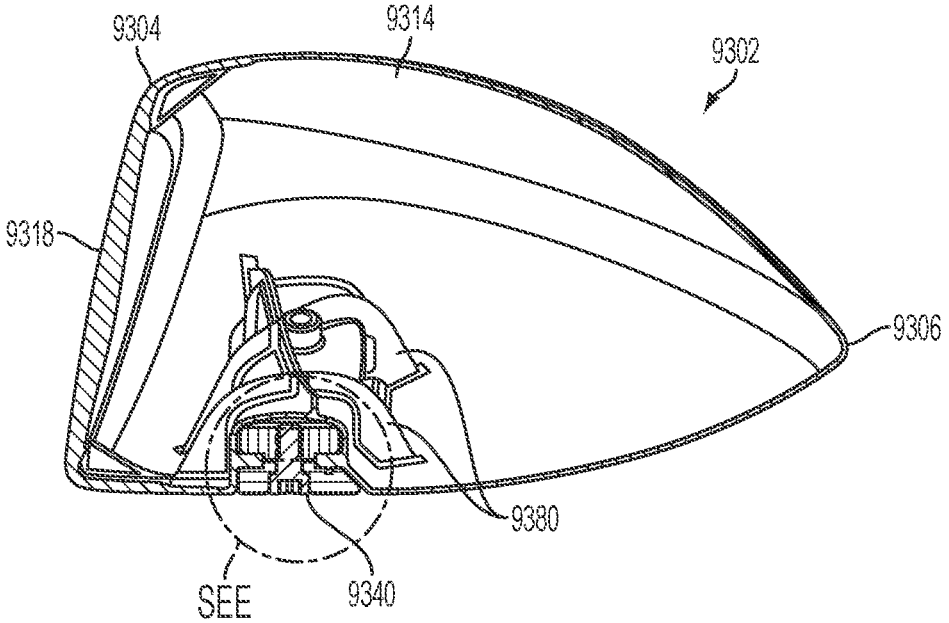
FIG. 22B
FIG. 22A
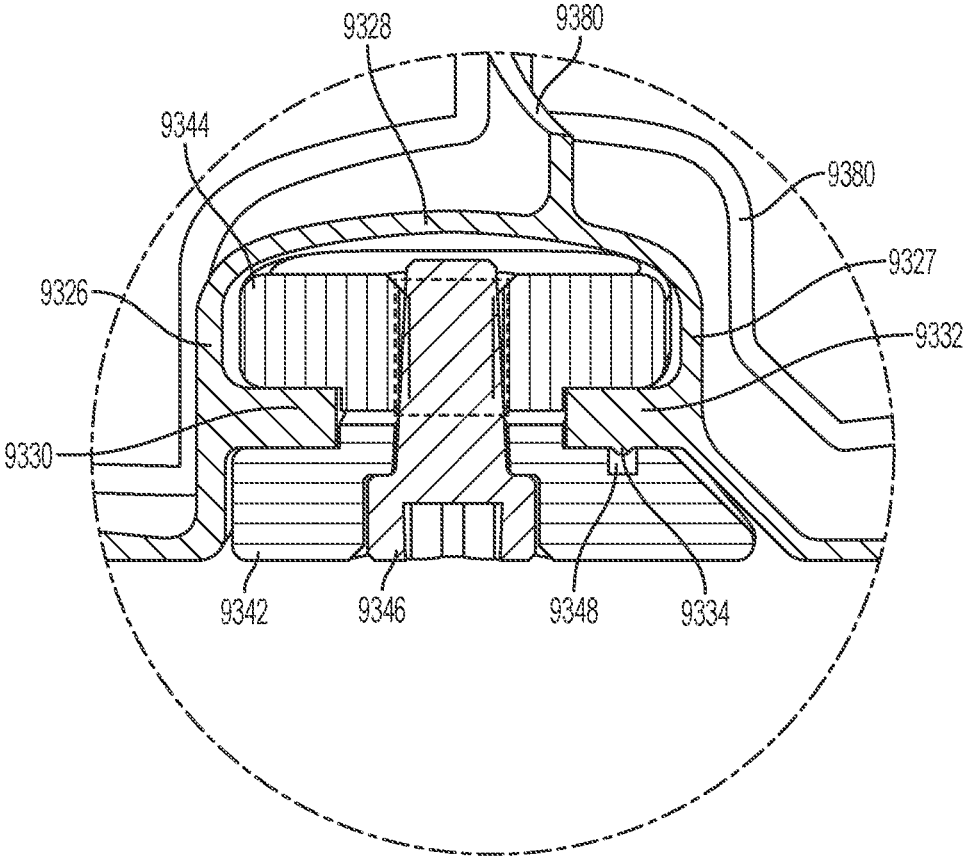
FIG. 22B

GOLF CLUB HEAD

CROSS-REFERENCE TO RELATED APPLICATIONS

This application claims the benefit of U.S. Provisional Application No. 62/020,972, filed on Jul. 3, 2014, U.S. Provisional Application No. 62/065,552, filed on Oct. 17, 2014, and U.S. Provisional Application No. 62/141,160, filed on Mar. 31, 2015, and are incorporated herein by reference in their entirety.

This application relates to U.S. patent application Ser. No. 13/340,039, filed Dec. 29, 2011, which is a continuation-in-part of U.S. patent application Ser. No. 13/166,668, filed Jun. 22, 2011, which is a continuation-in-part of U.S. patent application Ser. No. 12/646,769, filed Dec. 23, 2009, all three of which applications are incorporated by reference herein in their entirety. This application also relates to U.S. Patent Application No. 62/020,972, filed Jul. 3, 2014.

Other related applications and patents concerning golf clubs, U.S. Pat. Nos. 6,773,360, 6,800,038, 6,824,475, 6,997,820, 7,166,040, 7,186,190, 7,267,620, 7,407,447, 7,419,441, 7,628,707, 7,744,484, 7,850,546, 7,862,452, 7,871,340, 7,874,936, 7,874,937, 7,887,431, 7,887,440, 7,985,146, RE 42,544, 8,012,038, 8,012,039, 8,025,587 and U.S. patent application Ser. Nos. 11/642,310, 11/825,138, 11/870,913, 11/960,609, 11/960,610, 12/006,060, 12/474,973, 12/646,769, 12/687,003, 12/986,030, 13/077,825, 13/224,222, 13/305,514, 13/305,523 13/305,533, 13/339,933, 13/839,727, and 13/841,325 are also incorporated by reference herein in their entirety.

FIELD

The present application is directed to embodiments of golf club heads, particularly club heads that have adjustable components.

BACKGROUND

For a given type of golf club (e.g., driver, iron, putter, wedge), the golfing consumer has a wide variety of variations to choose from. This variety is driven, in part, by the wide range in physical characteristics and golfing skill among golfers and by the broad spectrum of playing conditions that a golfer may encounter. For example, taller golfers require clubs with longer shafts; more powerful golfers or golfers playing in windy conditions or on a course with firm fairways may desire clubs having less shaft flex (greater stiffness); and a golfer may desire a club with certain playing characteristics to overcome a tendency in their swing (e.g., a golfer who has a tendency to hit low-trajectory shots may want to purchase a club with a greater loft angle). Variations in shaft flex, loft angle and handedness (i.e., left or right) alone account for 24 variations of the TaylorMade r7 460 driver.

Having such a large number of variations available for a single golf club, golfing consumers can purchase clubs with club head-shaft combinations that suit their needs. However, shafts and club heads are generally manufactured separately, and once a shaft is attached to a club head, usually by an adhesive, replacing either the club head or shaft is not easily done by the consumer. Motivations for modifying a club include a change in a golfer's physical condition (e.g., a younger golfer has grown taller), an increase the golfer's skill or to adjust to playing conditions. Typically, these modifications must be made by a technician at a pro shop.

The attendant cost and time spent without clubs may dissuade golfers from modifying their clubs as often as they would like, resulting in a less-than-optimal golfing experience. Thus, there has been effort to provide golf clubs that are capable of being assembled and disassembled by the golfing consumer.

To that end, golf clubs having club heads that are removably attached to a shaft by a mechanical fastener are known in the art. For example, U.S. Pat. No. 7,083,529 to Cackett et al. (hereinafter, "Cackett") discloses a golf club with interchangeable head-shaft connections. The connection includes a tube, a sleeve and a mechanical fastener. The sleeve is mounted on a tip end of the shaft. The shaft with the sleeve mounted thereon is then inserted in the tube, which is mounted in the club head. The mechanical fastener secures the sleeve to the tube to retain the shaft in connection with the club head. The sleeve has a lower section that includes a keyed portion which has a configuration that is complementary to the keyway defined by a rotation prevention portion of the tube. The keyway has a non-circular cross-section to prevent rotation of the sleeve relative to the tube. The keyway may have a plurality of splines, or a rectangular or hexagonal cross-section.

While removably attachable golf club heads of the type represented by Cackett provide golfers with the ability to disassemble a club head from a shaft, it is necessary that they also provide club head-shaft interconnections that have the integrity and rigidity of conventional club head-shaft interconnection. For example, the manner in which rotational movement between the constituent components of a club head-shaft interconnection is restricted must have sufficient load-bearing areas and resistance to stripping. Consequently, there is room for improvement in the art.

Additionally, the center of gravity (CG) of a golf club head is a critical parameter of the club's performance. Upon impact, the position of the CG greatly affects launch angle and flight trajectory of a struck golf ball. Thus, much effort has been made over positioning the center of gravity of golf club heads. To that end, current driver and fairway wood golf club heads are typically formed of lightweight, yet durable material, such as steel or titanium alloys. These materials are typically used to form thin club head walls. Thinner walls are lighter, and thus result in greater discretionary weight, i.e., weight available for redistribution around a golf club head. Greater discretionary weight allows golf club manufacturers more leeway in assigning club mass to achieve desired golf club head mass distributions.

Golf swings vary among golfers. The mass properties (e.g., CG location, moment of inertia, etc.) and design geometry (e.g., static loft) of a given golf club may provide a high level of performance for a golfer having a relatively high swing speed, but not for a golfer having a relatively slower swing speed.

It should, therefore, be appreciated that there is a need for golf club heads and golf clubs having designs that perform over a wide range of club head swing speeds. The present application fulfills this need and others.

SUMMARY

Some embodiments of a golf club head comprises a body having a face, a crown and a sole together defining an interior cavity, the body having a channel located on the sole and extending generally from a heel end of the body to a toe end of the body. The minimum distance between a vertical plane intersecting a center of the face and a forward channel or track is less than about 50 mm over a full length of the channel. A weight member can be movably positioned within the channel such that a position of the weight member within the channel is able to be adjusted.

In some of these embodiments, the distance between the vertical plane and the channel is less than about 40 mm over a full length of the channel. In still other embodiments, the distance between the vertical plane and the channel is less than about 30 mm over a full length of the channel.

In some of these embodiments, a ledge extends within the channel from the heel end of the body to the toe end of the body. The ledge can include a plurality of locking projections located on an exposed surface of the ledge. In some of these embodiments, the weight member includes an outer member retained within the channel and in contact with the ledge, an inner member retained within the channel, and a fastening bolt that connects the outer member to the inner member. In some of these embodiments, the outer member includes a plurality of locking notches adapted to selectively engage the locking projections located on the exposed surface of the ledge. In some of these embodiments, the outer member has a length L extending generally in the heel to toe direction of the channel, and each adjacent pair of locking projections are separated by a distance D1 along the ledge, with L>D1.

In some of these embodiments, a rotatably adjustable sole piece is secured to the sole at one of a plurality of rotational positions with respect to a central axis extending through the sole piece. The sole piece extends a different axial distance from the sole at each of the rotational positions. Adjusting the sole piece to a different one of the rotational positions changes the face angle of the golf club head independently of the loft angle of the golf club head when the golf club head is in the address position. In some of these embodiments, a releasable locking mechanism is configured to lock the sole piece at a selected one of the rotational positions on the sole. The locking mechanism can include a screw adapted to extend through the sole piece and into a threaded opening in the sole of the club head body. In some of these embodiments, the sole piece has a convex bottom surface, such that when the sole piece is at each rotational position the bottom surface has a heel-to-toe curvature that substantially matches a heel-to-toe curvature of a leading contact surface of the sole.

Some embodiments of a golf club head include a body having a face, a crown and a sole together defining an interior cavity, the body having a channel located on the sole and extending generally from a heel end of the body to a toe end of the body. A weight member can be movably positioned within the channel such that a position of the weight member within the channel is able to be adjusted. The face includes a center face location that defines the origin of a coordinate system in which an x-axis is tangential to the face at the center face location and is parallel to a ground plane when the body is in a normal address position, a y-axis extends perpendicular to the x-axis and is also parallel to the ground plane, and a z-axis extends perpendicular to the ground plane, wherein a positive x-axis extends toward the heel portion from the origin, a positive y-axis extends rearwardly from the origin, and a positive z-axis extends upwardly from the origin. A maximum x-axis position adjustment range of the weight member (Max $\Delta x$) is greater than 50 mm and a maximum y-axis position adjustment range of the weight member (Max $\Delta y$) is less than 40 mm.

In some of these embodiments, the weight member has a mass ($M_{WA}$) and the product of $M_{WA}$*Max $\Delta x$ is at least 250 g·mm, such as between about 250 g·mm and about 4950 g·mm.

In some of these embodiments, the product of $M_{WA}$*Max $\Delta y$ is less than 1800 g·mm, such as between about 0 g·mm and about 1800 g·mm.

In some of these embodiments, a center of gravity of the body has a z-axis coordinate (CGz) that is less than about 0 mm.

Some embodiments of a golf club head include a body having a face, a crown and a sole together defining an interior cavity, the body having a channel located on the sole and extending generally from a heel end of the body to a toe end of the body. A weight member can be movably positioned within the channel such that a position of the weight member within the channel is able to be adjusted, thereby adjusting a location of a center of gravity of the body. The face includes a center face location that defines the origin of a coordinate system in which an x-axis is tangential to the face at the center face location and is parallel to a ground plane when the body is in a normal address position, a y-axis extends perpendicular to the x-axis and is also parallel to the ground plane, and a z-axis extends perpendicular to the ground plane, wherein a positive x-axis extends toward the heel portion from the origin, a positive y-axis extends rearwardly from the origin, and a positive z-axis extends upwardly from the origin. Adjustment of the weight member can provide a maximum x-axis adjustment range of the position of the center of gravity (Max $\Delta CGx$) that is greater than 2 mm and a maximum y-axis adjustment range of the center of gravity (Max $\Delta CGy$) that is less than 3 mm.

In some of these embodiments, a center of gravity of the body has a z-axis coordinate (CGz) that is less than about 0 mm.

The foregoing and other features and advantages of the invention will become more apparent from the following detailed description, which proceeds with reference to the accompanying figures.

BRIEF DESCRIPTION OF THE DRAWINGS

FIG. 22A is a cross-sectional view of the golf club head of FIGS. 19A-B.

FIG. 22B is a close up view taken along inset line "B" in FIG. 22A.

DETAILED DESCRIPTION

Figure 1A:
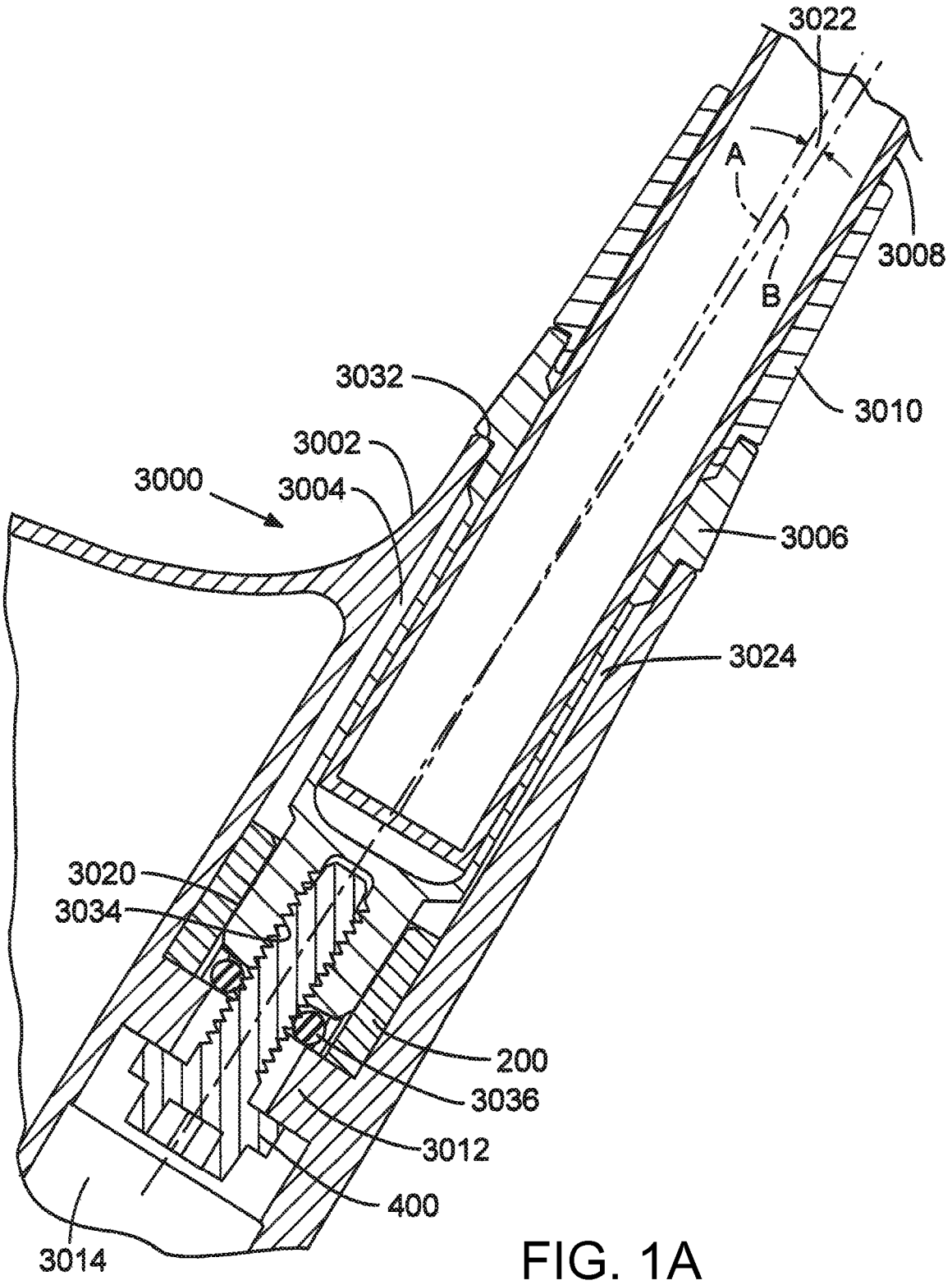
FIG. 1A is an enlarged cross-sectional view of a golf club head having a removable shaft, in accordance with another embodiment.

The inventive features include all novel and non-obvious features disclosed herein both alone and in novel and non-obvious combinations with other elements. As used herein, the phrase "and/or" means "and", "or" and both "and" and "or". As used herein, the singular forms "a," "an," and "the" refer to one or more than one, unless the context clearly dictates otherwise. As used herein, the term "includes" means "comprises."

General Considerations

The following disclosure describes embodiments of golf club heads for metal wood type clubs (e.g., metal drivers and metal fairway woods). The disclosed embodiments should not be construed as limiting in any way. Instead, the present disclosure is directed toward all novel and nonobvious features and aspects of the various disclosed embodiments, alone and in various combinations and subcombinations with one another. Furthermore, any features or aspects of the disclosed embodiments can be used in various combinations and subcombinations with one another. The disclosed embodiments are not limited to any specific aspect or feature or combination thereof, nor do the disclosed embodiments require that any one or more specific advantages be present or problems be solved.

Throughout the following detailed description, a variety of golf club heads for metal wood type clubs (e.g., metal drivers and metal fairway woods) examples are provided. Related features in the examples may be identical, similar, or dissimilar in different examples. For the sake of brevity, related features will not be redundantly explained in each example. Instead, the use of related feature names will cue the reader that the feature with a related feature name may be similar to the related feature in an example explained previously. Features specific to a given example will be described in that particular example. The reader should understand that a given feature need not be the same or similar to the specific portrayal of a related feature in any given figure or example.

Throughout the following detailed description, references will be made to channel and tracks. Sometimes these words may be used interchangeable to describe a feature that may hold a slidably repositionable weight, such as, for example a forward channel or track. At other times, a channel may refer to feature in the club designed to improve perimeter flexibility, and may not necessarily hold a weight. Still at other times a forward channel or track may be shown without an attached weight assembly, however this does not indicate that a weight assembly cannot be installed in the channel.

The present disclosure makes reference to the accompanying drawings which form a part hereof, wherein like numerals designate like parts throughout. The drawings illustrate specific embodiments, but other embodiments may be formed and structural changes may be made without departing from the intended scope of this disclosure. Directions and references may be used to facilitate discussion of the drawings but are not intended to be limiting. For example, certain terms may be used such as "up," "down," "upper," "lower," "horizontal," "vertical," "left," "right," and the like. These terms are used, where applicable, to provide some clarity of description when dealing with relative relationships, particularly with respect to the illustrated embodiments. Such terms are not, however, intended to imply absolute relationships, positions, and/or orientations. Accordingly, the following detailed description shall not to be construed in a limiting sense.

Figure 25:
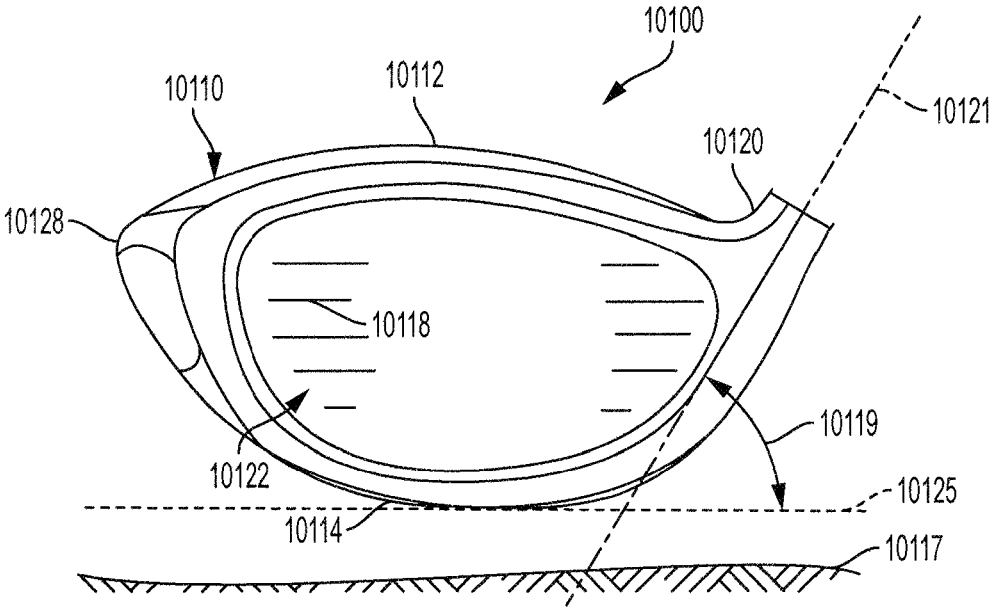
FIG. 25 is a front elevation view of an exemplary embodiment of a golf club head.
Figure 26:
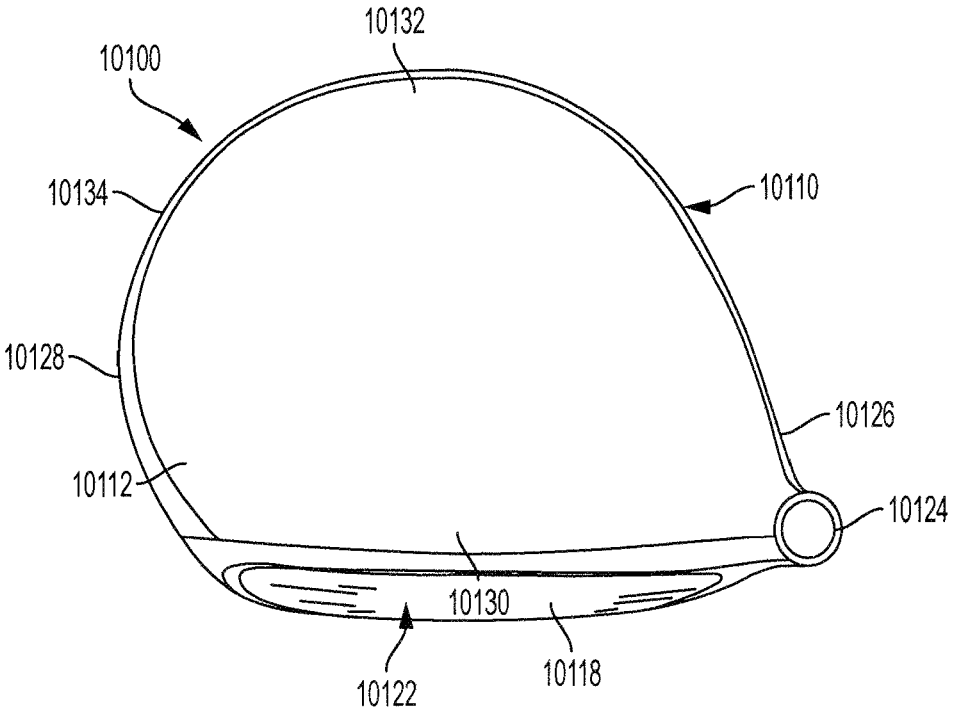
FIG. 26 is a top plan view of the golf club head of FIG. 25.
Figure 27:
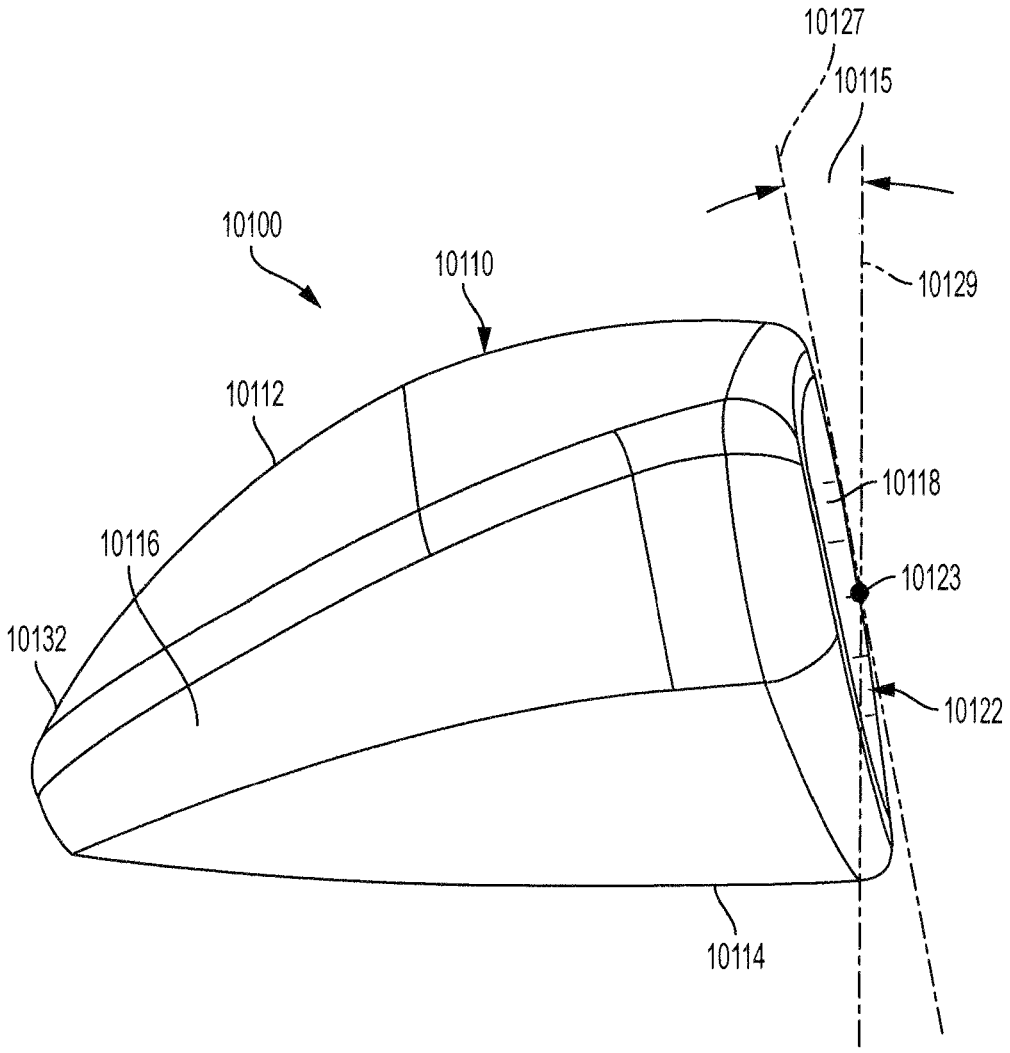
FIG. 27 is a side elevation view from a toe side of the golf club head of FIG. 25.

The following provides additional background information that may help further the understanding of the golf club head technology described within this description. Turning next to FIGS. 25-27, embodiment of a golf club head 10100 includes a hollow body 10110, a crown 10112, sole 10114, skirt 10116, and a ball striking club face 10118.

A. Normal Address Position

Club heads and many of their physical characteristics disclosed herein will be described using "normal address position" as the club head reference position, unless otherwise indicated. FIGS. 25-27 illustrate one embodiment of a wood-type golf club head at normal address position. FIG. 25 illustrates a front elevation view of golf club head 10100, FIG. 26 illustrates a top plan view of the golf club head 10100, and FIG. 27 illustrates a side elevation view of the golf club head 10100 from the toe side. By way of preliminary description, the club head 10100 includes a ball striking club face 10118. At normal address position, the club head 10100 is positioned on a plane 10125 above and parallel to a ground plane 10117.

As used herein, "normal address position" means the club head position wherein a vector normal to the club face 10118 substantially lies in a first vertical plane (a vertical plane is perpendicular to the ground plane 10117), the centerline axis 10121 of the club shaft substantially lies in a second substantially vertical plane, and the first vertical plane and the second substantially vertical plane substantially perpendicularly intersect.

B. Club Head Features

A wood-type golf club head, such as the golf club head 10100 shown in FIGS. 25-27, includes a hollow body 10110 defining a crown portion 10112, a sole portion 10114, a skirt portion 10116, and a ball striking club face 10118. The ball striking club face 10118 can be integrally formed with the body 10110 or attached to the body. The body 10110 further includes a heel portion 10126, a toe portion 10128, a front portion 10130, and a rear portion 10132. The body 10110 further includes a hosel 10120, which defines a hosel bore 10124 adapted to receive a golf club shaft. In some embodiments, a golf club shaft may be bonded to the body 10110. Alternatively, the club head 10100 may include an adjustable shaft connection system for coupling a shaft to the hosel 10120, such as the adjustable shaft connection systems described herein, the details of which are not repeated here and not shown in FIGS. 25-27 for clarity. The club head 10100 also has a volume, typically measured in cubic-centimeters ($cm^3$).

As used herein, "crown" means an upper portion of the club head above a peripheral outline 10134 of the club head as viewed from a top-down direction and rearward of the topmost portion of a ball striking surface 10122 of the ball striking club face 10118. As used herein, "sole" means a lower portion of the club head 10100 extending upwards from a lowest point of the club head when the club head is at the normal address position. In some implementations, the sole 10114 extends approximately 50% to 60% of the distance from the lowest point of the club head to the crown 10112. In other implementations, the sole 10114 extends upwardly from the lowest point of the golf club head 10100 a shorter distance. Further, the sole 10114 can define a substantially flat portion extending substantially horizontally relative to the ground 10117 when in normal address position or can have an arced or convex shape as shown in FIG. 25. As used herein, "skirt" means a side portion of the club head 10100 between the crown 10112 and the sole 10114 that extends across a periphery 10134 of the club head, excluding the striking surface 10122, from the toe portion 10128, around the rear portion 10132, to the heel portion 10126. As used herein, "striking surface" means a front or external surface of the ball striking club face 10118 configured to impact a golf ball. In some embodiments, the striking surface 10122 can be a striking plate attached to the body 10110 using known attachment techniques, such as welding. Further, the striking surface 10122 can have a variable thickness. In certain embodiments, the striking surface 10122 has a bulge and roll curvature (discussed more fully below).

The body 10110, or any parts thereof, can be made from a metal alloy (e.g., an alloy of titanium, an alloy of steel, an alloy of aluminum, and/or an alloy of magnesium), a composite material (e.g., a graphite or carbon fiber composite) a ceramic material, or any combination thereof. The crown 10112, sole 10114, skirt 10116, and ball striking club face 10118 can be integrally formed using techniques such as molding, cold forming, casting, and/or forging. Alternatively, any one or more of the crown 10112, sole 10114, skirt 10116, or ball striking club face 10118 can be attached to the other components by known means (e.g., adhesive bonding, welding, and the like).

In some embodiments, the striking face 10118 is made of a composite material, while in other embodiments, the striking face 10118 is made from a metal alloy (e.g., an alloy of titanium, steel, aluminum, and/or magnesium), ceramic material, or a combination of composite, metal alloy, and/or ceramic materials.

When at normal address position, the club head 10100 is disposed at a lie angle 10119 relative to the club shaft axis 10121 (as shown in FIG. 25) and the club face has a loft angle 10115 (as shown in FIG. 27). Referring to FIG. 25, the lie angle 10119 refers to the angle between the centerline axis 10121 of the club shaft and the ground plane 10117 at normal address position. Referring to FIG. 27, loft angle 10115 refers to the angle between a tangent line 10127 to the club face 10118 and a vector 10129 normal to the ground plane and passing thru the geometric center of the face at normal address position.

Figure 28:
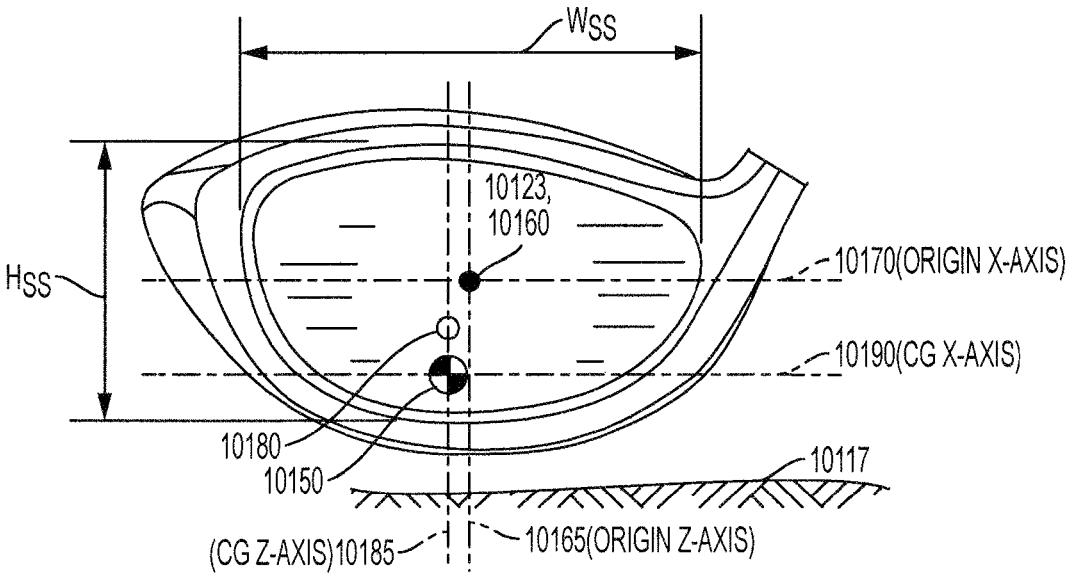
FIG. 28 is a front elevation view of the golf club of FIG. 25 illustrating club head origin and center of gravity origin coordinate systems.
Figure 29:
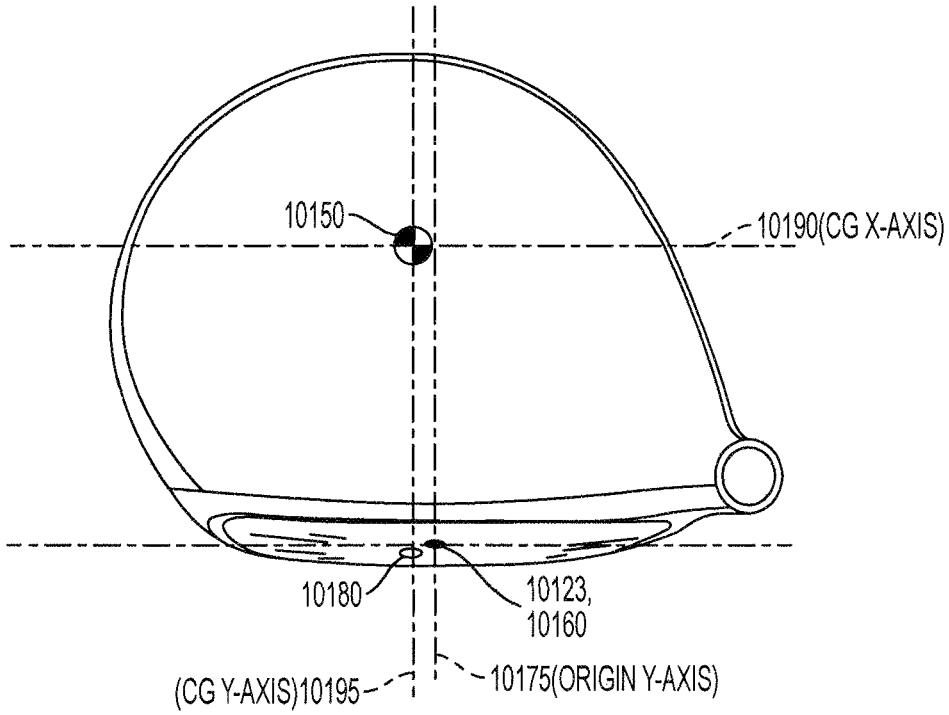
FIG. 29 is a top plan view of the golf club of FIG. 25 illustrating the club head origin and center of gravity origin coordinate systems.
Figure 30:
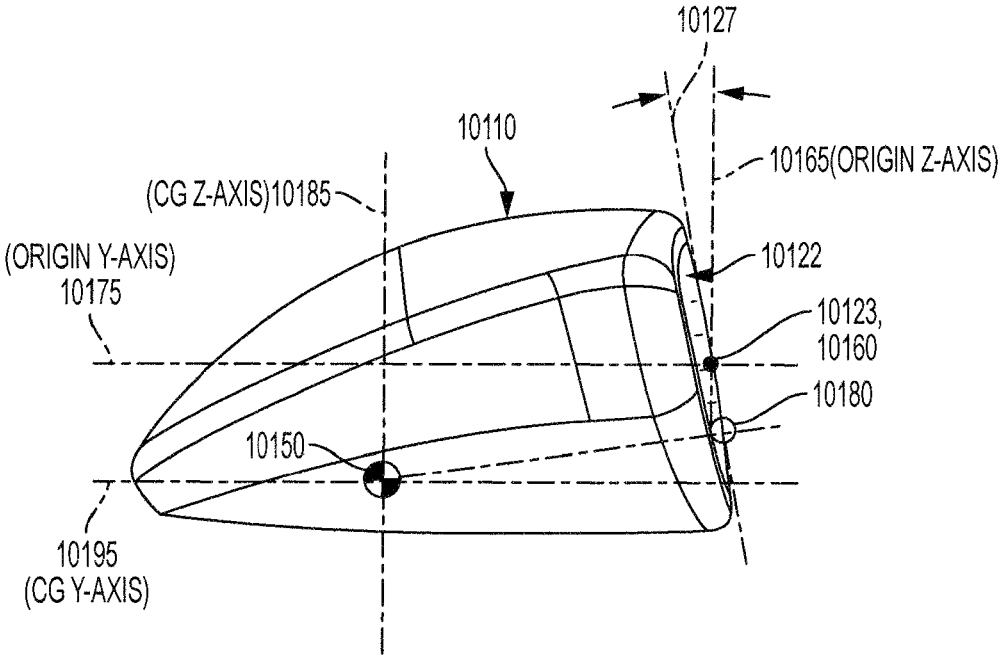
FIG. 30 is a side elevation view from a toe side of the golf club of FIG. 25 illustrating the club head origin and center of gravity origin coordinate systems.

FIGS. 28-30 illustrate coordinate systems that can be used in describing features of the disclosed golf club head embodiments. FIG. 28 illustrates a front elevation view of the golf club head 10100, FIG. 29 illustrates a top plan view of the golf club head 10100, and FIG. 27 illustrates a side elevation view of the golf club head 10100 from the toe side. As shown in FIGS. 28-30, a center 10123 is disposed on the striking surface 10122. For purposes of this disclosure, the center 10123 is defined as the intersection of the midpoints of a height ($H_{ss}$) and a width ($W_{ss}$) of the striking surface 122. Both $H_{ss}$ and $W_{ss}$ are determined using the striking face curve ($S_{ss}$). The striking face curve is bounded on its periphery by all points where the face transitions from a substantially uniform bulge radius (face heel-to-toe radius of curvature) and a substantially uniform roll radius (face crown-to-sole radius of curvature) to the body. $H_{ss}$ is the distance from the periphery proximate to the sole portion of $S_{ss}$ (also referred to as the bottom radius of the club face) to the periphery proximate to the crown portion of $S_{ss}$ (also referred to as the top radius of the club face) measured in a vertical plane (perpendicular to ground) that extends through the center 10123 of the face (e.g., this plane is substantially normal to the x-axis). Similarly, $W_{ss}$ is the distance from the periphery proximate to the heel portion of $S_{ss}$ to the periphery proximate to the toe portion of $S_{ss}$ measured in a horizontal plane (e.g., substantially parallel to ground) that extends through the center 10123 of the face (e.g., this plane is substantially normal to the z-axis). In other words, the center 10123 along the z-axis corresponds to a point that bisects into two equal parts a line drawn from a point just on the inside of the top radius of the striking surface (and centered along the x-axis of the striking surface) to a point just on the inside of the bottom radius of the face plate (and centered along the x-axis of the striking surface). For purposes of this disclosure, the center 10123 is also be referred to as the "geometric center" of the golf club striking surface 10122. See also U.S.G.A. "Procedure for Measuring the Flexibility of a Golf Clubhead," Revision 2.0 for the methodology to measure the geometric center of the striking face.

C. Golf Club Head Coordinates

Referring to FIGS. 28-30, a club head origin coordinate system can be defined such that the location of various features of the club head (including a club head center-of-gravity (CG) 10150) can be determined. A club head origin 10160 is illustrated on the club head 10100 positioned at the center 10123 of the striking surface 10122.

The head origin coordinate system defined with respect to the head origin 10160 includes three axes: a z-axis 10165 extending through the head origin 10160 in a generally vertical direction relative to the ground 10117 when the club head 10100 is at the normal address position; an x-axis 10170 extending through the head origin 10160 in a toe-to-heel direction generally parallel to the striking surface 10122 (e.g., generally tangential to the striking surface 10122 at the center 10123) and generally perpendicular to the z-axis 10165; and a y-axis 10175 extending through the head origin 10160 in a front-to-back direction and generally perpendicular to the x-axis 10170 and to the z-axis 10165. The x-axis 10170 and the y-axis 10175 both extend in generally horizontal directions relative to the ground 10117 when the club head 10100 is at the normal address position. The x-axis 10170 extends in a positive direction from the origin 10160 towards the heel 10126 of the club head 10100. The y-axis 10175 extends in a positive direction from the head origin 10160 towards the rear portion 10132 of the club head 10100. The z-axis 10165 extends in a positive direction from the origin 10160 towards the crown 10112.

D. Center of Gravity

Generally, the center of gravity (CG) of a golf club head is the average location of the weight of the golf club head or the point at which the entire weight of the golf club head may be considered as concentrated so that if supported at this point the head would remain in equilibrium in any position.

Referring to FIGS. 28-30, a CG 10150 is shown as a point inside the body 10110 of the club head 10100. The location of the club CG 10150 can also be defined with reference to the club head origin coordinate system. For example, and using millimeters as the unit of measure, a CG 10150 that is located 3.2 mm from the head origin 10160 toward the toe of the club head along the x-axis, 36.7 mm from the head origin 10160 toward the rear of the club head along the y-axis, and 4.1 mm from the head origin 10160 toward the sole of the club head along the z-axis can be defined as having a $CG_x$ of −3.2 mm, a $CG_y$ of 36.7 mm, and a $CG_z$ of −4.1 mm.

The CG can also be used to define a coordinate system with the CG as the origin of the coordinate system. For example, and as illustrated in FIGS. 28-30, the CG origin coordinate system defined with respect to the CG origin 10150 includes three axes: a CG z-axis 10185 extending through the CG 10150 in a generally vertical direction relative to the ground 10117 when the club head 10100 is at normal address position; a CG x-axis 10190 extending through the CG origin 10150 in a toe-to-heel direction generally parallel to the striking surface 10122 (e.g., generally tangential to the striking surface 10122 at the club face center 10123), and generally perpendicular to the CG z-axis 10185; and a CG y-axis 10195 extending through the CG origin 10150 in a front-to-back direction and generally perpendicular to the CG x-axis 10190 and to the CG z-axis 10185. The CG x-axis 10190 and the CG y-axis 10195 both extend in generally horizontal directions relative to the ground 10117 when the club head 10100 is at normal address position. The CG x-axis 10190 extends in a positive direction from the CG origin 10150 to the heel 10126 of the club head 10100. The CG y-axis 10195 extends in a positive direction from the CG origin 10150 towards the rear portion 10132 of the golf club head 10100. The CG z-axis 10185 extends in a positive direction from the CG origin 10150 towards the crown 10112. Thus, the axes of the CG origin coordinate system are parallel to corresponding axes of the head origin coordinate system. In particular, the CG z-axis 10185 is parallel to z-axis 10165, CG x-axis 10190 is parallel to x-axis 10170, and CG y-axis 10195 is parallel to y-axis 10175.

As best shown in FIG. 30, FIGS. 28-30 also show a projected CG point 10180 on the golf club head striking surface 10122. The projected CG point 10180 is the point on the striking surface 10122 that intersects with a line that is normal to the tangent line 10127 of the ball striking club face 10118 and that passes through the CG 10150. This projected CG point 10180 can also be referred to as the "zero-torque" point because it indicates the point on the ball striking club face 10118 that is centered with the CG 10150. Thus, if a golf ball makes contact with the club face 10118 at the projected CG point 10180, the golf club head will not twist about any axis of rotation since no torque is produced by the impact of the golf ball.

Exemplary Embodiments of High Loft, Low CG Golf Club Heads

A. Z-Axis Gear Effect

Figure 31:
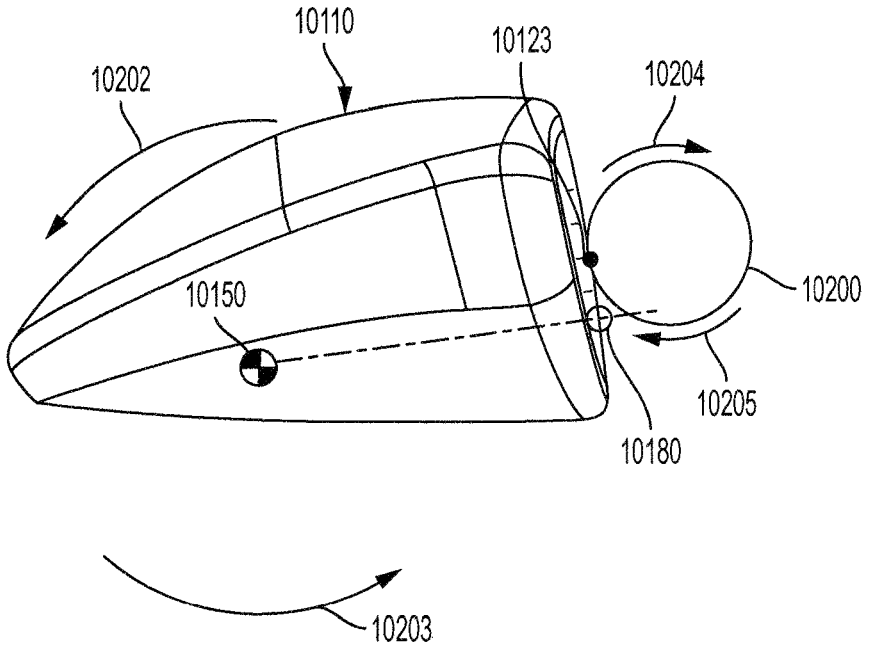
FIG. 31 is a side elevation view from a toe side of the golf club of FIG. 25 illustrating the projection of the center of gravity (CG) onto the golf club head face.

In certain embodiments disclosed herein, the projected CG point on the ball striking club face is located below the geometric center of the club face. In other words, the projected CG point on the ball striking club face is closer to the sole of the club face than the geometric center. As a result, and as illustrated in FIG. 31, when the golf club is swung such that the club head 10100 impacts a golf ball 10200 at the club head's center 10123, the impact is "off center" from the projected CG point 10180, creating torque that causes the body of the golf club head to rotate (or twist) about the CG x-axis (which is normal to the page in FIG. 31). This rotation of the golf club head about the x-axis is illustrated in FIG. 31 by arrows 10202, 10203. The rotation of the club face creates a "z-axis gear effect." More specifically, the rotation of the club head about the CG x-axis tends to induce a component of spin on the ball. In particular, the backward rotation (shown by arrows 10202, 10203) of the club head face that occurs as the golf ball is compressed against the club face during impact causes the ball to rotate in a direction opposite to the rotation of the club face, much like two gears interfacing with one another. Thus, the backward rotation of the club face during impact creates a component of forward rotation (shown by arrows 10204, 10205) in the golf ball. This effect is termed the "z-axis gear effect."

Because the loft of a golf club head also creates a significant amount of backspin in a ball impacted by the golf club head, the forward rotation resulting from the z-axis gear effect is typically not enough to completely eliminate the backspin of the golf ball, but instead reduces the backspin from that which would normally be experienced by the golf ball.

In general, the forward rotation (or topspin) component resulting from the z-axis gear effect is increased as the impact point of a golf ball moves upward from (or higher above) the projected CG point on the ball striking club face. Additionally, the effective loft of the golf club head that is experienced by the golf ball and that determines the launch conditions of the golf ball can be different than the static loft of the golf club head. The difference between the golf club head's effective loft at impact and its static loft angle at address is referred to as "dynamic loft" and can result from a number of factors. In general, however, the effective loft of a golf club head is increased from the static loft as the impact point of a golf ball moves upward from (or higher than) the projected CG point on the ball striking club face.

Figure 32:
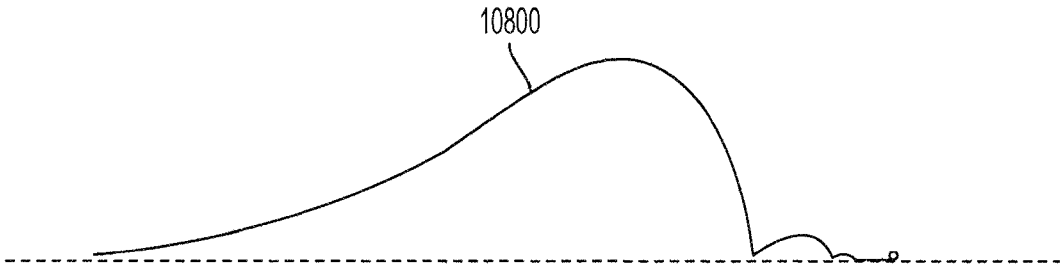
FIG. 32 is a schematic elevation view of the trajectory of a golf ball hit with a driver having a $CG_z$ aligned with the geometric center of the ball striking club face.

FIG. 32 is a schematic side view 10800 illustrating trajectory 10800 of a golf ball hit by a driver having a projected CG that coincides with the geometric center of the striking surface. The launch conditions created from such a driver typically include a low launch angle and a significant amount of backspin. The backspin on the ball causes it to quickly rise in altitude and obtain a more vertical trajectory, "ballooning" into the sky. Consequently, the ball tends to quickly lose its forward momentum as it is transferred to vertical momentum, eventually resulting in a steep downward trajectory that does not create a significant amount of roll. As illustrated by FIG. 32, then, even though some backspin can be beneficial to a golf ball's trajectory by allowing it to "rise" vertically and resist a parabolic trajectory, too much backspin can cause the golf ball to lose distance by transferring too much of its forward momentum into vertical momentum.

Figure 33:
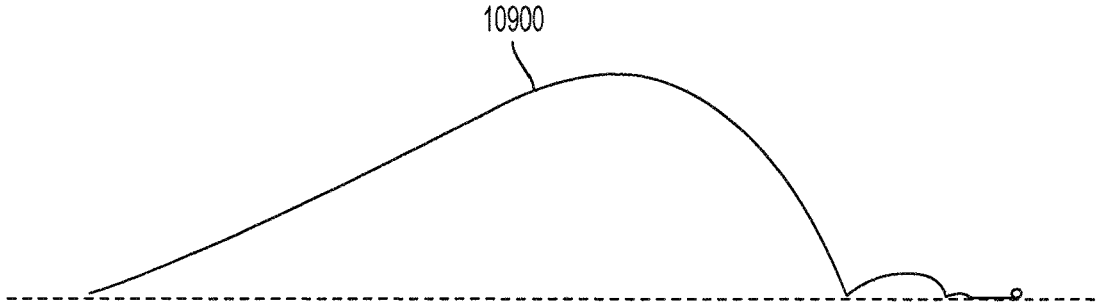
FIG. 33 is a schematic elevation view of the trajectory of a golf ball hit with a driver having a $CG_z$ lower than the geometric center of the ball striking club face.

FIG. 33, by contrast, is a schematic side view illustrating trajectory 10900 of a golf ball hit by a driver having a lower center of gravity in accordance with embodiments of the disclosed technology. In FIG. 33, the static loft of the golf club head is assumed to be the same as the driver in FIG. 32, although the static loft can be higher, as more fully explained below. The launch conditions created from a driver having a lower center of gravity includes a higher launch angle and less backspin relative to the driver having a projected CG that coincides with the geometric center of the striking surface. As can be seen in FIG. 33, the trajectory 10900 includes less "ballooning" than the trajectory 10800 but still has enough backspin for the ball to have some rise and to generally maintain its launch trajectory longer than a ball with no backspin. As a result, the golf ball with trajectory 10900 carries further than a golf ball with trajectory 10800. Furthermore, because the horizontal momentum of the golf ball is greater with trajectory 10900 than with trajectory 10800, the roll experienced by the golf ball with trajectory 10900 is greater than with trajectory 10800.

C. Using Discretionary Mass to Lower the Center of Gravity

Lower center of gravity values can be attained by distributing club head mass to particular locations in the golf club head. Discretionary mass generally refers to the mass of material that can be removed from various structures providing mass and that can be distributed elsewhere for locating the club head center-of-gravity.

Club head walls provide one source of discretionary mass. A reduction in wall thickness reduces the wall mass and provides mass that can be distributed elsewhere. For example, in some implementations, one or more walls of the club head can have a thickness less than approximately 0.7 mm. In some embodiments, the crown 10112 can have a thickness of approximately 0.65 mm throughout at least a majority of the crown. In addition, the skirt 10116 can have a similar thickness, whereas the sole 10114 can have a greater thickness (e.g., more than approximately 1.0 mm). Thin walls, particularly a thin crown 10112, provide significant discretionary mass.

To achieve a thin wall on the club head body 10110, such as a thin crown 10112, a club head body 10110 can be formed from an alloy of steel or an alloy of titanium. In other embodiments, the thin walls of the club head body are formed of a non-metallic material, such as a composite material, ceramic material, thermoplastic, or any combination thereof. For example, in particular embodiments, the crown 10112 and the skirt 10116 are formed of a composite material.

To lower the center of gravity within the club head body 10110, one or more portions of the sole 10114 can be formed of a higher density material than the crown 10112 and the skirt 10116. For example, the sole 10114 can be formed of metallic material, such as tungsten or a tungsten alloy. The sole 10114 can also be shaped so that the center of gravity is closer or further from the golf ball striking club face as desired.

Golf club heads according to the disclosed technology can also use one or more weight plates, weight pads, or weight ports in order to lower the center of gravity to the desired $CG_z$ location. For example, certain embodiments of the disclosed golf club heads have one or more integral weight pads cast into the golf club head at predetermined locations (e.g., in the sole of the golf club head) that lower the club head's center-of-gravity. Also, epoxy can be added to the interior of the club head through the club head's hosel opening to obtain a desired weight distribution. Alternatively, one or more weights formed of high-density materials (e.g., tungsten or tungsten alloy) can be attached to the sole. Such weights can be permanently attached to the club head. Furthermore, the shape of such weights can vary and is not limited to any particular shape. For example, the weights can have a disc, elliptical, cylindrical, or other shape.

The golf club head 10100 can also define one or more weight ports formed in the body 10110 that are configured to receive one or more weights. For example, one or more weight ports can be disposed in the sole 10114. The weight port can have any of a number of various configurations to receive and retain any of a number of weights or weight assemblies, such as described in U.S. Pat. Nos. 7,407,447 and 7,419,441, which are incorporated herein by reference. These and all other referenced patents and applications are incorporated herein by reference in their entirety. Furthermore, where a definition or use of a term in a reference, which is incorporated by reference herein is inconsistent or contrary to the definition of that term provided herein, the definition of that term provided herein applies and the definition of that term in the reference does not apply.

Inclusion of one or more weights in the weight port(s) provides a customized club head mass distribution with corresponding customized moments of inertia and center-of-gravity locations. Adjusting the location of the weight port(s) and the mass of the weights and/or weight assemblies provides various possible locations of center-of-gravity and various possible mass moments of inertia using the same club head.

In further embodiments, one or more openings in the walls of the golf club head body are formed. For example, the crown of the golf club head can include an opening. A lightweight panel can be positioned within each opening in order to close the opening. By selecting a material for the panels that is less dense than the material used to form the club head body, the difference between the mass of the body material that would otherwise occupy the opening and the panel can be positioned elsewhere in the club head. For example, by strategically selecting the number, size, and location of the openings, the center of gravity of the golf club head can be lowered to a desired position within the club head body. The panels may comprise, for example, carbon fiber epoxy resin, carbon fiber reinforced plastic, polyurethane or quasi-isotropic composites. The panels can be attached using adhesive or any other suitable technique.

In addition to redistributing mass within a particular club head envelope as discussed above, the club head center-of-gravity location can also be tuned by modifying the club head external envelope. For example, the club head body 10110 can be extended rearwardly, and its overall height can be reduced. In specific embodiments, for example, the crown of the club head body is indented or otherwise includes an at least partially concave shape, thereby distributing the weight of the crown lower into the club head body.

D. Mass Moments of Inertia

Referring to FIGS. 28-30, golf club head moments of inertia are typically defined about the three CG axes that extend through the golf club head center-of-gravity 10150. For example, a moment of inertia about the golf club head CG x-axis 10190 can be calculated by the following equation $$I_{xx}=\int(z^2+y^2)dm \tag{1}$$

where y is the distance from a golf club head CG xz-plane to an infinitesimal mass, dm, and z is the distance from a golf club head CG xy-plane to the infinitesimal mass, dm. The golf club head CG xz-plane is a plane defined by the golf club head CG x-axis 10190 and the golf club head CG z-axis 10185. The CG xy-plane is a plane defined by the golf club head CG x-axis 10190 and the golf club head CG y-axis 10195.

The moment of inertia about the CG x-axis ($I_{xx}$) is an indication of the ability of the golf club head to resist twisting about the CG x-axis. A higher moment of inertia about the CG x-axis ($I_{xx}$) indicates a higher resistance to the upward and downward twisting of the golf club head 10100 resulting from high and low off-center impacts with the golf ball.

In certain embodiments of the disclosed golf club heads, the moment of inertia $I_{xx}$ is at least 250 kg-mm$^2$. For example, in certain embodiments, the moment of inertia $I_{xx}$ is between 250 kg-mm$^2$ and 800 kg-mm$^2$. It has been observed that for embodiments of the disclosed golf club heads in which the projected CG on the club head face is lower than the geometric center, a lower moment of inertia can increase the dynamic loft and decrease the backspin experienced by a golf ball struck at the geometric center of the club. Thus, in particular embodiments, the moment of inertia $I_{xx}$ is relatively low (e.g., between 250 kg-mm$^2$ and 500 kg-mm$^2$). In such embodiments, the relatively low moment of inertia contributes to the reduction in golf ball spin, thereby helping a golf ball obtain the desired high launch, low spin trajectory (e.g., a trajectory similar to that shown in FIG. 33). In still other embodiments, the moment of inertia is less than 250 kg-mm$^2$ (e.g., between 150-250 kg-mm$^2$ or between 200-250 kg-mm$^2$). Adjusting the location of the discretionary mass in a golf club head using the methods described herein can provide the desired moment of inertia $I_{xx}$ in embodiments of the disclosed golf club heads.

E. Delta 1

Delta 1 ("$\Delta_1$") is a measure of how far rearward in the club head body 10110 the CG is located. More specifically, Delta 1 is the distance between the CG and the hosel axis along the y axis (in the direction straight toward the back of the body of the golf club face from the geometric center of the striking face). It has been observed that for embodiments of the disclosed golf club heads, smaller values of Delta 1 result in lower projected CGs on the club head face. Thus, for embodiments of the disclosed golf club heads in which the projected CG on the ball striking club face is lower than the geometric center, reducing Delta 1 can lower the projected CG and increase the distance between the geometric center and the projected CG. Recall also that a lower projected CG creates a lower dynamic loft and more reduction in backspin due to the z-axis gear effect. Although the club loft angle is static, when the $\Delta_1$ is large, the CG of the golf club head is in a position to cause added loft to the club head during use. This occurs because, at impact, the offset CG of the golf club head from the shaft axis creates a moment of the golf club head about the x-axis (heel to toe axis) that causes rotation of the golf club head about the x-axis. The larger $\Delta_1$ becomes, the greater the moment arm to generate a moment about the x-axis. Therefore, if $\Delta_1$ is particularly large, greater rotation is seen of the golf club head about the x-axis. The increased rotation leads to added loft at impact.

Thus, for particular embodiments of the disclosed golf club heads, the Delta 1 values are relatively small, thereby reducing the amount of backspin on the golf ball and helping the golf ball obtain the desired high launch, low spin trajectory (e.g., a trajectory similar to that shown in FIG. 33). For example, in certain embodiments, the Delta 1 values are 25 mm or less (e.g., in the range of 10-25 mm). Adjusting the location of the discretionary mass in a golf club head as described herein can provide the desired Delta 1 value. For instance, Delta 1 can be manipulated by varying the mass in front of the CG (closer to the face) with respect to the mass behind the CG. That is, by increasing the mass behind the CG with respect to the mass in front of the CG, Delta 1 can be increased. In a similar manner, by increasing the mass in front of the CG with the respect to the mass behind the CG, Delta 1 can be decreased.

G. Volume

Embodiments of the disclosed golf club heads disclosed herein can have a variety of different volumes. For example, certain embodiments of the disclosed golf club heads are for drivers and have a head volume of between 250 and 460 cm$^3$ and a weight of between 180 and 210 grams. Other embodiments of the disclosed golf club heads may include fairway woods incorporating any one or more aspects of the disclosed technology and having a volume between about 130 and 220 cm$^3$ and a weight of between about 190 and 225 grams, whereas embodiments of so-called hybrid woods incorporating any one or more aspects of the disclosed technology may have a volume between about 80 and 150 cm$^3$ and a weight of between about 210 and 240 grams. Other embodiments of the disclosed golf club heads have a volume larger than 460 cm$^3$. If such a club head is desired, it can be constructed as described herein by enlarging the size of the strike plate and the outer shell of the golf club head. Furthermore, such "large" club heads allow for greater opportunity to achieve a lower $CG_z$ in the golf club head. It should also be understood that golf club heads that have volumes or dimensions in excess of the current U.S.G.A. rules on clubs and ball are possible and contemplated by this disclosure.

H. Low and Forward Center of Gravity

Until recently, conventional wisdom has been to move the center of gravity ("CG") position of the clubhead rearward, as this movement of the CG can increase the clubhead's moment of inertia in some designs. The golf club head 10100 described herein is an example of moving the CG position of the clubhead low and rearward. However, there are several unexpected advantages of placing the weight in the forward position of the clubhead which results in a lower projection point of the center of gravity onto the face as compared to one where the CG is further back from the face. This in turn can reduce the effect of so called "dynamic lofting" which occurs during the golf swing when the Ai is particularly large.

Although dynamic lofting may be desired in some situations, and, as such, low and rearward CG may be a desired design element, it can causes some negative effects on the resulting ball flight. First, for each degree of added dynamic loft, launch angle increases by 0.5-0.75°. Second, for each degree of added dynamic loft, spin rate increases by about 200-250 rpm.

An advantage of low forward CG is that the center of gravity projects closer to the center face, which gives lower spin and more ballspeed for center face impacts. Also, with low forward CG, the club has less dynamic loft at impact which may require the golfer to use a club with higher static loft. For example, a club with a CGz less than −2 mm, and Delta 1 of less than 16 mm could require a higher loft than a standard CG position. In specific embodiments, the static loft is between 11° and 19°. More preferably, it could be advantageous to have a static loft between 14° and 17° for a driver with a volume greater than 400 cc. More preferably, the Delta 1 would be less than 14 mm or even more preferably less than 12 mm. Also, more preferably the CGz would be less than −3 mm or even more preferably less than −4 mm.

The increased spin rate is due to several factors. First, the dynamic lofting simply creates higher loft, and higher loft leads to more backspin. The second and more unexpected explanation is gear effect. The projection of a rearward CG onto the face of the golf club head creates a projection point above center face (center face being the ideal impact location for most golf club heads). Gear effect theory states that, when the projection point is offset from the strike location, the gear effect causes rotation of the golf ball toward the projection point. Because center face is an ideal impact location for most golf club heads, offsetting the projection point from the center face can cause a gear effect on perfectly struck shots. Thus loft of the golf club head causes the projection point to be above the center face—or, above the ideal strike location. This results in a gear effect on center strikes that causes the ball to rotate up the face of the golf club head, generating even greater backspin. Backspin may be problematic in some designs because the ball flight will "balloon"—or, in other words, rise too quickly—and the distance of travel of the resultant golf shot will be shorter than for optimal spin conditions.

A further consideration with offsetting the CG such that the projection point is not aligned with center face is the potential loss of energy due to spin. Because of the aforementioned gear effect problem, moving the projection point anywhere other than the ideal strike location reduces the energy transfer on ideal strikes, as more energy is turned into spin. As such, golf club heads for which the projection point is offset from the ideal strike location may experience less distance on a given shot than golf club heads for which the projection point is aligned with the ideal strike location (assumed to be at center face).

Slidably Repositionable Weight

According to some embodiments of the golf club heads described herein, the golf club head includes a slidably repositionable weight. Among other advantages, a slidably repositionable weight facilitates the ability of the end user of the golf club to adjust the location of the CG of the club head over a range of locations relating to the position of the repositionable weight. FIGS. 19-24 show an exemplary golf club head having a slidably repositionable weight retained within a channel located at a forward region of the sole of the club head. The weight is slidably repositionable such that it can be positioned at a plurality of selected points between the heel and toe ends of the channel.

The exemplary golf club heads described herein and shown in FIGS. 19-24 can include an adjustable sole piece and internal sole ribs, an adjustable shaft attachment system, a variable thickness face plate, thin wall body construction, movable weights inserted in weight ports, and/or any other club head features described herein. While this description proceeds with respect to the particular embodiments shown in FIGS. 19-24, these embodiments are only exemplary and should not be considered as a limitation on the scope of the underlying concepts. For example, although the illustrated examples include many described features, alternative embodiments can include various subsets of these features and/or additional features.

Figure 19A:
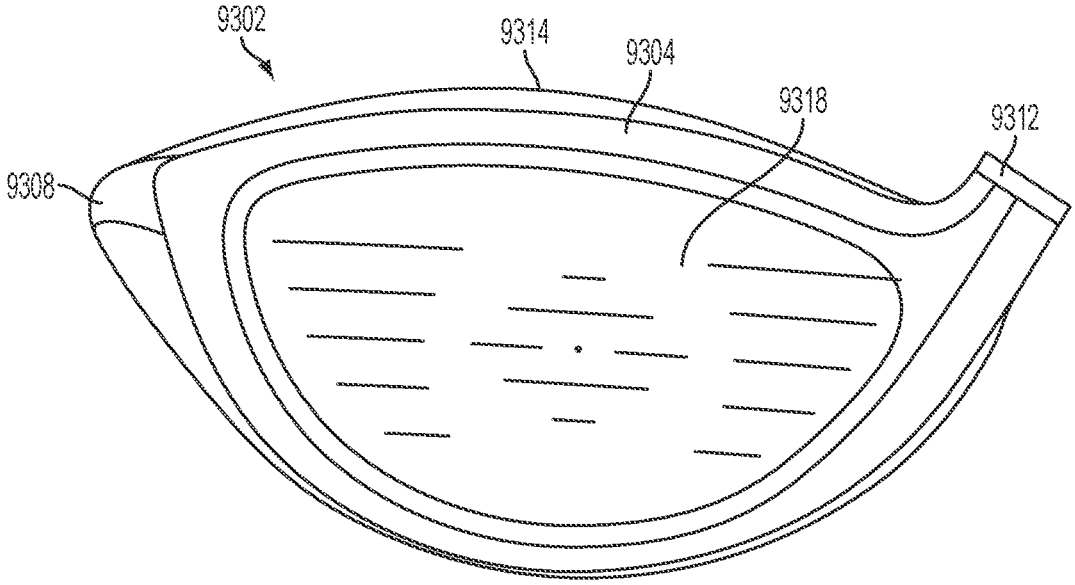
FIGS. 19A-B are front and bottom views, respectively, of a golf club head, according to an embodiment.
Figure 19B:
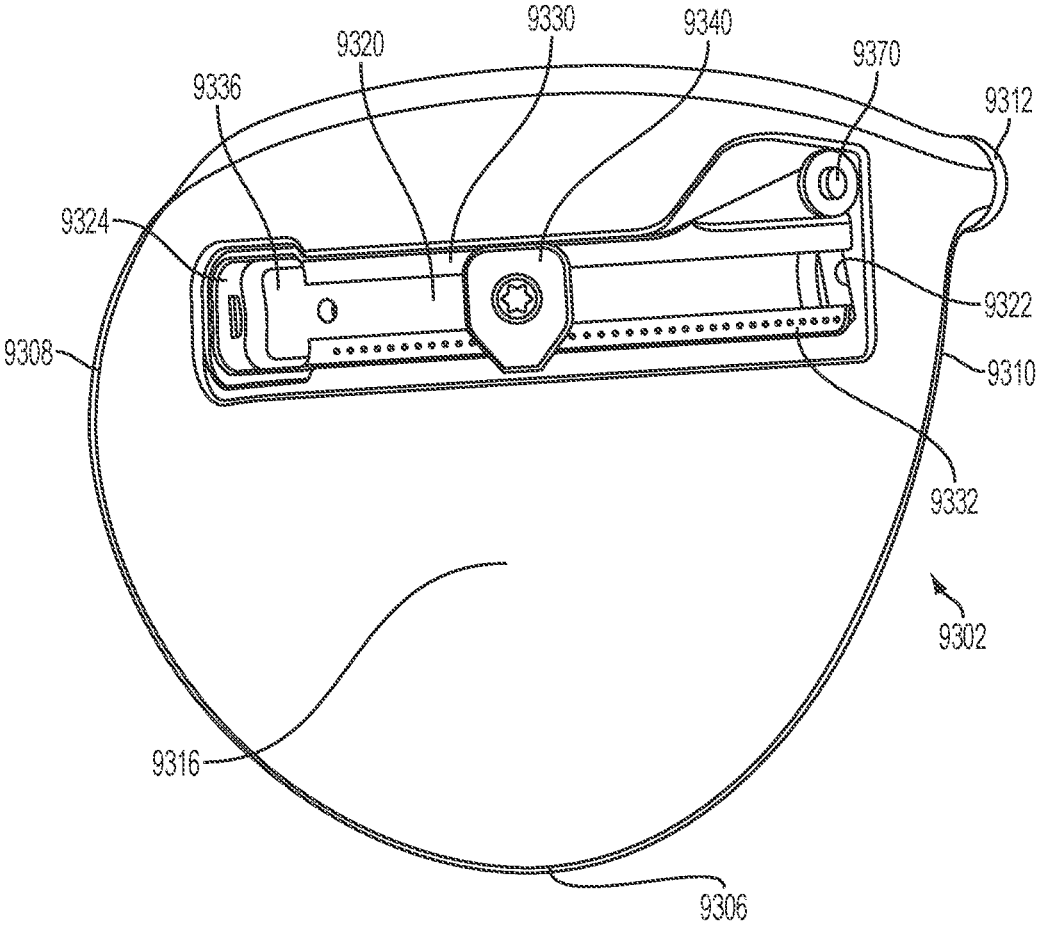
Figure 20A:
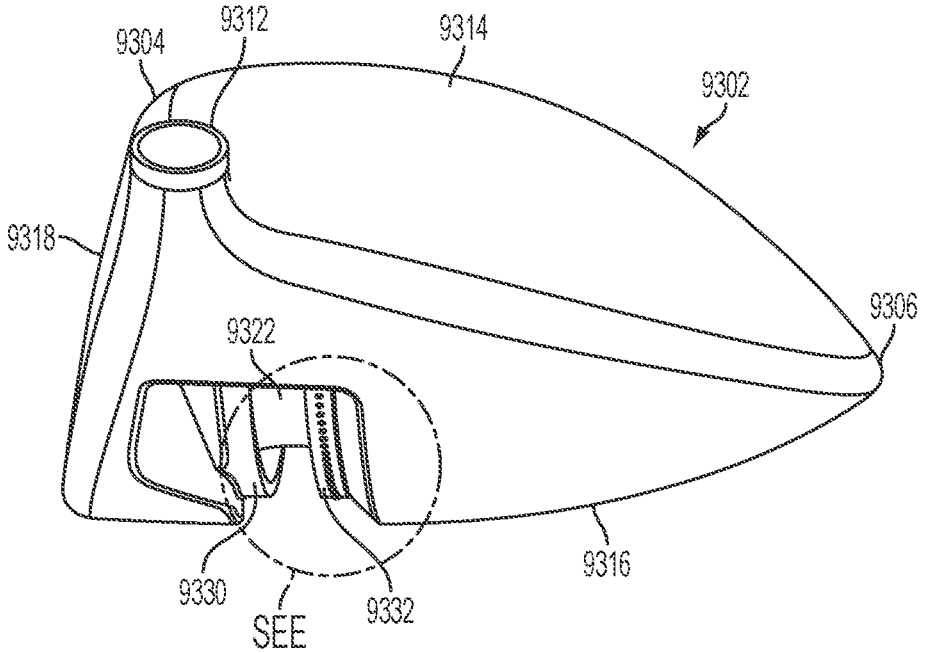
FIG. 20A is a heel side view of the golf club head of FIGS. 19A-B, with the weight assembly removed for clarity.
Figure 20B:
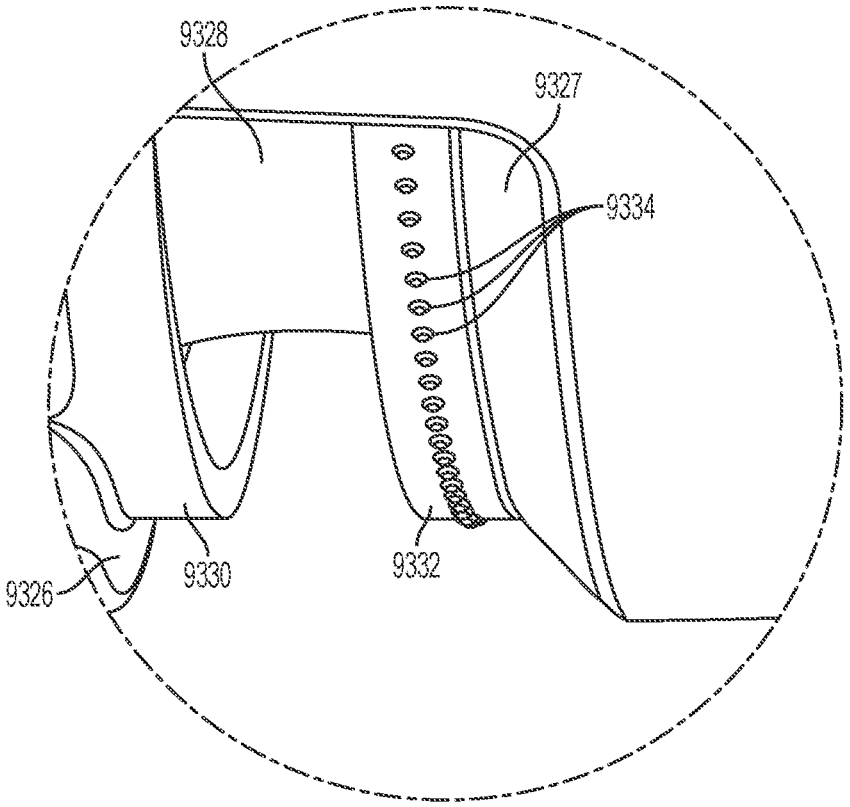
FIG. 20B is a close up view taken along inset line "B" in FIG. 20A.
Figure 21A:
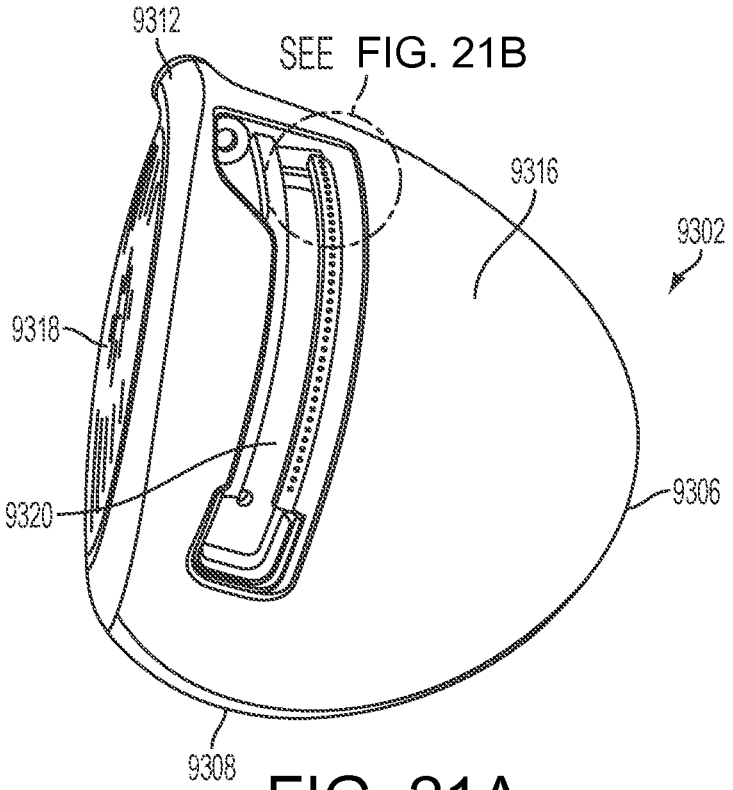
FIG. 21A is a bottom view of the golf club head of FIGS. 19A-B, with the weight assembly removed for clarity.
Figure 21B:
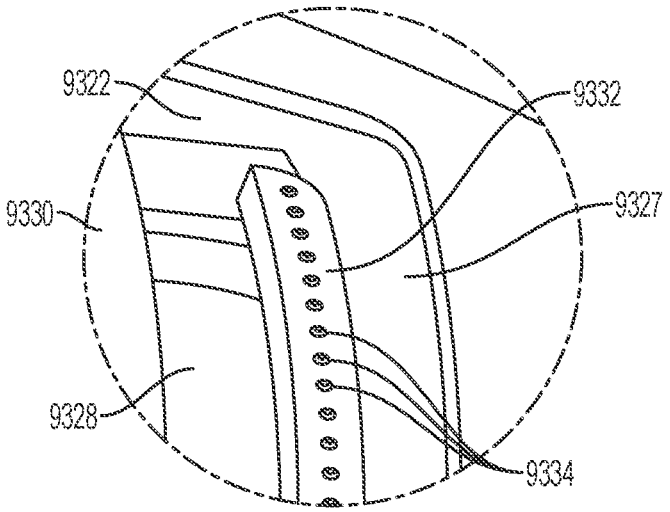
FIG. 21B is a close up view taken along inset line "B" in FIG. 21A.

FIGS. 19A-B show several views of an exemplary golf club head 9300. The head 9300 comprises a hollow body 9302. The body 9302 (and thus the whole club head 9300) includes a front portion 9304, a rear portion 9306, a toe portion 9308, a heel portion 9310, a hosel 9312, a crown 9314 and a sole 9316. The front portion 9304 forms an opening that receives a face plate 9318, which can be a variable thickness, composite, and/or metal face plate, as described herein.

The illustrated club head 9300 can also comprise an adjustable shaft connection system for coupling a shaft to the hosel 9312, such as the adjustable shaft connection systems described herein, the details of which are not repeated here and not shown in FIGS. 19A-B for clarity. For example, a passageway 9370 to provide passage of an attachment screw (not shown) is included in the embodiments shown.

The adjustable shaft connection system may include various components, such as (without limitation) a sleeve and a ferrule (more detail regarding the hosel and the adjustable shaft connection system can be found, for example, in U.S. Pat. No. 7,887,431 and U.S. patent application Ser. Nos. 13/077,825, 12/986,030, 12,687,003, 12/474,973, which are incorporated herein by reference in their entirety). The shaft connection system, in conjunction with the hosel 9312, can be used to adjust the orientation of the club head 9300 with respect to the shaft, as described herein. The illustrated club head 9300 may also include an adjustable sole piece at a sole port or pocket, as also described herein.

In the embodiments shown in FIGS. 19A-B, the club head 9302 is provided with an elongated channel 9320 on the sole 9316 that extends generally from a heel end 9322 oriented toward the heel portion 9310 to a toe end 9324 oriented toward the toe portion 9308. A front ledge 9330 and a rear ledge 9332 are located within the channel 9320, and a weight assembly 9340 is retained on the front and rear ledges 9330, 9332 within the channel 9320. In the embodiment shown, the channel 9320 is merged with the hosel opening 340 that forms a part of a head-shaft connection assembly.

Turning next to FIGS. 20A-B and 21A-B, additional details relating to the channel 9320 and front and rear ledges 9330, 9332 are shown in the illustrated embodiments in which the weight assembly 9340 is not included for clarity. In the embodiments shown, the channel 9320 includes a front channel wall 9326, a rear channel wall 9327, and a bottom channel wall 9328. The front, rear, and bottom channel walls 9326, 9327, 9328 collectively define an interior channel volume within which the weight assembly 9340 is retained. The front ledge 9330 extends rearward from the front channel wall 9326 into the interior channel volume, and the rear ledge 9332 extends forward from the rear channel wall 9327 into the interior channel volume.

In some embodiments, a plurality of locking projections 9334 are formed on a surface of one or more of the front and rear ledges 9330, 9332. In the embodiments shown, the locking projections 9334 are located on an outward-facing surface of the rear ledge 9332. As described more fully below, each of the locking projections 9334 has a size and shape adapted to engage one of a plurality of locking notches formed on the weight assembly 9340 to thereby retain the weight assembly 9340 in a desired location within the channel 9320. In the embodiment shown, each locking projection 9334 has a generally hemispherical shape.

In alternative embodiments, the locking projections 9334 may be located on one or more other surfaces defined by the front ledge 9330 and/or rear ledge 9332. For example, in some embodiments, locking projections are located on an outward facing surface of the front ledge 9330, while in other embodiments the locking projections are located on an inward-facing surface of one or both of the front ledge 9330 and rear ledge 9332. In further embodiments, the weight assembly 9340 is retained on the front and rear ledges 9330, 9332 without the use of locking projections. In still further embodiments, a plurality of locking notches (not shown in the Figures) are located on one or more surfaces of the front and rear ledges 9330, 9332 and are adapted to engage locking projections that are located on engaging portions of the weight assembly 9340. All such combinations, as well as others, may be suitable for retaining the weight assembly 9340 at selected locations within the channel 9320.

In alternative embodiments, the plurality of projections 9334 serve as markers or indices to help locate the position of the weight assembly 9340 along the channel but do not perform any locking function. Instead, the weight assembly 9340 is locked into place at a selected position along the channel by tightening the bolt 9346. In these embodiments, the plurality of projections 9334 are sized of a width smaller than the width of the recesses 9348 in the washer 9342 such that the washer 9342 can move a limited amount when placed over one of the projections 9334.

Turning next to FIGS. 22A-B, additional details relating to the channel 9320 and front and rear ledges 9330, 9332 are shown in the illustrated embodiments in which the weight assembly 9340 is not included for clarity. In the embodiments shown, the channel 9320 includes a front channel wall 9326, a rear channel wall 9327, and a bottom channel wall 9328. The front, rear, and bottom channel walls 9326, 9327, 9328 collectively define an interior channel volume within which the weight assembly 9340 is retained. The front ledge 9330 extends rearward from the front channel wall 9326 into the interior channel volume, and the rear ledge 9332 extends forward from the rear channel wall 9327 into the interior channel volume.

In the embodiments shown in the Figures, the channel 9320 is substantially straight within the X-Y plane (see, e.g., FIG. 19B), and generally tracks the curvature of the sole 9316 within the X-Z and Y-Z planes (see, e.g., FIGS. 19A-B). The channel 9320 is located in a forward region of the sole 9316, i.e., toward the front portion 9304 of the club head. For example, in some embodiments, the entire channel 9320 is located in a forward 50% region of the sole 9316, such as in a forward 40% region of the sole 9316, such as in a forward 30% region of the sole 9316. The referenced forward regions of the sole are defined in relation to an imaginary vertical plane that intersects an imaginary line extending between the center of the face plate 9318 and the rearward-most point on the rear portion 9306 of the club head. The imaginary vertical plane is also parallel to a vertical plane which contains the shaft longitudinal axis when the shaft 50 is in the correct lie (i.e., typically 60 degrees±5 degrees) and the sole 9316 is resting on the playing surface 70 (the club is in the grounded address position). The imaginary line is assigned a length, L. Accordingly, the forward 50% region of the sole is the region of the sole 9316 located toward the front portion 9304 of the club head relative to the imaginary vertical plane where the imaginary vertical plane is located at a distance of 0.5*L from the center of the face plate 9318. The forward 40% region of the sole is the region of the sole 9316 located toward the front portion 9304 of the club head relative to the imaginary vertical plane where the imaginary vertical plane is located at a distance of 0.4*L from the center of the face plate 9318. The forward 30% region of the sole is the region of the sole 9316 located toward the front portion 9304 of the club head relative to the imaginary vertical plane where the imaginary vertical plane is located at a distance of 0.3*L from the center of the face plate 9318.

In the embodiments shown, the minimum distance between a vertical plane passing through the center of the face plate 9318 and the channel 9320 at the same x-coordinate as the center of the face plate 9318 is between about 10 mm and about 50 mm, such as between about 20 mm and about 40 mm, such as between about 25 mm and about 30 mm. In the embodiments shown, the width of the channel (i.e., the horizontal distance between the front channel wall 9326 and rear channel wall 9327 adjacent to the locations of front ledge 9330 and rear ledge 9332) may be between about 8 mm and about 20 mm, such as between about 10 mm and about 18 mm, such as between about 12 mm and about 16 mm. In the embodiments shown, the depth of the channel (i.e., the vertical distance between the bottom channel wall 9328 and an imaginary plane containing the regions of the sole 9316 adjacent the front and rear edges of the channel 9320) may be between about 6 mm and about 20 mm, such as between about 8 mm and about 18 mm, such as between about 10 mm and about 16 mm. In the embodiments shown, the length of the channel (i.e., the horizontal distance between the heel end 9322 of the channel and the toe end 9324 of the channel) may be between about 30 mm and about 120 mm, such as between about 50 mm and about 100 mm, such as between about 60 mm and about 90 mm.

The weight assembly 9340 and the manner in which the weight assembly 9340 is retained on the front and rear ledges 9330, 9332 within the channel 9320 are shown in more detail in FIGS. 22A-B. In the embodiments shown, the weight assembly 9340 includes three components: a washer 9342, a mass member 9344, and a fastening bolt 9346. The washer 9342 is located within an outer portion of the interior channel volume, engaging the outward-facing surfaces of the front ledge 9330 and rear ledge 9332. The mass member 9344 is located within an inner portion of the interior channel volume, engaging the inward-facing surfaces of the front ledge 9330 and rear ledge 9332. The fastening bolt 9346 has a threaded shaft that extends through a center aperture 9353 of the washer 9342 and engages mating threads located in a center aperture 9361 of the mass member 9344.

Each of the washer 9342 and the mass member 9344 may be formed of materials such as aluminum, titanium, stainless steel, tungsten, metal alloys containing these materials, or combinations of these materials. The fastening bolt 9346 is preferably formed of titanium alloy or stainless steel. In the embodiments shown, each of the washer 9342 and mass element 9344 has a length and width that ranges from about 8 mm to about 20 mm, such as from about 10 mm to about 18 mm, such as from about 12 mm to about 16 mm. The height of the washer 9342 and mass element 9344 embodiments shown in the Figures is from about 2 mm to about 8 mm, such as from about 3 mm to about 7 mm, such as from about 4 mm to about 6 mm.

The addition of the channel 9320 and an attached adjustable weight assembly 9340 can undesirably change the sound the club makes during impact with a ball. Accordingly, one or more ribs 9380 are provided on the internal surface of the sole (i.e., within the internal cavity of the club head 9300). The ribs 9380 on the internal surface of the sole can be oriented in several different directions and can tie the channel 9320 to other strong structures of the club head body, such as the sole of the body and/or the skirt region between the sole and the crown. One or more ribs can also be tied to the hosel to further stabilize the sole. With the addition of such ribs on the internal surface of the sole, the club head can produce higher sound frequencies when striking a golf ball on the face.

In some embodiments, the weight assembly 9340 is installed into the channel 9320 by placing the weight assembly 9340 into an installation cavity 9336 located adjacent to the toe end 9324 of the channel. The installation cavity 9336 is a portion of the channel 9320 in which the front ledge 9330 and rear ledge 9332 do not extend, thereby facilitating placement of the assembled weight assembly 9340 into the channel 9320. Once placed into the installation cavity 9336, the weight assembly 9340 is shifted toward the heel end 9322 and into engagement with the front ledge 9330 and rear ledge 9332. After the weight assembly 9340 is shifted completely out of the installation cavity 9336, an optional cap or plug (see, e.g., FIG. 23) may be installed into the installation cavity 9336 to prevent removal of the weight assembly 9340 from the channel 9320.

Figure 23:
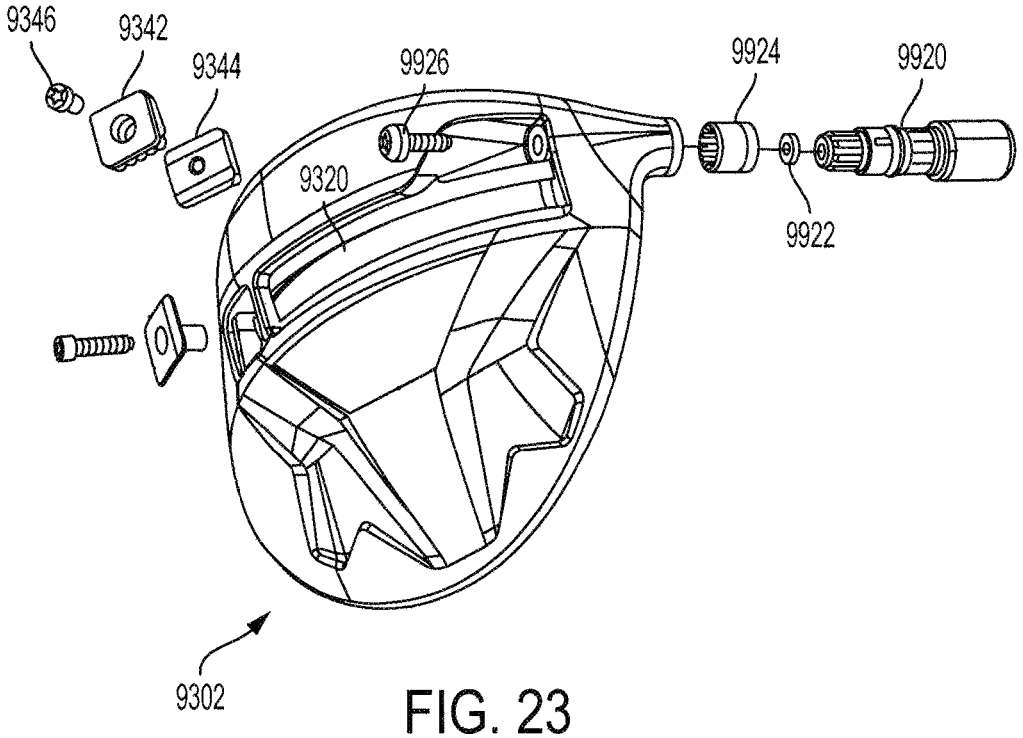
FIG. 23 is an exploded view of a golf club head, according to yet another embodiment.
Figure 24:
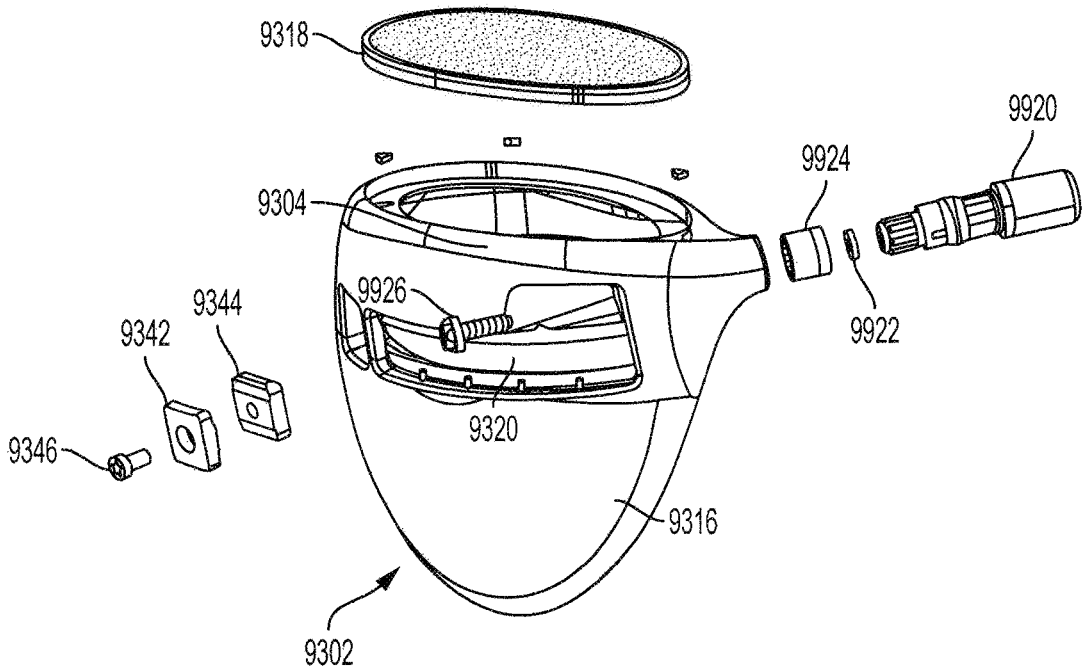
FIG. 24 is an exploded view of a golf club head, according to yet another embodiment.

The embodiment shown in FIG. 23 also includes an adjustable shaft attachment system for coupling a shaft to the hosel 9312, the system including various components, such as a sleeve 9920, a washer 9922, a hosel insert 9924, and a screw 9926 (more detail regarding the hosel and the adjustable shaft connection system can be found, for example, in U.S. Pat. No. 7,887,431 and U.S. patent application Ser. Nos. 13/077,825, 12/986,030, 12,687,003, 12/474,973, which are incorporated herein by reference in their entirety). The shaft connection system, in conjunction with the hosel 9312, can be used to adjust the orientation of the club head 9302 with respect to the shaft, as described herein and in the patents and applications incorporated by reference. Some embodiments may comprise a composite face plate. Further details concerning the construction and manufacturing processes for the composite face plate are described in U.S. Pat. No. 7,871,340 and U.S. Published Patent Application Nos. 2011/0275451, 2012/0083361, and 2012/0199282. The composite face plate is attached to an insert support structure located at the opening at the front portion 9304 of the club head. Further details concerning the insert support structure are described in U.S. Pat. No. RE43,801.

Further Embodiments Including a Slidably Repositionable Weight

The exemplary golf club heads described herein and shown in FIGS. 34-59 can include an adjustable sole piece and internal sole ribs, an adjustable shaft attachment system, a variable thickness face plate, thin wall body construction, movable weights inserted in weight ports, and/or any other club head features described herein. While this description proceeds with respect to the particular embodiments shown in FIGS. 34-59, these embodiments are only exemplary and should not be considered as a limitation on the scope of the underlying concepts. For example, although the illustrated examples include many described features, alternative embodiments can include various subsets of these features and/or additional features.

Turning attention to FIGS. 34A-D, another example of a golf club head, golf club head 12000, will now be described. Golf club head 12000 includes several of the structures and features of the previous embodiments, including a hollow body 12002A, a channel 12020 and a slidable weight assembly 12040. The body 12002A (and thus the whole club head 12000) includes a front portion 12004, a rear portion 12006, a toe portion 12008, a heel portion 12010, a hosel 12012, a crown 12014 and a sole 12016. The front portion 12004 forms an opening that receives a face plate 12018, which can be a variable thickness, composite, and/or metal face plate, as described herein.

The illustrated club head 12000 can also comprise an adjustable shaft connection system for coupling a shaft to the hosel 12012. The adjustable shaft connection system may include various components, such as (without limitation) a sleeve and a ferrule (more detail regarding the hosel and the adjustable shaft connection system can be found, for example, in U.S. Pat. No. 7,887,431 and U.S. patent application Ser. Nos. 13/077,825, 12/986,030, 12,687,003, 12/474,973, which are incorporated herein by reference in their entirety).

The club head 12000 is formed with a hosel opening 12070, or passageway, that extends from the hosel 12012 through the club head and opens at the sole, or bottom surface, of the club head. The hosel opening 12070 may allow for passage of an attachment screw (not shown) that forms a part of a head-shaft connection assembly. The shaft connection system, in conjunction with the hosel 12012, can be used to adjust the orientation of the club head 12000 with respect to the shaft, as described herein. The illustrated club head 12000 may also include an adjustable sole piece at a sole port or pocket, as also described herein.

In the embodiments shown in FIGS. 34A-D, the golf club head 12000 is provided with an elongated channel 12020 on a sole 12016 that extends generally from a heel end 12022 oriented toward a heel portion 12010 to a toe end 12024 oriented toward a toe portion 12008. A front ledge 12030 and a rear ledge 12032 are located within the channel 12020, and a weight assembly 12040 is retained on the front and rear ledges 12030, 12032 within the channel 12020. In the embodiment shown, the channel 12020 is merged with the hosel opening 12070 that forms a part of the head-shaft connection assembly.

In some embodiments channel 12020 may follow the curvature of the sole 12016. This allows the slidable weight to maintain a low and forward position, which in turn causes the CG to be lower and more forward. By positioning the weight assembly low and forward, we have found this produces a ball flight with less backspin.

Further, we have found that sliding the weight along the channel allows a golfer to better control his or her shot shape by repositioning the CGx of the club head. Moving the weight towards the toe of the club repositions the CGx to promote a fade bias. Likewise, moving the weight towards the heel of the club repositions the CGx to promote a draw bias.

However, we have found that repositioning the weight assembly can undesirably effect CGz. The effect on CGz is most pronounced when the weight assembly is in the extreme toe or heel position. In these extreme positions, the CG projects higher on the face resulting in a tradeoff between shot shape control and low CG. Accordingly, in some embodiments it may desirable to flatten the channel so that sliding the weight has less impact on CGz.

Figure 34A:
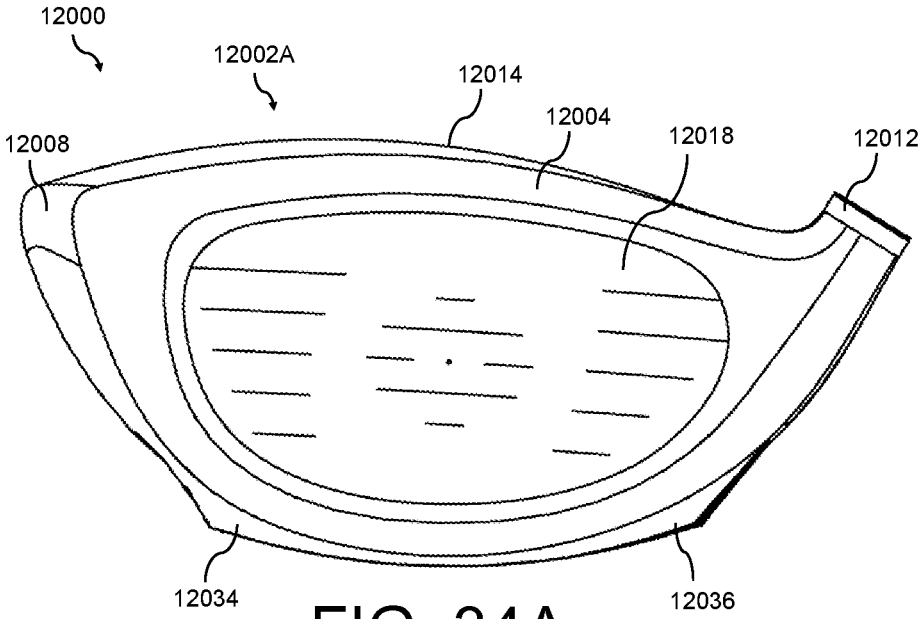
FIGS. 34A-D are front, bottom, toe side, and heel side views, respectively, of a golf club head, according to yet another embodiment.
Figure 34B:
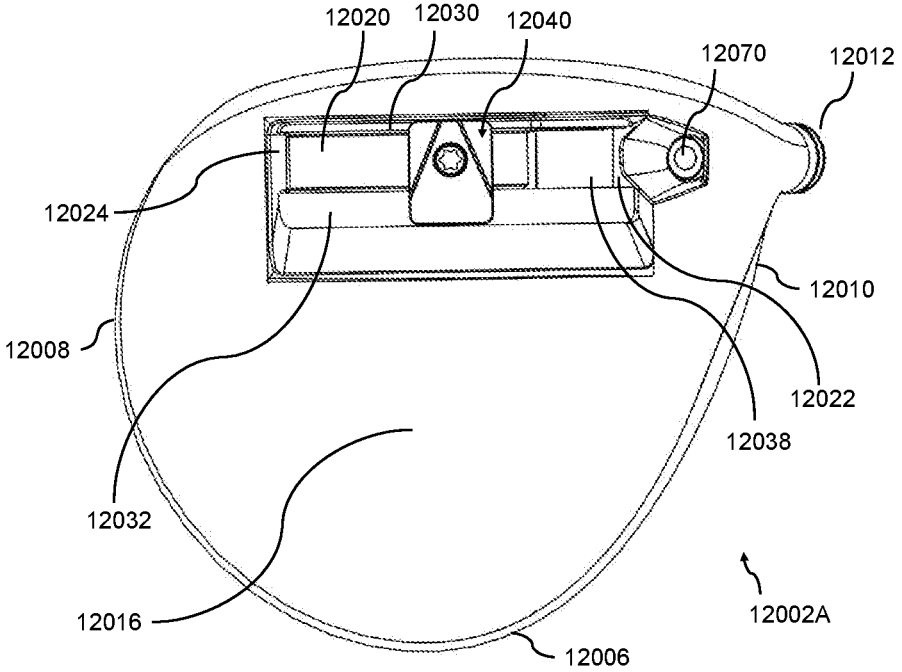
Figure 34C:
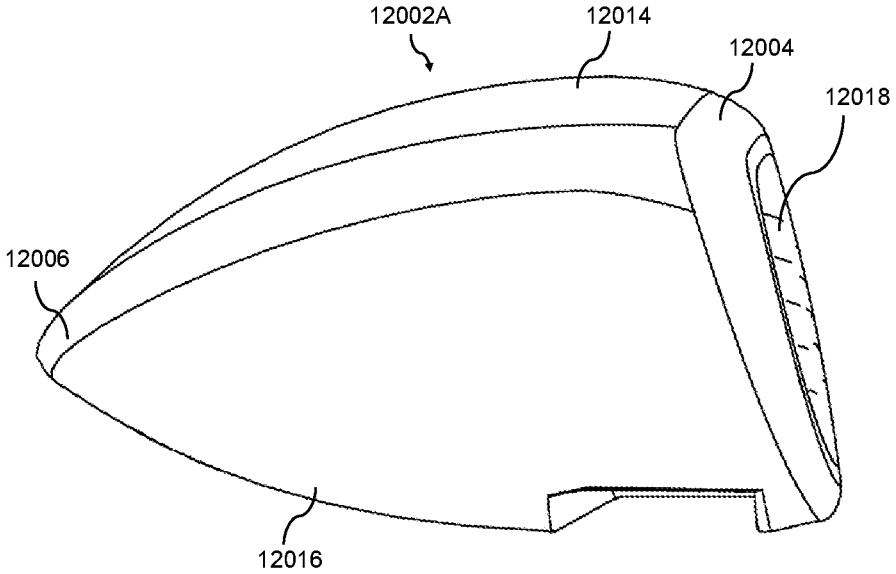
Figure 34D:
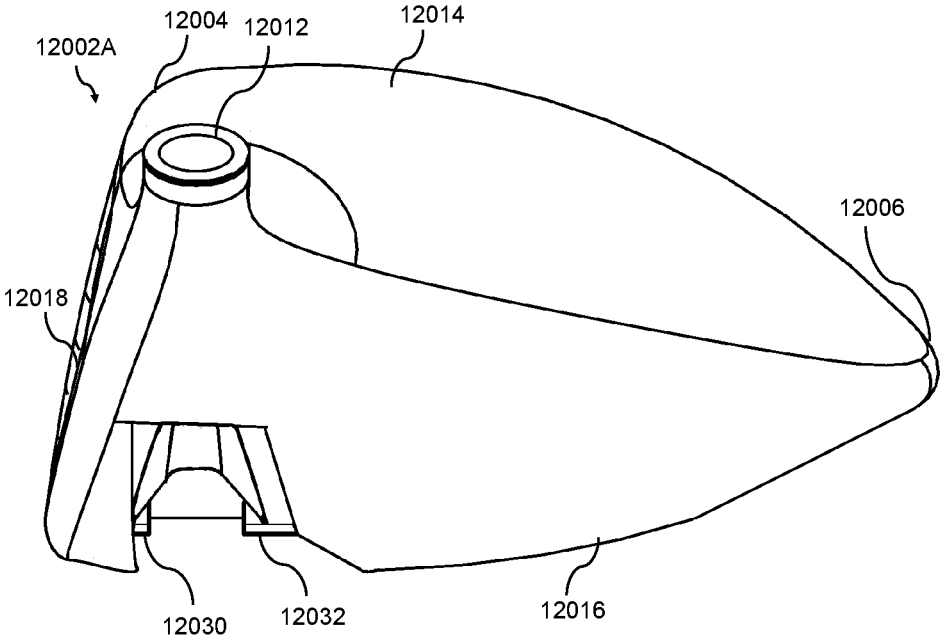

As shown in FIG. 34A, the sole of the club head includes a toe side winglet 12034 and a heel side winglet 12036. These built up portions of the sole allow the channel radius of curvature in the heel/toe direction to be different than that of the sole. Typically, the sole has a relatively rounded, e.g. 50-100 mm, heel/toe radius, and it could be desirable to have a larger radius, e.g. 100-150 mm, of curvature for the channel to maintain the weight at a lower vertical height when the weight(s) are in the heel and toe positions. This helps maintain a consistently low CGz as the weight assembly slides along the channel.

In some embodiments, the front and rear channel ledges may have radii in the range of 50 mm-400 mm, and a channel ledge thickness between 0.5 mm to 3.0 mm. In other embodiments, the front and rear channel ledges may be flat. In other embodiments, the front and rear channel ledges may include a combination of flat and rounded sections. As discussed above, a flatter channel or one with a large radius allows movement along the channel with less impact to CGz. This allows the CG to remain low and forward, which allows for a CG that projects lower on the striking face.

Figure 35A:
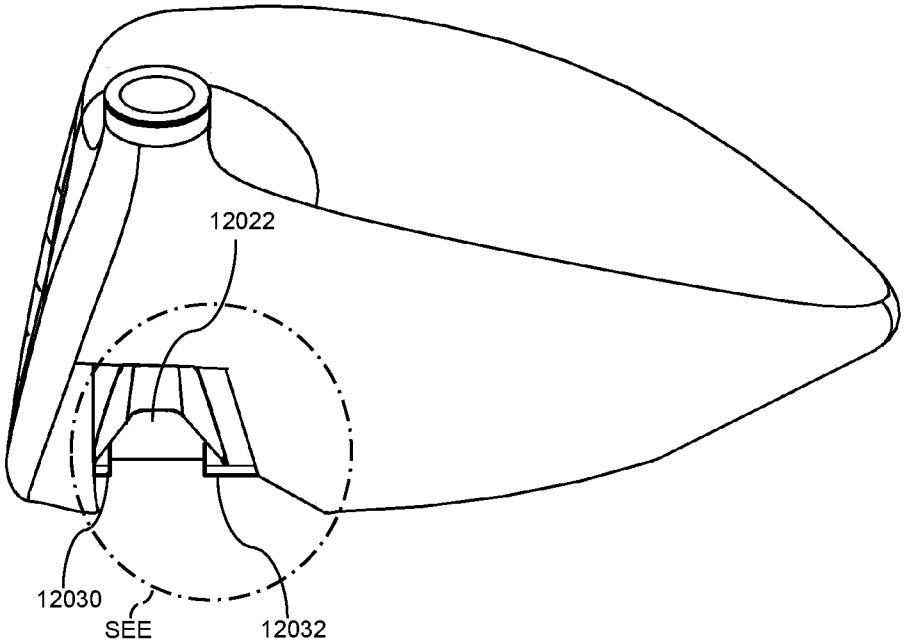
FIG. 35A is a heel side view of the golf club head of FIGS. 34A-D, with the weight assembly removed for clarity.
Figure 35B:
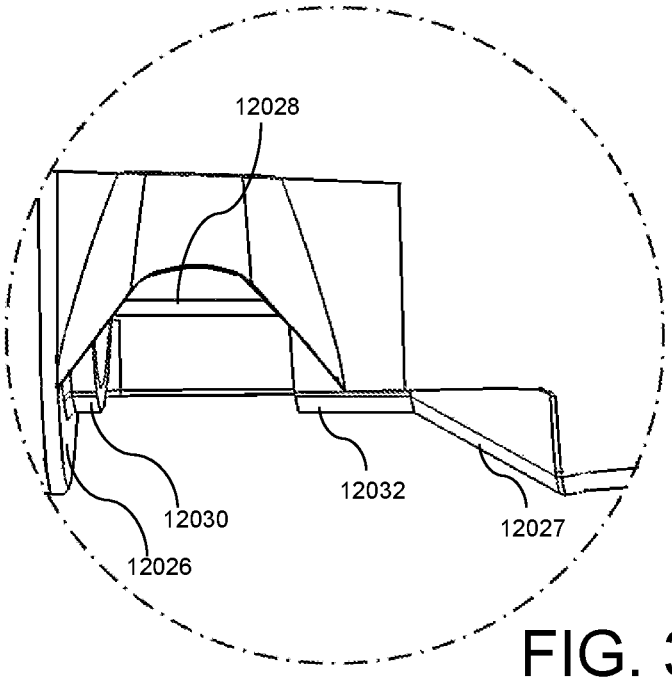
FIG. 35B is a close up view taken along inset line "B" in FIG. 35A.
Figure 36A:
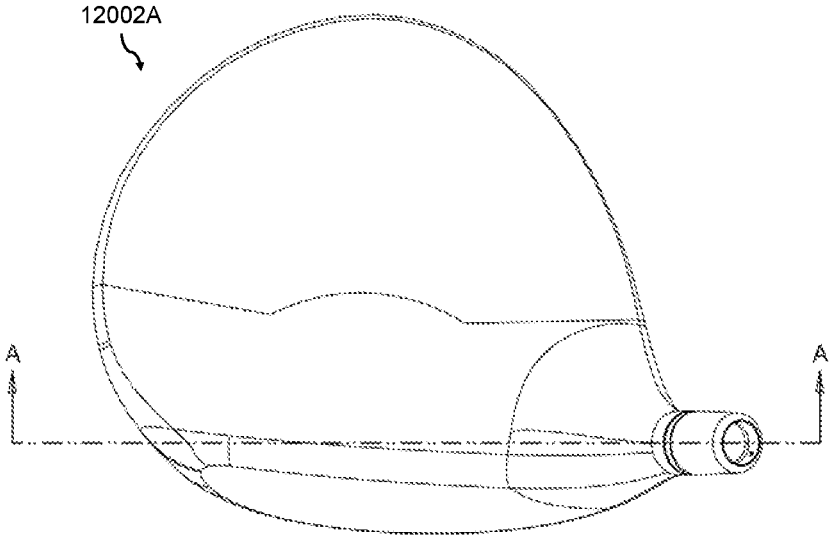
FIG. 36A is a top view of the golf club head of FIGS. 34A-D.
Figure 36B:
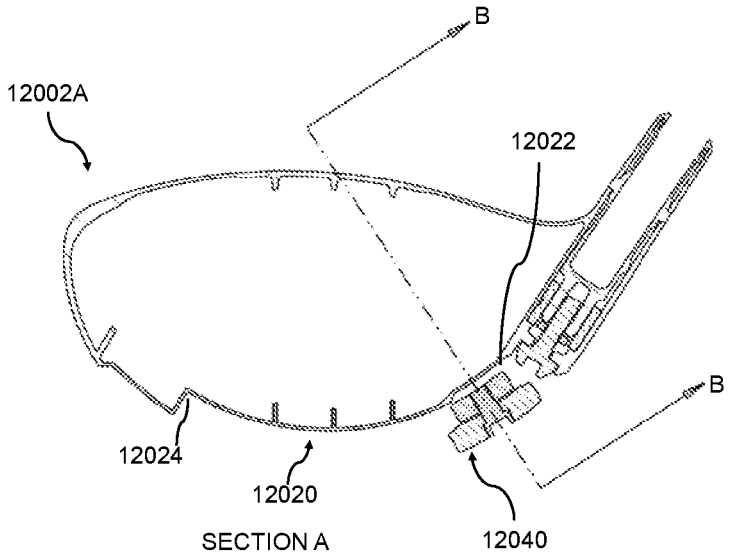
FIG. 36B is a cross-sectional view along line A-A of the golf club head of FIG. 36A.
Figure 36C:
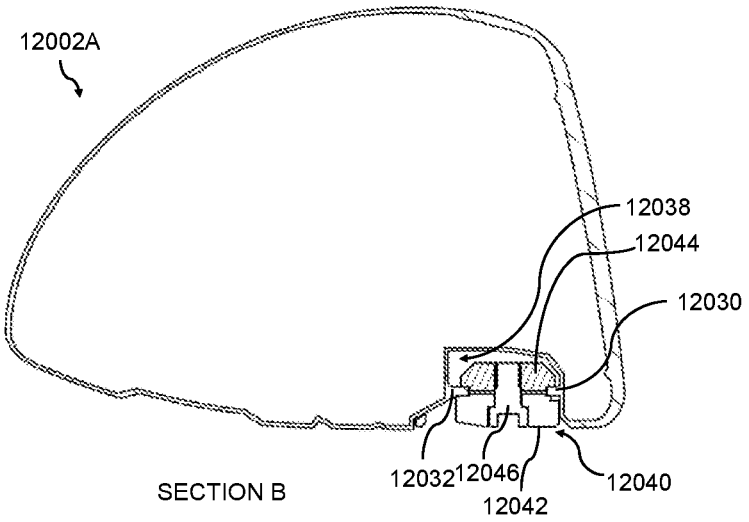
FIG. 36C is a cross-sectional view along line B-B of the golf club head of FIG. 36B.

Turning next to FIGS. 35A-B, additional details relating to the channel 12020 and front and rear ledges 12030, 12032 are shown in the illustrated embodiments in which the weight assembly 12040 is not included for clarity. In the embodiments shown, the channel 12020 includes a front channel wall 12026, a rear channel wall 12027, and a bottom channel wall 12028. The front, rear, and bottom channel walls 12026, 12027, 12028 collectively define an interior channel volume within which the weight assembly 12040 is retained. The front ledge 12030 extends rearward from the front channel wall 12026 into the interior channel volume, and the rear ledge 12032 extends forward from the rear channel wall 12027 into the interior channel volume. As shown channel 12020 may be an enclosed structure except for the open portion that weight assembly 12040 slides along. The channel 12020 may be an as-cast feature or a machined feature.

In the embodiments shown in FIGS. 34A-D, the channel 12020 is located in a forward region of the sole 12016, i.e., toward the front portion 12004 of the club head. For example, in some embodiments, the entire channel 12020 is located in a forward 50% region of the sole 12016, such as in a forward 40% region of the sole 12016, such as in a forward 30% region of the sole 12016. The referenced forward regions of the sole are defined in relation to an imaginary vertical plane that intersects an imaginary line extending between the center of the face plate 12018 and the rearward-most point on the rear portion 12006 of the club head. The imaginary vertical plane is also parallel to a vertical plane which contains the shaft longitudinal axis when the shaft 50 is in the correct lie (i.e., typically 60 degrees.+−.5 degrees) and the sole 12016 is resting on the playing surface 70 (the club is in the grounded address position). The imaginary line is assigned a length, L. Accordingly, the forward 50% region of the sole is the region of the sole 12016 located toward the front portion 12004 of the club head relative to the imaginary vertical plane where the imaginary vertical plane is located at a distance of 0.5*L from the center of the face plate 12018. The forward 40% region of the sole is the region of the sole 12016 located toward the front portion 12004 of the club head relative to the imaginary vertical plane where the imaginary vertical plane is located at a distance of 0.4*L from the center of the face plate 12018. The forward 30% region of the sole is the region of the sole 12016 located toward the front portion 12004 of the club head relative to the imaginary vertical plane where the imaginary vertical plane is located at a distance of 0.3*L from the center of the face plate 12018.

In the embodiments shown, the distance between the CG of the weight assembly 12040 and a first vertical plane passing through the center of the face plate 12018 at the same x-coordinate as the center of the face plate 12018 may be between about 5 mm and about 50 mm, such as between about 10 mm and about 40 mm, such as between about 25 mm and about 30 mm. In the embodiments shown, the width of the channel (i.e., the horizontal distance between the front channel wall 12026 and rear channel wall 12027 adjacent to the locations of front ledge 12030 and rear ledge 12032) may be between about 8 mm and about 20 mm, such as between about 10 mm and about 18 mm, such as between about 12 mm and about 16 mm. In the embodiments shown, the depth of the channel (i.e., the vertical distance between the bottom channel wall 12028 and an imaginary plane containing the regions of the sole 12016 adjacent the front and rear edges of the channel 12020) may be between about 6 mm and about 20 mm, such as between about 8 mm and about 18 mm, such as between about 10 mm and about 16 mm. In the embodiments shown, the length of the channel (i.e., the horizontal distance between the heel end 12022 of the channel and the toe end 12024 of the channel) may be between about 30 mm and about 120 mm, such as between about 50 mm and about 100 mm, such as between about 60 mm and about 90 mm.

The weight assembly 12040 and the manner in which the weight assembly 12040 is retained on the front and rear ledges 12030, 12032 within the channel 12020 are shown in more detail in FIGS. 36A-C and 37A-D. In the embodiments shown, the weight assembly 12040 includes three components: a washer 12042, a mass member 12044, and a fastening bolt 12046. The washer 12042 is located within an outer portion of the interior channel volume, engaging the outward-facing surfaces of the front ledge 12030 and rear ledge 12032. The mass member 12044 is located within an inner portion of the interior channel volume, engaging the inward-facing surfaces of the front ledge 12030 and rear ledge 12032. The fastening bolt 12046 has a threaded shaft that extends through a center aperture of the washer 12042 and engages mating threads located in a center aperture 12061 of the mass member 12044. This is a tension system for securing the weight assembly. Alternatively, the washer could have the mating threads in a center aperture, and the fastening bolt could go through a center aperture of the mass member and be tightened by a drive on the exposed outer surface of the bolt. In this embodiment, the head of the bolt would be captured on the inner surface of the mass member holding it in place during tightening.

In some embodiments, the washer 12042 may be heavier than mass member 12044, and vice versa. Or, the washer 12042 and the mass member 12044 may have similar masses. An advantage of making the washer heavier than the mass member is an even lower CG. The washer and/or mass member may have a mass in the range of 1 g to 50 g.

Figure 38A:
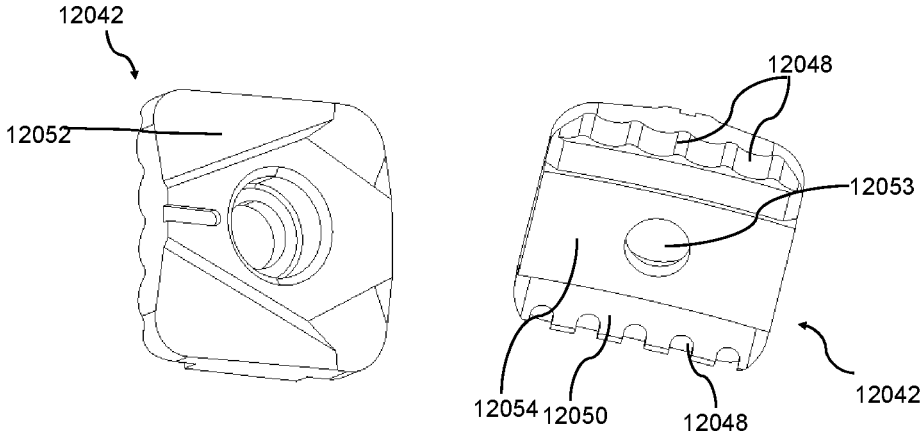
FIG. 38A includes top and bottom perspective views of a washer used with the weight assembly of the golf club head of FIGS. 34A-D.

As shown in FIG. 38A, and similar to the weight assembly discussed in relation to club head 9300, the washer 12042 includes an inward-facing surface 12050 and an outward-facing surface 12052. The washer 12042 may include a plurality of locking notches 12048 (either protrusions and/or indentations) located along the inward-facing surface 12050 of the washer such that the locking notches 12048 are adapted to engage locking projections 12034 (either protrusions and/or indentations) located on the rear ledge 12032 when the weight assembly 12040 is retained within the channel 12020.

The washer 12042 may further include a raised center ridge 12054 on the inward-facing surface 12050. The raised center ridge 12054 has a width dimension that is slightly smaller than the separation distance between the front ledge 12030 and rear ledge 12032, such that the center ridge 12054 is able to slide in the heel-to-toe direction within the channel 12020 while being laterally restrained by the front and rear ledges 12030, 12032.

Figure 38B:
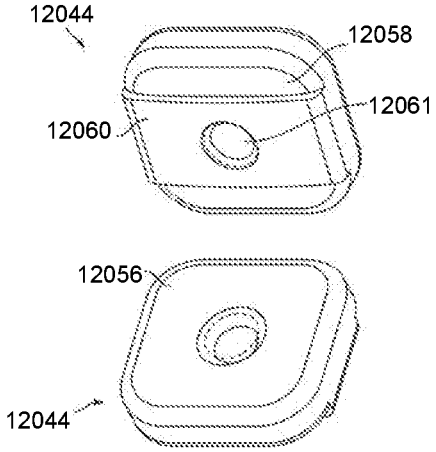
FIG. 38B includes top and bottom perspective views of a mass member used with the weight assembly of the golf club head of FIGS. 34A-D.

An embodiment of the mass member 12044 is shown in FIG. 38B. The mass member 12044 includes an inward-facing surface 12056, and outward-facing surface 12058, and a center ridge 12060 extending through the outward-facing surface 12058. The raised center ridge 12060 has a width dimension that is slightly smaller than the separation distance between the front ledge 12030 and rear ledge

12032, such that the center ridge 12060 is able to slide in the heel-to-toe direction within the channel 12020 while being laterally restrained by the front and rear ledges 12030, 12032. The mass member 12044 also has a threaded central aperture 12061 through which the threaded shaft of the fastening bolt 12046 is located.

In some embodiments, the washer is heavier than the mass member. This allows for the CG to be even lower. Additionally, this allows for the heavier piece (e.g. washer) to be removed and replaced with a different weight in fewer steps. Simply unscrewing the fastening bolt allows for removal of the washer, which can be replaced with a heavier or lighter weight depending on user preferences. This is an important improvement over other designs that typically have an additional step involved to remove or replace a weight. For example, other designs typically have something, e.g. a cap or plug, installed in, along, or adjacent a sliding weight track to prevent removal of a weight. Other designs require at least one additional step to remove the weight because this secondary object prevents the direct removal of the weight. Furthermore, these designs typically do not allow for full use of the sliding weight track because the item preventing removal of the weight typically hinders full use of the sliding weight track in some way. This design, however, in some embodiments may allow for full use of the channel with substantially no unusable portions.

Another concern with these alternative designs is failure of the part retaining the weight such that the part fails to maintain engagement with the club head during a round of golf. In some instances, this can result in a player's disqualification from a tournament. Accordingly, this design improves upon earlier designs by eliminating the additional piece, eliminating an additional step for weight removal, providing substantially full use of the channel, and eliminating the possibility of the failure described herein.

In some embodiments, the weight assembly 12040 is installed into the channel 12020 by placing the weight assembly 12040 into an installation cavity 12038 located adjacent to the heel end 12022 of the channel 12020. The installation cavity 12038 is a portion of the channel 12020 in which the front ledge 12030 and rear ledge 12032 extend, thereby allowing for full use of the channel 12020 with substantially no unusable portions along the channel. Once placed into the installation cavity 12038, the weight assembly 12040 may be engaged with the front ledge 12030 and rear ledge 12032 or the weight assembly 12040 may be shifted to another position along the channel 12020 and then engaged with the front ledge 12030 and rear ledge 12032.

Alternatively, as shown in FIGS. 37A-D, the weight assembly 12040 may be installed into the channel 12020 by first placing the mass member 12044 into the installation cavity 12038 located adjacent to the heel end 12022 of the channel 12020, then passing the fastening bolt 12046 through the center aperture 12053 of the washer 12042 and engaging the mating threads located on the mass member 12044.

Figure 37A:
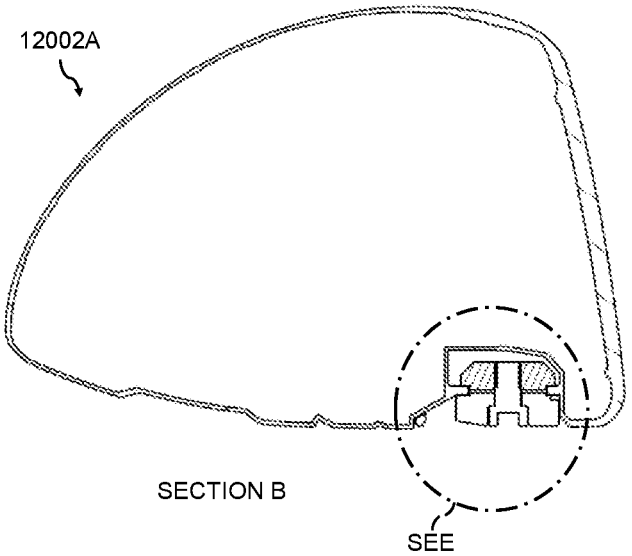
FIG. 37A is a cross-sectional view along line B-B of the golf club head of FIG. 36B.
Figure 37B:
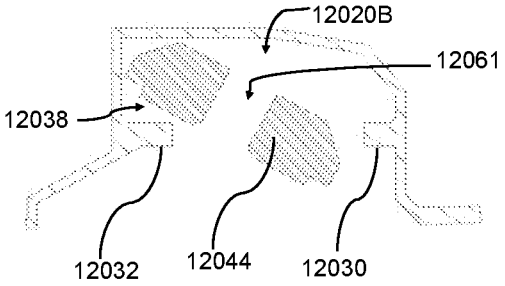
FIGS. 37B-D are close up cross-sectional views along line B-B of the golf club head of FIG. 36B with the bolt and washer of the weight assembly removed for clarity.
Figure 37D:
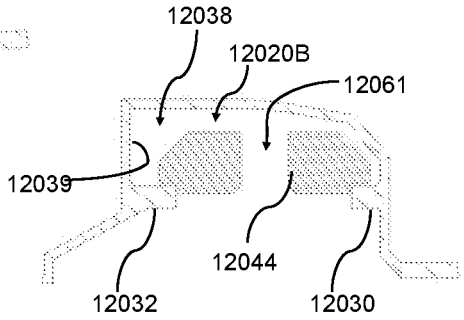
Figure 37C:
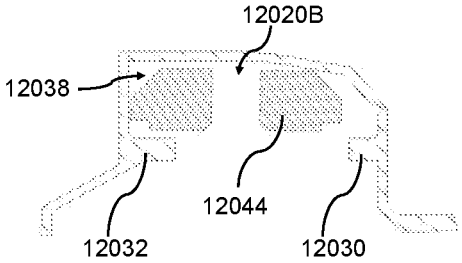

As shown in FIGS. 37A-D, placing the mass member 12044 into the installation cavity 12038 may require first angling the mass member 12044 relative to the channel (see FIG. 37B) and then inserting the mass member 12044 a sufficient distance underneath the rear ledge 12032 such that the mass member 12044 may rotate into position within the channel 12020 (see FIG. 37C). If the mass member 12044 is not inserted a sufficient distance it may not be able to rotate into position within the channel 12020 due to a possible interference with the front ledge 12030 of the channel 12020. Once the mass member is rotated into position, then the washer 12042 may be attached to the mass member 12044 using the fastening bolt 12046. FIG. 37D shows the how the mass member may transition slightly towards the front ledge when slid along the channel.

Similarly, the entire weight assembly 12040A may be installed using the same method as just described. First, the fastening bolt must loosely be holding the assembly together, next the entire assembly must be at an angle relative to the channel for insertion, then inserted into the channel such that the mass member and the washer sandwich a portion of the rear ledge, next the assembly may be rotated into position, adjusted so that the weight assembly is sandwiching both the front and rear ledges between the mass member and the washer, then the weight assembly may be slid to the desire position along the channel, and finally the fastening bolt may be tightened so as to securely engage the channel.

In some embodiments, the installation cavity 12038 may include a recessed or indented surface 12039 to facilitate installation of the mass member 12044 within the channel 12020. As shown, the recessed surface 12039 may be located between the rear ledge 12032 and the bottom channel wall 12028. Additionally or alternatively, the installation cavity 12038 and recessed surface 12039 may be located at a toe end 12024 of the channel 12020. Additionally or alternatively, the recessed surface 12039 may extend an entire length of the channel 12020 allowing for installation along the entire length of the channel. Additionally or alternatively, the recessed surface 12039 may be located between the front ledge 12030 and the bottom channel wall 12028.

The recess whether it extends the entire length of the channel or just a portion of the channel should be sized appropriately to accept the mass member or weight assembly. Typically this can be accomplished by making the channel dimensions slightly larger than the mass member so that mass member can slide with little resistance within the channel. In the embodiments shown, the mass member is rectangular in shape with some thickness, however the mass member could take the form of other geometric shapes and still engage the channel. For example, the mass member could be frusto-conical, circular, triangular, trapezoidal, hexagonal, or some other shape.

As already discussed, this method of installation allows for full use of the channel because the installation cavity 12038 is incorporated into the useable portion of the channel 12020. Additionally, in some embodiments, to remove the weight assembly the club head, mass member, or weight assembly must be rotated. This prevents the mass member or weight assembly from unintentionally disengaging from the channel.

The mass member may be removed from the channel in many different ways, the following description is one way in which a user may remove the mass member from the channel, but is not the only way and is design dependent. To remove the mass member from the channel a user may rotate the club so that the sole is facing upwards, e.g. towards the sky, and the toe of the club is facing the user, next the user may unscrew the bolt removing the bolt and the washer, next the mass member should be positioned within the installation cavity, then the user may slowly rotate the club clockwise until the mass member falls out. Depending on the channel and installation cavity design the mass member may fall out of the channel once the channel makes an angle of about 90 degrees or less with a horizontal plane, e.g. the ground. This description is specific to a channel having an installation cavity along only a portion of the channel, and the installation cavity is along the rearward ledge.

To use the adjustable weight system shown in the Figures, a user may use an engagement end of a tool (such as the torque wrench 6600 described herein) to loosen the fastening bolt 12046 of the weight assembly 12040. Once the fastening bolt 12046 is loosened, the weight assembly 12040 may be adjusted toward the toe portion 12008 or the heel portion 12010 by sliding the weight assembly 12040 in the desired direction within the channel 12020. Once the weight assembly 12040 is in the desired location, the fastening bolt 12046 is tightened until the clamping force between the washer 12042 and the mass member 12044 upon the front ledge 12030 and/or rear ledge 12032 is sufficient to restrain the weight assembly 12040 in place.

Figure 39A:
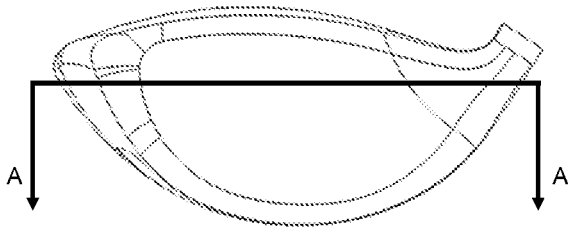
FIG. 39A is a front view of the golf club head of FIGS. 34A-D.
Figure 39B:
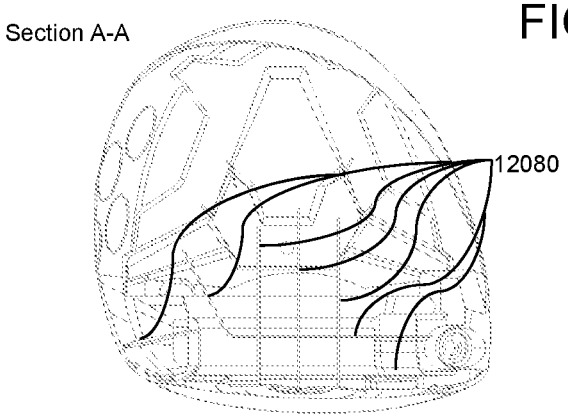
FIG. 39B is a cross-sectional view along line A-A of the golf club head of FIG. 39A showing various structural ribs.

The addition of the channel 12020 and an attached adjustable weight assembly 12040 can undesirably change the sound the club makes during impact with a ball. Accordingly, as shown in FIGS. 39A-B, one or more ribs 12080 may be provided on the internal surface of the sole and/or crown (i.e., within the internal cavity of the club head 12000). The ribs 12080 on the internal surface of the sole can be oriented in several different directions and can tie the channel 12020 to other strong structures of the club head body, such as the sole of the body and/or the skirt region between the sole and the crown. One or more ribs can also be tied to the hosel to further stabilize the sole. Additionally or alternatively, the ribs may go across the channel and may or may not connect to the front lower portion of the face or face lip. With the addition of such ribs on the internal surface of the sole, the club head can produce higher sound frequencies preferably greater than 2500 Hz, more preferably greater than 3000 Hz, most preferably greater 3400 Hz, when striking a golf ball on the face.

Slidably Repositionable Weight Compression System

Figure 41:
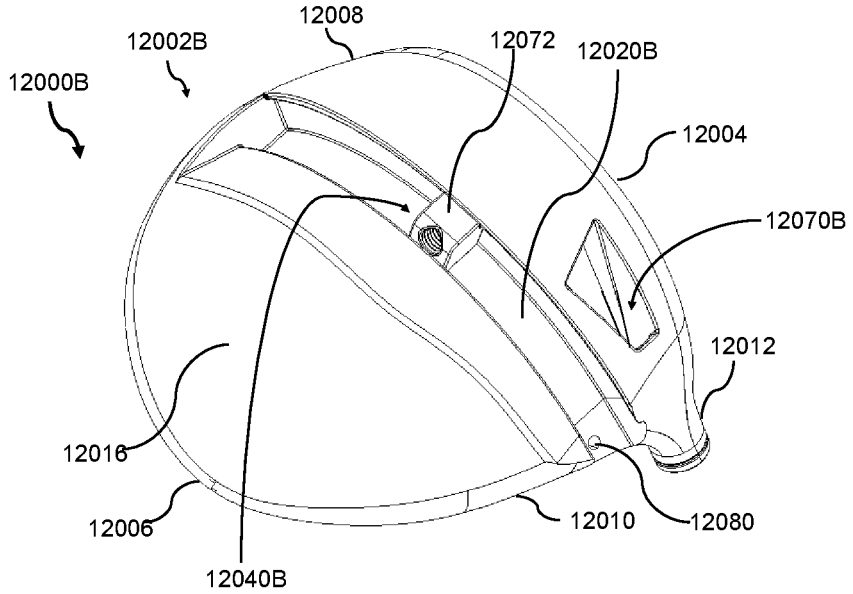
FIG. 41 is a perspective view of a golf club head, according to yet another embodiment.

Turning attention to FIG. 41, another example of a golf club body, golf club head 12000B, will now be described. Golf club head 12000B includes many similar or identical features to golf club head 12000 combined in unique and distinct ways. Thus, for the sake of brevity, each feature of golf club head 12000B will not be redundantly explained. Rather, key distinctions between golf club head 12000B and golf club head 12000 will be described in detail and the reader should reference the discussion above for features substantially similar between the two golf club heads.

As shown in FIG. 41, the body 12002B (and thus the whole club head 12000B) includes a front portion 12004, a rear portion 12006, a toe portion 12008, a heel portion 12010, a hosel 12012, a crown and a sole 12016. Golf club head 12000B, may include a channel 12020B that may be open at one or both ends allowing for a weight assembly 12040B to freely slide into position along the channel 12020B. Similar to the other embodiments already discussed, the channel 12020B may merge with the hosel opening 12070B. The weight assembly may include a slidable weight 12072 and a set screw (not shown). Tightening the set screw secures the weight assembly 12040B within the channel 12020B. The set screw presses against the channel going into compression and thereby compressing the slidable weight against the rearward portion of the channel. This is a compression system for securing the weight assembly. Additionally or alternatively, the open channel may include a bumper affixed to aperture 12080 to prevent the weight assembly from sliding out of the channel. This might be important if the set screw loosens during use.

Additionally or alternatively, the channel 12020B may be closed off at the heel and toe ends, and instead include an installation cavity similar to that discussed above in regard to channel 12020. The slidable weight 12072 could then be designed more similar to the mass member 12044 discussed above. Once the slidable weight 12072 was installed in the channel then the screw could be tightened, which would cause the screw to compress against the bottom of the channel and correspondingly cause the slidable weight to compress against the channel ledges, thereby securing the weight in place.

As discussed above, the channel provides a user with the ability to adjust the club head CG so as to promote either a fade or draw bias. The channel is not necessarily straight and may have some curvature. The curvature may match either the front portion or rear portion of the club head. Or the curvature may take another form, such as a partial or full circular shape.

The illustrated club head can also comprise an adjustable shaft connection system for coupling a shaft to the hosel, such as the adjustable shaft connection systems described above, the details of which are not repeated here and not shown for clarity.

Slidably Repositionable Weight with Weight Ports

The following discussion provides important background for understanding the embodiments shown in FIGS. 42-47. Low and forward center of gravity in a wood-type golf club head is advantageous for the variety of reasons discussed above. Moreover, the combination of high launch and low spin is particularly desirable from wood-type golf club heads.

Having a low and forward center of gravity location in wood-type golf club heads aids in achieving the ideal launch conditions by reducing spin and increasing launch angle. In certain situations, however, low and forward center of gravity can reduce the moment of inertia of a golf club head if a substantial portion of the mass is concentrated in one region of the golf club head. As described in U.S. Pat. No. 7,731,603, filed Sep. 27, 2007, entitled "Golf Club Head," increasing moment of inertia can be beneficial to improve stability of the golf club head for off-center contact. For example, when a substantial portion of the mass of the golf club head is located low and forward, the center of gravity of the golf club head can be moved substantially. However, moment of inertia is a function of mass and the square of the distance from the mass to the axis about which the moment of inertia is measured. As the distance between the mass and the axis of the moment of inertia changes, the moment of inertia of the body changes quadratically. As such, golf club heads with mass concentrated in one area can have particularly low moments of inertia in some cases.

Particularly low moments of inertia can be detrimental in some cases. Particularly with respect to poor strikes and/or off-center strikes, low moment of inertia of the golf club head can lead to twisting. With respect to moment of inertia along the center of gravity x-axis, low moment of inertia can change flight properties for off-center strikes. In the current discussion, when the center of gravity is particularly low and forward in the golf club head, strikes that are substantially above the center of gravity lead to a relatively large moment arm and potential for twisting. If the moment of inertia of the golf club head about the center of gravity x-axis (hereinafter the "$I_{xx}$") is particularly low, high twisting can result in energy being lost in twisting rather than being transferred to the golf ball to create distance. As such, although low and forward center of gravity is beneficial for creating better launch conditions, poor implementation may result in a particularly unforgiving golf club head in certain circumstances.

A low and forward center of gravity location in the golf club head results in favorable flight conditions because the low and forward center of gravity location results in a projection of the center of gravity normal to a tangent face plane (see discussion of tangent face plane and center of gravity projection as described in U.S. patent application Ser. No. 13/839,727, entitled "Golf Club," filed Mar. 15, 2013, which is incorporated herein by reference in its entirety). During impact with the ball, the center of gravity projection determines the vertical gear effect that results in higher or lower spin and launch angle. Although moving the center of gravity low in the golf club head results in a lower center of gravity projection, due to the loft of the golf club head, moving the center of gravity forward also can provide a lower projection of the center of gravity. The combination of low and forward center of gravity is a very efficient way to achieve low center of gravity projection. However, forward center of gravity can cause the $I_{XX}$ to become undesirably low. Mass distributions which achieve low CG projection without detrimental effect on moment of inertia in general—and $I_{XX}$, specifically—would be most beneficial to achieve both favorable flight conditions and more forgiveness on off center hits. A parameter that helps describe the effectiveness of the center of gravity projection is the ratio of CGz (the vertical distance of the center of gravity as measured from the center face along the z-axis) to CGy (the distance of the center of gravity as measured rearward from the center face along the y-axis). As the $CG_Z/CG_Y$ ratio becomes more negative, the center of gravity projection would typically become lower, resulting in improved flight conditions.

As such, the following golf club head embodiments aim to provide golf club heads having the benefits of a large negative number for $CG_z/CG_y$ (indicating a low CG projection) without substantially reducing the forgiveness of the golf club head for off-center—particularly, above—center-strikes (indicating a higher $I_{xx}$). To achieve the desired results, weight may be distributed in the golf club head in a way that promotes the best arrangement of mass to achieve increased $I_{xx}$, but the mass is placed to promote a substantially large negative number for $CG_z/CG_y$.

Figure 42:
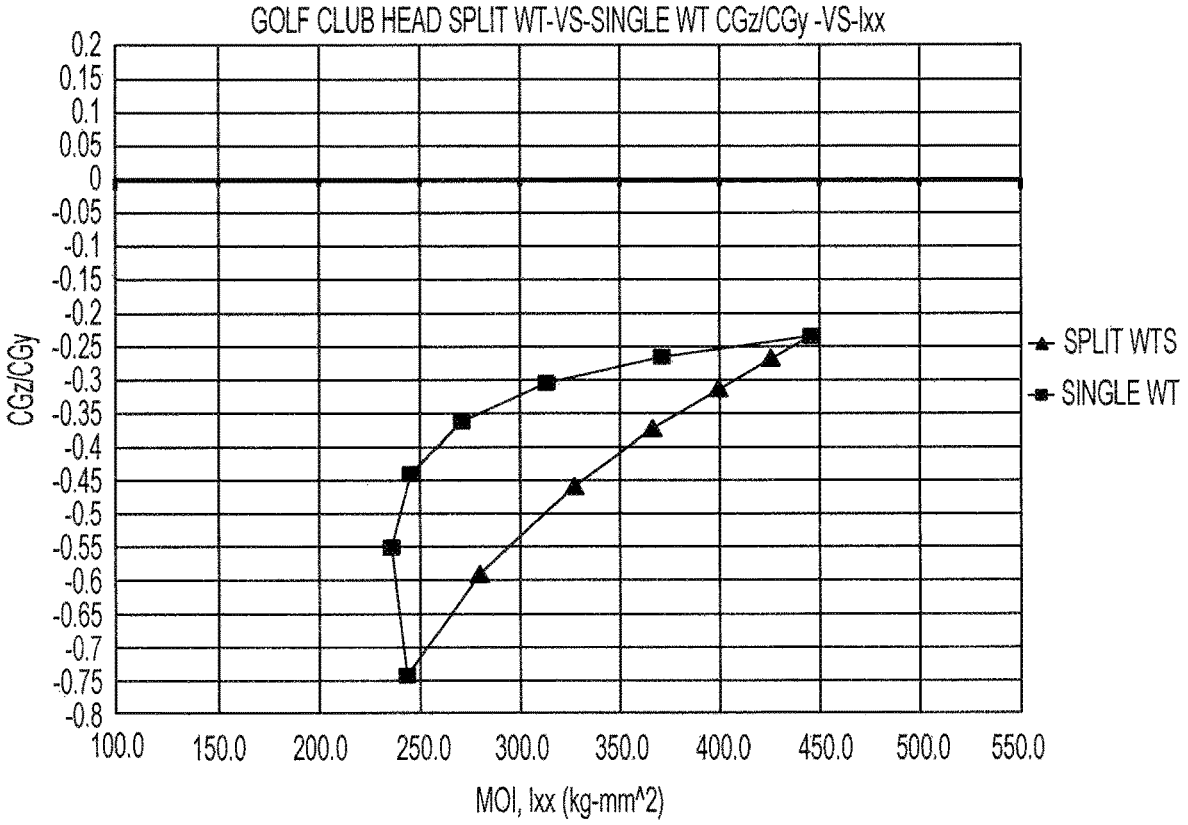
FIG. 42 is a graph showing different CGz/CGy and MOI as the location of a single weight and two weights are changed, according to yet another embodiment.

As illustrated by FIG. 42, $CG_Z/CG_Y$ provides a measure of how low the CG projects on the face of the golf club head. Although $CG_Z/CG_Y$ may be various numbers, the chart of FIG. 42 displays the same golf club head geometry with one mass and with split masses. For the single mass, a single mass was varied throughout the golf club head to achieve varying MOIs, from very far forward to very far rearward. With split masses, two masses were placed on the periphery of the golf club head and the amount of mass was varied from all mass at the front to all mass at the back. As can be seen, the single mass and split mass curves approach each other at their ends. This is because, as split mass becomes more heavily unbalanced to one end or the other, its distribution approaches that of a single mass. However, it is important to note that, with the split masses, higher MOI can be achieved with a lower $CG_Z/CG_Y$ ratio. Effectively, this means that CG projection can be moved lower in the golf club head while maintaining relatively high MOI. The effectiveness of this difference will be determined by the specific geometry of each golf club head and the masses utilized.

Additionally, U.S. patent application Ser. No. 13/839,727 discusses that knowing the CGy distance allows the use of a CG effectiveness product to describe the location of the CG in relation to the golf club head space. The CG effectiveness product is a measure of the effectiveness of locating the CG low and forward in the golf club head. The CG effectiveness product ($CG_{eff}$) is calculated with the following formula and, in the current embodiment, is measured in units of the square of distance ($mm^2$):

$$CG_{eff}=CG_y\times\Delta z$$

With this formula, the smaller the $CG_{eff}$, the more effective the club head is at relocating mass low and forward. This measurement adequately describes the location of the CG within the golf club head without projecting the CG onto the face. As such, it allows for the comparison of golf club heads that may have different lofts, different face heights, and different locations of the center face. It should be understood that Δz and Z-up may be used interchangeably. The CG effectiveness product will vary depending on the volume of the club head. In general, a smaller club head volume, such as below 250 cc, will have a smaller CG effectiveness product. For the embodiments discussed herein with a club head volume less than 250 cc, $CG_y$ may range from about 12 mm to about 20 mm and Δz may range from about 12 mm to about 18 mm. As such, the $CG_{eff}$ of an embodiment with a club head volume less than 250 cc ranges from about 144 $mm^2$ to about 360 $mm^2$. More specifically, for a club head with a volume less than 200 cc the $CG_{eff}$ may range from about 180 $mm^2$ to about 300 $mm^2$. For the embodiments discussed herein with a club head volume greater than 250 cc, $CG_y$ may range from about 20 mm to about 32 mm and Δz may range from about 20 mm to about 30 mm. As such, the $CG_{eff}$ of an embodiment with a club head volume less than 250 cc ranges from about 400 $mm^2$ to about 960 $mm^2$. More specifically, for a club head with a volume greater than 400 cc the $CG_{eff}$ may range from about 690 $mm^2$ to about 750 $mm^2$.

Slidably Repositionable Weight with Front and Rear Weight Port(s)

Figure 44A:
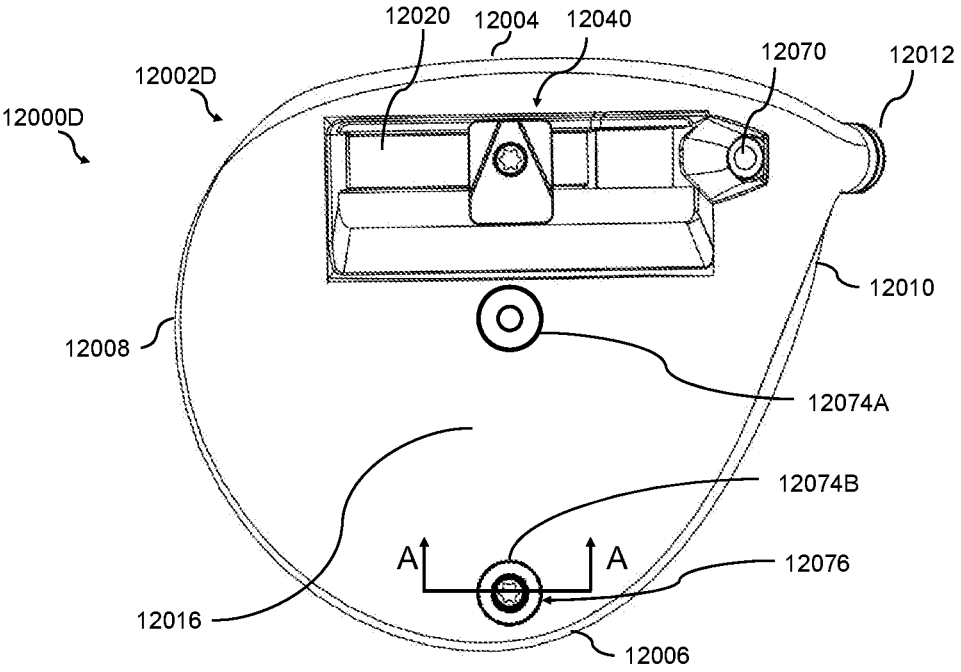
FIG. 44A is a bottom view of a golf club head, according to yet another embodiment.

Turning attention to FIG. 44A, another example of a golf club head, golf club head 12000D, will now be described. Golf club head 12000D includes many similar or identical features to golf club head 12000 combined in unique and distinct ways. Thus, for the sake of brevity, each feature of golf club head 12000D will not be redundantly explained. Rather, key distinctions between golf club head 12000D and golf club head 12000 will be described in detail and the reader should reference the discussion above for features substantially similar between the two golf club heads.

The body 12002D (and thus the whole club head 12000D) includes a front portion 12004, a rear portion 12006, a toe portion 12008, a heel portion 12010, a hosel 12012, a crown and a sole 12016. Golf club head 12000D includes a channel similar to the channels discussed previously and additionally includes one or more forward weight ports 12074A and one or more rearward weight ports 12074B on the sole. The one or more weight ports may be capable of accommodating one or more weights 12076 ranging from 1 g to 50 g. Additionally, the weight 12076 for the weight port may be compatible and interchangeable with the washer that forms part of the weight assembly 12040 used with the channel 12020. Additionally or alternatively, the weight for the weight port may be compatible and interchangeable with the weight assembly 12040 used with the channel 12020.

Figure 44B:
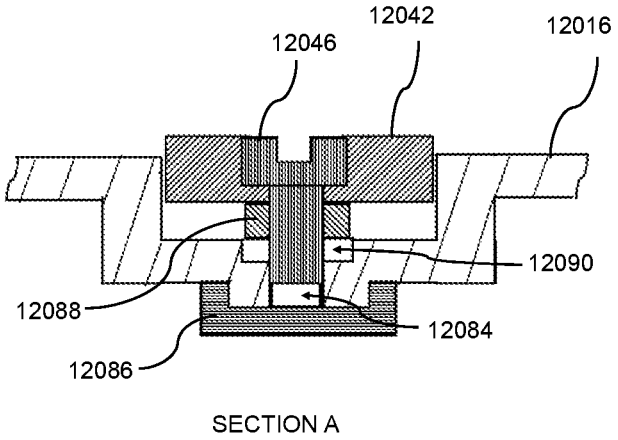
FIG. 44B is a cross-sectional view along line A-A of the golf club head of FIG. 44A.

Turning to FIG. 44B, Section A shows a cross-section view of the weight port and an installed washer 12042, which may be circular, triangular, or rectangular or some other shape. As shown, the bolt 12046 bolts to a threaded hole 12084 in the sole 12016 thereby securing the washer 12042. A rubber washer 12088 or grommet may be used to keep the bolt and washer together when the weight is removed from the club head. Gap 12090 may be included to prevent the rubber washer 12088 from being compressed during tightening of bolt 12046, which could lead to loss of preload. If the washer is circular, the bolt and the washer may be integrated into one unitary piece, and do not need to be separate.

The threaded hole 12084 may be a through bore or blind bore. If the hole is a through bore a cap 12086 may be affixed to the underside of the sole before attaching either the crown or face plate to the golf club head. The cap 12086 may be affixed by gluing, screwing, pressing, or welding it onto the sole or other similar methods and combinations. A through bore is easier to manufacture and could provide some cost savings over a blind bore. Capping of the hole 12084 may be desirable to avoid water intrusion into the club head and/or to avoid possible USGA rule violations.

If there is a bonded on component to the head, such as a crown, sole, or face, it is easier to gain access to apply the cap to the backside of the through bore, as oppose to a fully welded metallic head.

The illustrated club head can also comprise an adjustable shaft connection system for coupling a shaft to the hosel, such as the adjustable shaft connection systems described herein, the details of which are not repeated here and not shown in for clarity.

The weight port may allow a user to increase the overall MOI of the golf club head and correspondingly the spin imparted to the ball. For example, by placing a heavy weight (e.g. 10-30 grams) in the rear of the club and using a light weight washer (e.g. 1-5 grams) in the front of the club the MOI is increased and the CG is moved rearward, which would result in increased spin due to dynamic lofting effects. Although moving weight to the rear of the club would increase golf ball spin, some users may prefer a high MOI club that resists twisting over a club that produces a lower spinning ball. Additionally, some users may prefer a more traditional ball flight as shown in FIG. 32 over the low and boring ball flight shown in FIG. 33 that is produced by a low and forward CG golf club. Providing one or more weight ports on a rearward portion of the sole allows a user the option to select between a high MOI club with more spin producing a more traditional ball flight or a club with less spin producing a more boring ball flight.

Unexpectedly, this combination produces a club exhibiting a higher MOI without drastically increasing the spin. Traditionally, a high MOI has been accomplished by moving all of the weight to the rear of the club head. However, this not only increases MOI, but also unfavorably increases backspin. The increase in spin is due to an increase in delta 1, which causes a greater gear effect due to where the CG projects onto the face. By deviating from tradition and placing some weight at the front and some at the rear of the club head we achieved both a higher MOI and a lower spinning driver due to a smaller delta 1. The smaller delta 1 and increased MOI are due to the two weights being on opposing sides of the CG.

For example, rather than placing 30 grams at the rear of the club, 15 grams may be put at the rear and 15 grams at the front of the club or some other combination depending on user preferences. Additionally, the weight ports also allow for swing weight adjustment.

For the preceding embodiments, the golf club heads 12000C and 12000D may additionally or alternatively include an interchangeable or adjustable shaft attachment system for coupling a shaft to the hosel using the hosel opening 12070.

Incorporating an adjustable shaft attachment system may allow a player to adjust the club head static loft either higher or lower. Additionally or alternatively, such a system allows a player to easily interchange shafts depending on preference and swing parameters. For example, a user hitting a club head with a low and forward CG would generally want to increase the club head loft to launch the golf ball higher and achieve optimum distance. However, if the CG is moved rearward to increase MOI then the launch angle is going to be higher due to dynamic lofting and backspin will be increased. In this instance, a user may want to decrease the loft of the club to achieve optimum distance by reducing the effective loft and the amount of backspin. Alternatively, some users prefer a certain ball flight regardless of optimum distance. Providing an adjustable shaft system allows for greater accommodation of various users' preferences.

Multi-Directional Slidably Repositionable Weight(s)

Figure 45A:
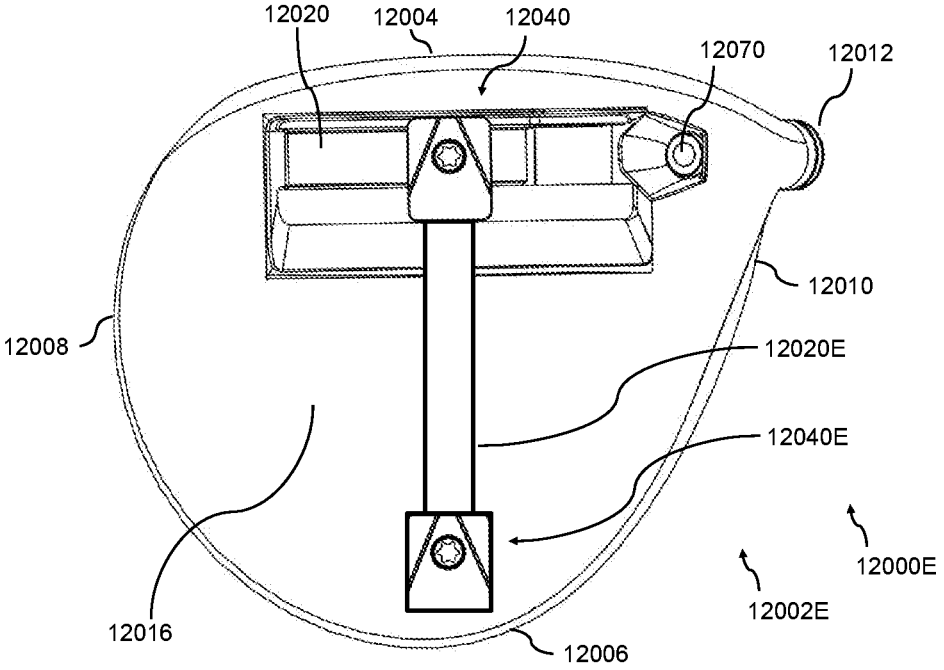
FIG. 45A is a bottom view of a golf club head, according to yet another embodiment.
Figure 45B:
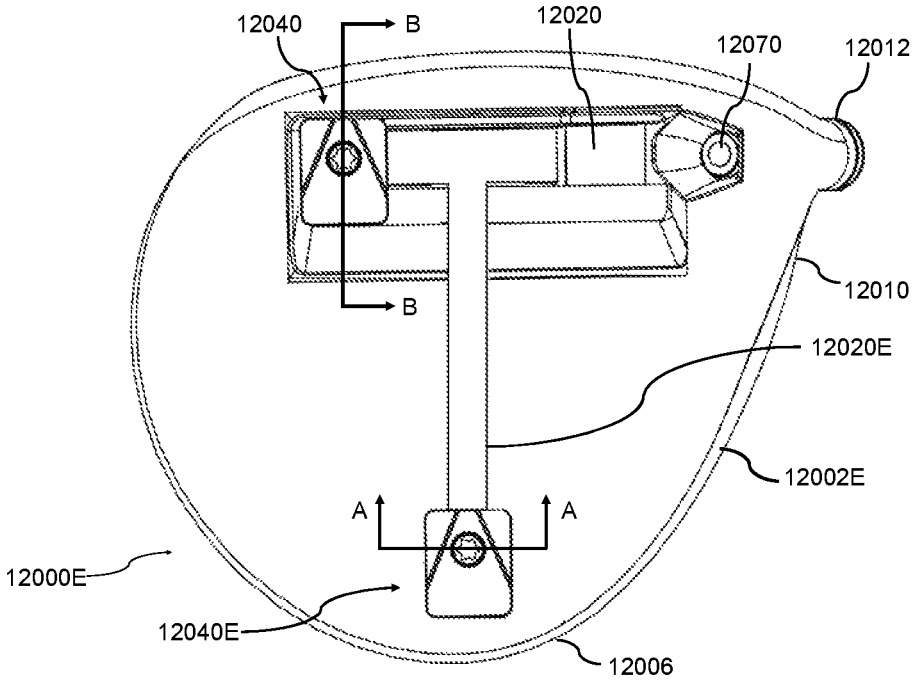
FIG. 45B is a bottom view of a golf club head, according to yet another embodiment.
Figure 45C:
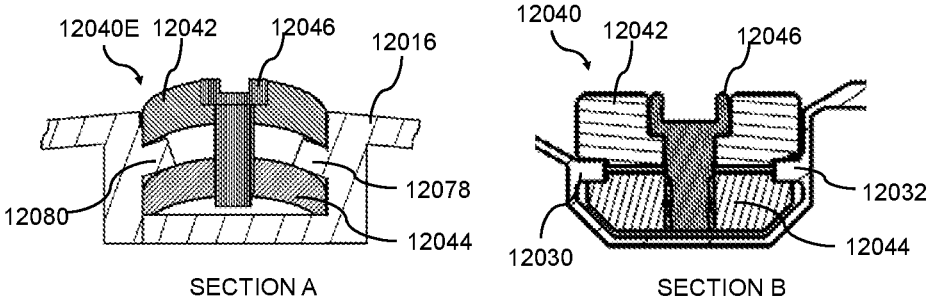
FIG. 45C are cross-sectional views along line A-A and line B-B of the golf club head of FIG. 45B.

Turning attention to FIGS. 45A-C, another example of a golf club head, golf club head 12000E, will now be described. Golf club head 12000E includes many similar or identical features to golf club head 12000 combined in unique and distinct ways. Thus, for the sake of brevity, each feature of golf club head 12000E will not be redundantly explained. Rather, key distinctions between golf club head 12000E and golf club head 12000 will be described in detail and the reader should reference the discussion above for features substantially similar between the two golf club heads.

The body 12002E (and thus the whole club head 12000E) includes a front portion 12004, a rear portion 12006, a toe portion 12008, a heel portion 12010, a hosel 12012, a crown and a sole 12016. Golf club head 12000E includes a rearward track 12020E similar to the channels discussed previously, however this channel extends rearward away from the face. In the embodiment shown, the two channels merge to make a T-shaped channel. The rearward track allows for adjustment of the MOI of the club head by sliding the weight assembly 12040E rearward along the channel 12020E. Having two channels allows for adjustment of MOI and shot shape. Weight assemblies 12040 and 12040E may be interchangeable. Additionally or alternatively, weight assemblies may be used in the forward channel 12020 (heel/toe) or rearward track 12020E.

Due to the curvature of the sole, the rearward track 12020E may also be slightly curved. FIG. 45C shows two cross section views of the forward and rearward track geometry as well as the weight assembly. Section B is taken through the forward channel 12020, and Section A is taken through the rearward track 12020E. Section B is the same geometry as discussed and shown in earlier figures. However, as shown in Section A, the washer 12042 and mass member 12044 have a slight curvature to accommodate for the curvature of the sole. In other words, the washer and mass member may be relatively flat in one direction and have some curvature in another direction. This allows for the weight assemblies 12040 and 12040E to slide between the forward and rearward tracks and be interchangeable. Additionally, the curvature of the washer and the mass member may be modified to accommodate for alternative channel geometry, such as for a curved channel.

Functionally, the two weight assemblies perform in the same manner as discussed above. As shown in Section A of FIG. 45C, tightening bolt 12046 causes the weight assembly to clamp onto a heel-side channel ledge 12078 and a toe-side channel ledge 12080. Additionally, weight assembly 12040E may include locking projections similar to those discussed above to further secure the weight assembly against the high G-forces experienced during impact.

Similar to the forward channel, the rearward track 12020E may have some curvature and is not required to be straight. In some embodiments, the rearward channel 12020E may be angled relative to the forward channel 12020. For example the entire channel may look more like a 7 (seven) rather than a T-shape due to the angle of the rearward track.

The illustrated club head can also comprise an adjustable shaft connection system for coupling a shaft to the hosel, such as the adjustable shaft connection systems described herein, the details of which are not repeated here and not shown for clarity.

The rearward track may allow for a weight to travel up to 125 mm rearward of the center face. The second weight may be inserted in the same manner as previously discussed with regard to the heel and toe channel 12020. Additionally or alternatively, the rearward track may include an insertion cavity or be open at the rearward end allowing for a weight to be slid into position within the channel 12020E. Additionally or alternatively, both weight assemblies may be installed at this opening.

Figure 46:
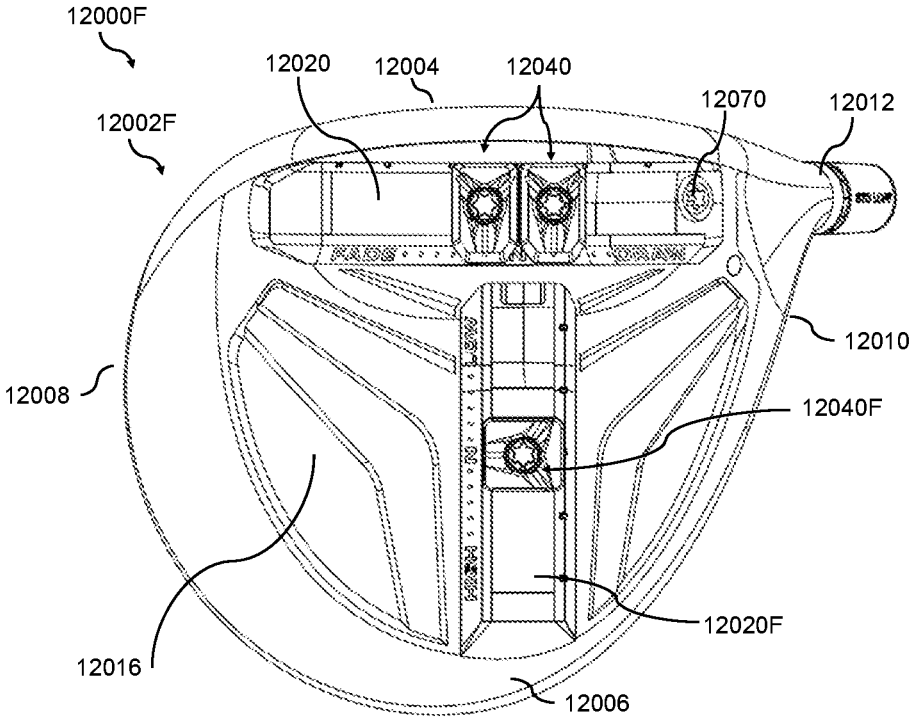
FIG. 46 is a bottom view of a golf club head, according to yet another embodiment.

Turning attention to FIG. 46, golf club head 12000F includes a rearward track 12020F similar to the channels discussed previously, however this channel does not merge with the forward channel. This allows for adjustment of the MOI of the club head by sliding the weight assembly 12040F rearward along the channel 12020F. Having forward and rearward channels allows for adjustment of MOI and shot shape. Weight assemblies 12040 and 12040F may be interchangeable. Additionally or alternatively, weight assemblies may be used in the forward channel 12020 (heel/toe) or rearward track 12020F.

Fairway Slidably Repositionable Weight(s)

Figure 47:
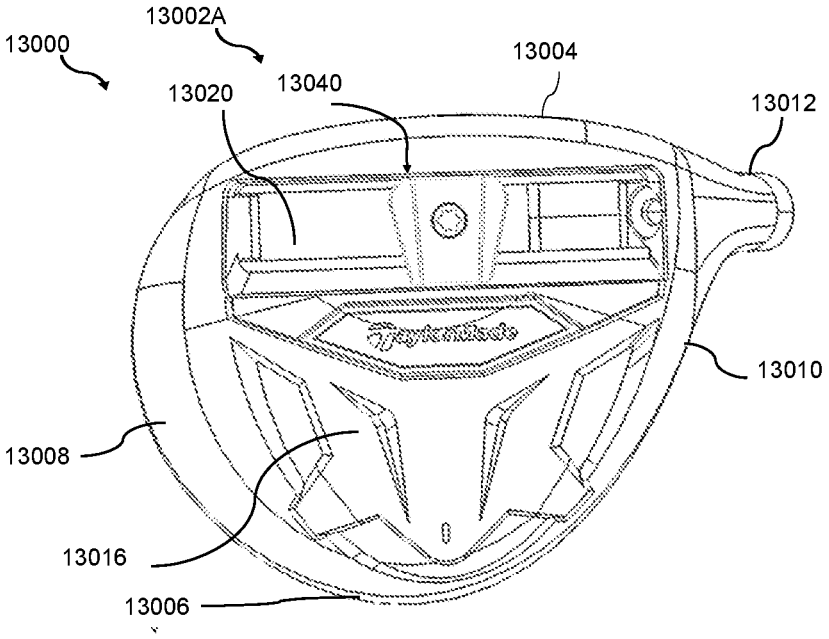
FIG. 47 is a bottom view of a golf club head, according to yet another embodiment.

Turning attention to FIG. 47, another example of a golf club head, golf club head 13000, will now be described. The most significant distinction between golf club head 13000 and golf club head 12000A-F is the volume. Golf club head 13000 has a volume range of between 110 $cm^3$ to 250 $cm^3$, whereas golf club head 12000A-F has a volume range of between 250 $cm^3$ to 500 $cm^3$.

Golf club head 13000 includes several of the structures and features of the previous embodiments, including a hollow body 13002A, a channel 13020 and a slidable weight assembly 13040. The body 13002A (and thus the whole club head 13000) includes a front portion 13004, a rear portion 13006, a toe portion 13008, a heel portion 13010, a hosel 13012, a crown and a sole 13016. The front portion 13004 forms an opening that receives a face plate, which can be a variable thickness, composite, and/or metal face plate, as described herein.

Multiple Weight Assemblies

Figure 48A:
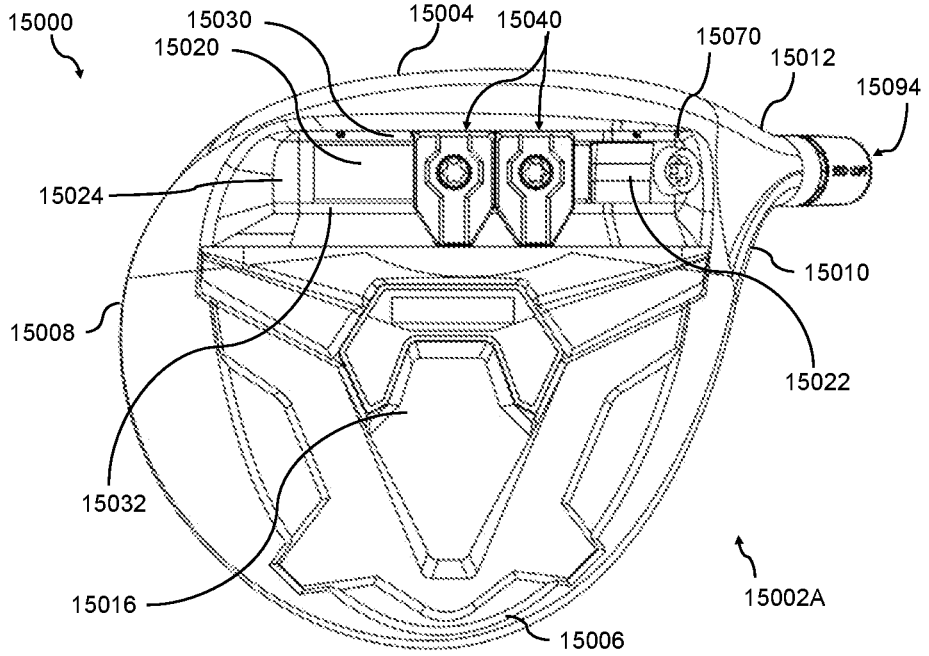
FIG. 48A is a bottom view of a golf club head, according to yet another embodiment.
Figure 48B:
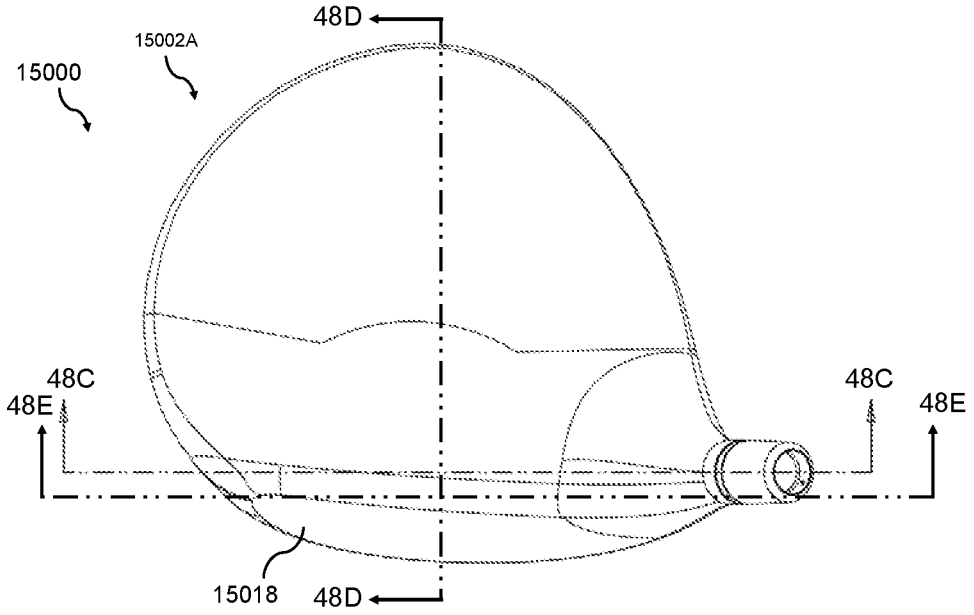
FIG. 48B is a top view of the golf club head of FIG. 48A.
Figure 48C:
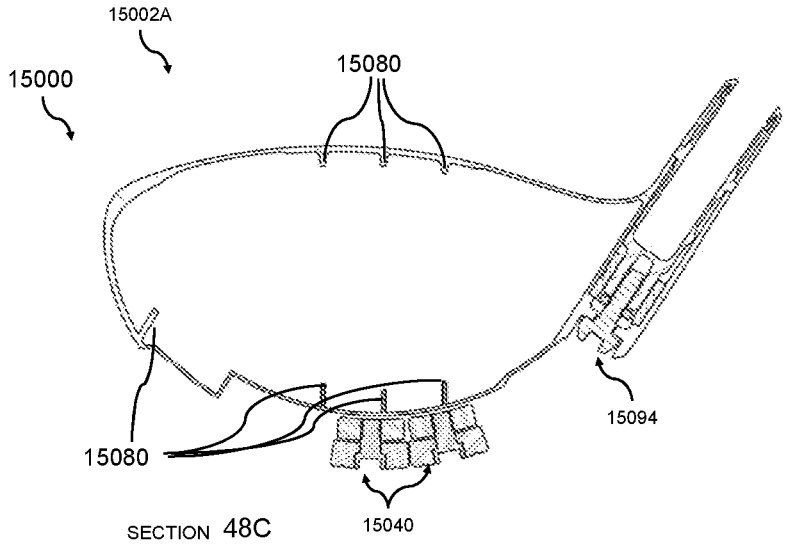
FIG. 48C is a cross-sectional view along line 48C-48C of the golf club head of FIG. 48B.
Figure 48D:
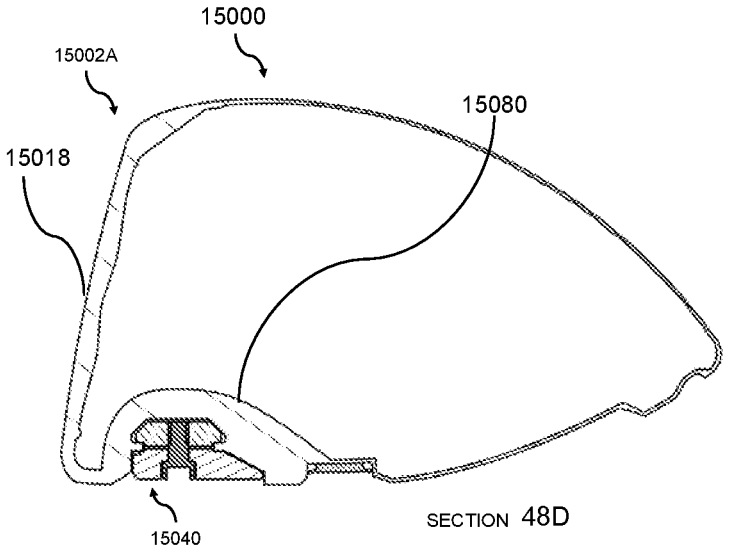
FIG. 48D is a cross-sectional view along line 48D-48D of the golf club head of FIG. 48B.
Figure 48E:
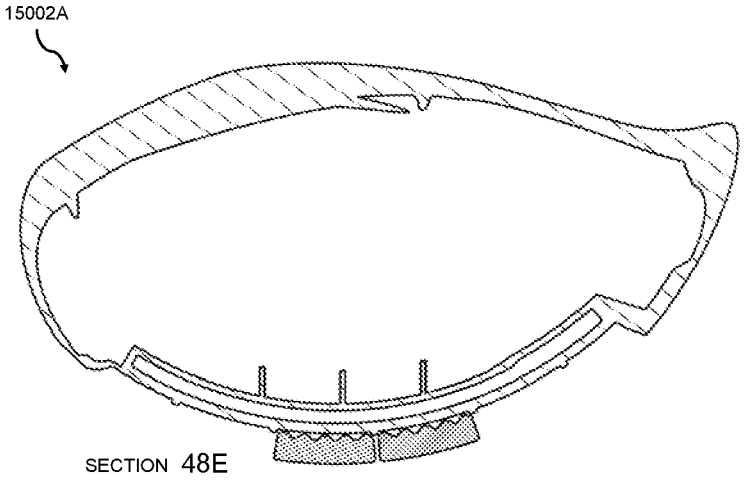
FIG. 48E is a cross-sectional view along line 48E-48E of the golf club head of FIG. 48B.
Figure 49:
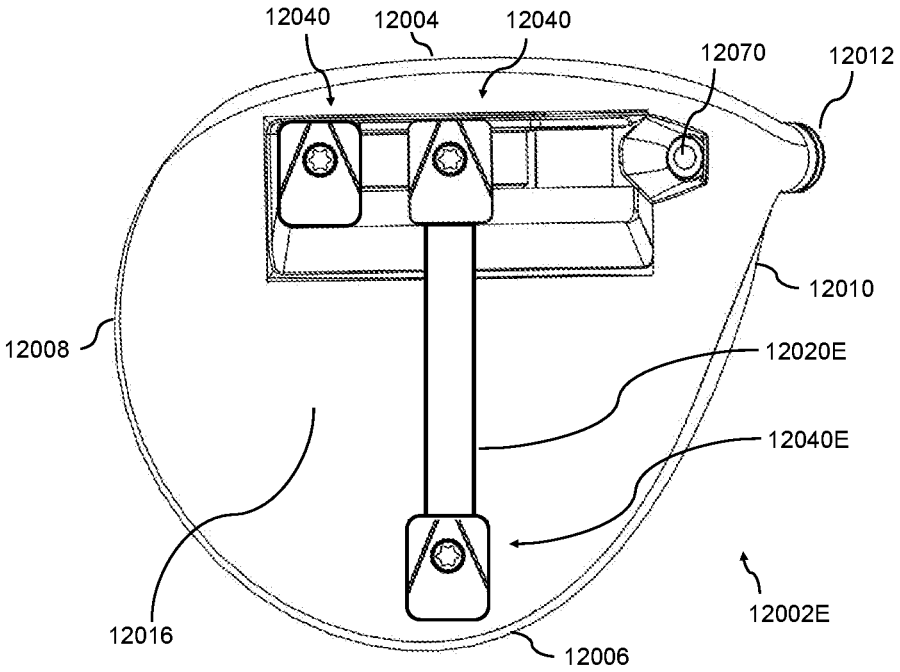
FIG. 49 is a bottom view of a golf club head, according to yet another embodiment.

Turning attention to FIGS. 48-49, various configurations of golf club heads having multiple weight assemblies installed in the front and/or rear channels are shown. Golf club head 15000 includes many similar or identical features to golf club head 12000 combined in unique and distinct ways. Thus, for the sake of brevity, each feature of golf club head 15000 will not be redundantly explained. Rather, key distinctions between golf club head 15000 and golf club head 12000 will be described in detail and the reader should reference the discussion above for features substantially similar between the two golf club heads.

Golf club head 15000 includes a hollow body 15002A, a channel 15020 and a slidable weight assembly 15040. The body 15002A (and thus the whole club head 15000) includes a front portion 15004, a rear portion 15006, a toe portion 15008, a heel portion 15010, a hosel 15012, a crown 12014 and a sole 15016. The front portion 15004 forms an opening that receives a face plate 15018, which can be a variable thickness, composite, and/or metal face plate, as described herein.

The illustrated club head 15000 can also comprise an adjustable shaft connection system 15094 for coupling a shaft to the hosel 15012 via the hosel opening 15070. The adjustable shaft connection system may also be used for adjusting loft and lie of golf club head 15002A. Additionally, club head 15000 may also include an adjustable sole piece at a sole port. These features are described in more detail in the patents incorporated by reference.

Similar to the above embodiments, golf club head 15000 includes an elongated channel 15020 on a sole 15016 that extends generally from a heel end 15022 oriented toward a heel portion 15010 to a toe end 15024 oriented toward a toe portion 15008. A front ledge 15030 and a rear ledge 15032 are located within the channel 15020, and one or more weight assemblies 15040 may be retained on the front and rear ledges 15030, 15032 within the channel 15020. Weight assemblies 15040 may be installed into channel 15020 in similar fashion to that already described herein. In the embodiment shown, the channel 15020 is merged with the hosel opening 15070 that forms a part of the head-shaft connection assembly discussed above.

In each of the embodiments discussed throughout this description, multiple weight assemblies may be used in the forward channel and/or rearward track. For example, golf club heads 12000 and 13000 may include multiple weight assemblies in the forward and/or rearward tracks.

Using more than one weight assembly may increase the overall adjustability of the club head. For example, additional weight assemblies may be used to further lower the golf club head CG, adjust the swing weight, adjust spin, and/or adjust the inertia of the golf club head.

As shown in FIG. 48A, golf club head 15002A includes a second weight assembly in the forward channel, which provides additional adjustability. For example, a user may position a first weight assembly in the extreme heel position and the second weight assembly in the extreme toe position, thereby increasing the moment of inertia about the y-axis ($I_{yy}$) and z-axis ($I_{zz}$) of the golf club head. This configuration may produce what some would consider a more "forgiving" golf club head due to the increased inertia mainly about the z-axis. Alternatively, a user may position both weights in a center position, which would lower the CG of the golf club head resulting in reduced golf ball spin.

Although two weight assemblies are shown, the channel may hold additional weight assemblies, such as, three or more, four or more, five or more, six or more, and/or seven or more weight assemblies. Multiple weight assemblies would produce a heavier golf club head with a lower CG. Alternatively, some users may prefer a lighter golf club head, in which case the weight assemblies may be completely removed from the channel leaving the channel empty.

FIG. 48B shows a top or crown view of golf club head 15002A. Sections 48C-E are taken to demonstrate various features of golf club head 15002A. FIG. 48C shows multiple weight assemblies 15040, the adjustable shaft connection system 15094, ribs 15080, and the weight installation cavity. FIG. 48D shows an installed weight assembly and a rib. FIG. 48E shows washers 15042 installed on the channel ledge. As shown, the washer may include either protrusions and/or indentations that correspond to either protrusions and/or indentations on the channel ledge. These features may help to better position the weight assembly within the channel. As shown in FIG. 48E, the notches on the washers fall in between the protrusions on the ledge. However, in other positions the indentations on the washers may engage the ledge protrusions/indentations.

Turning to FIG. 49, another example of how multiple weight assemblies may be used with the embodiments discussed above is shown. This configuration may allow a user to position more weight in the rear of the club, which may increase the MOI of the golf club head in the x-axis and z-axis directions. Additionally, this may increase spin, which may be a preferable ball flight for some users over the more boring ball flight produced from a lower spinning club.

The additional weight assemblies may range in weight from 1 g to 50 g. Each weight assembly may include indicia to indicate its weight. For example, the weight assemblies may be marked with letters, numbers, patterns, or color coded to indicate weight or any combination thereof. The washer and/or the mass member may each include weight identifying indicia.

Adjustable Face Angle

In some implementations, an adjustable mechanism is provided on the sole to "decouple" the relationship between face angle and hosel/shaft loft, i.e., to allow for separate adjustment of square loft and face angle of a golf club. For example, some embodiments of the golf club head include an adjustable sole portion that can be adjusted relative to the club head body to raise and lower the rear end of the club head relative to the ground. Further detail concerning the adjustable sole portion is provided in U.S. Patent Application Publication No. 2011/0312347, which is incorporated herein by reference.

Additionally, as described in detail in U.S. patent application Ser. No. 13/686,677, filed Nov. 27, 2012, entitled "Golf Clubs" and incorporated by reference herein in its entirety, a rotatably adjustable sole piece (ASP) may be included in some of the embodiments, which may be beneficial for adjusting the face angle.

A rotatably adjustable sole piece may be secured to the sole at one of a plurality of rotational positions with respect to an axis that may be centrally located extending through the sole piece. The sole piece may extend a different axial distance from the sole at each of the rotational positions. Adjusting the sole piece to a different one of the rotational positions may change the face angle of the golf club head independently of the loft angle of the golf club head when the golf club head is in the address position. In some of these embodiments, a releasable locking mechanism is configured to lock the sole piece at a selected one of the rotational positions on the sole. The locking mechanism may include a screw adapted to extend through the sole piece and into a threaded opening in the sole of the club head body. In some of these embodiments, the sole piece has a convex bottom surface, such that when the sole piece is at each rotational position the bottom surface has a heel-to-toe curvature that substantially matches a heel-to-toe curvature of a leading contact surface of the sole.

Some embodiments of a golf club head comprise a rotatably adjustable sole piece configured to be secured to the sole at three or more rotational positions with respect to a central axis extending through the sole piece, wherein the sole piece extends a different axial distance from the sole at each of the rotational positions. The adjustable sole piece can be generally triangular, square, pentagonal, circular, or some other shape, and can be secured to the sole at three or more discrete selectable positions. The adjustable sole piece can include an annular side wall that includes three or more wall segments that are substantially symmetrical with one another relative to the central axis of the sole piece. In some embodiments, adjusting the rotational position of the sole piece changes the face angle of the golf club head independently of the loft angle of the golf club head when the golf club head is in the address position.

The golf club head may further include a recessed sole port in the sole of the golf club head. The rotatably adjustable sole piece can be adapted to be at least partially received within the sole port. The sole piece can comprise a central body having a plurality of surfaces adapted to contact the sole port, the surfaces being offset from each other along a central axis extending through the central body. The sole piece can be positioned at least partially within the sole port at three or more rotational and axial positions with respect to the central axis. At each rotational position, at least one of the surfaces of the central body contacts the sole port to set the axial position of the sole piece. The sole port and the sole piece can each be generally triangular, square, pentagonal, circular, or some other shape when viewed from the bottom of the golf club head.

In some embodiments, the golf club body may further comprises an adjustable sole piece that can be secured to a sole of the club head at three or more, four or more, five or more, six or more, and/or seven or more different discrete rotational and axial positions with respect to an axis extending through sole piece, wherein the face angle of the club head is different at each position of the sole piece. In some embodiments, the sole piece comprises an outer wall that includes a plurality of notches that are configured to engage with corresponding ridges on the sole of the club head body to prevent the sole piece from rotating when the sole piece is secured to the sole. In some embodiments adjusting the sole piece between the different discrete rotational and axial positions does not cause a substantial change in the square loft angle of the club head. In some embodiments, adjusting the sole piece between the different discrete rotational and axial positions allows the face angle of the club head to be adjusted over a range of at least 8°. In some embodiments, the sole piece has a convex bottom surface, such that when the sole piece is at each rotational position the bottom surface has a heel-to-toe curvature that substantially matches the heel-to-toe curvature of a leading surface portion of the sole. In some embodiments, sole piece comprises a generally cylindrical stepped wall that comprises a plurality of wall sections in an angular array around the central axis, wherein the wall sections comprise at least 3, at least 4, at least 5, at least 6, and/or at least 7 trios of upper surfaces, each trio of upper surfaces being configured to mate with the sole port of the body to set the sole piece at a different axial position relative to the sole.

Figure 50:
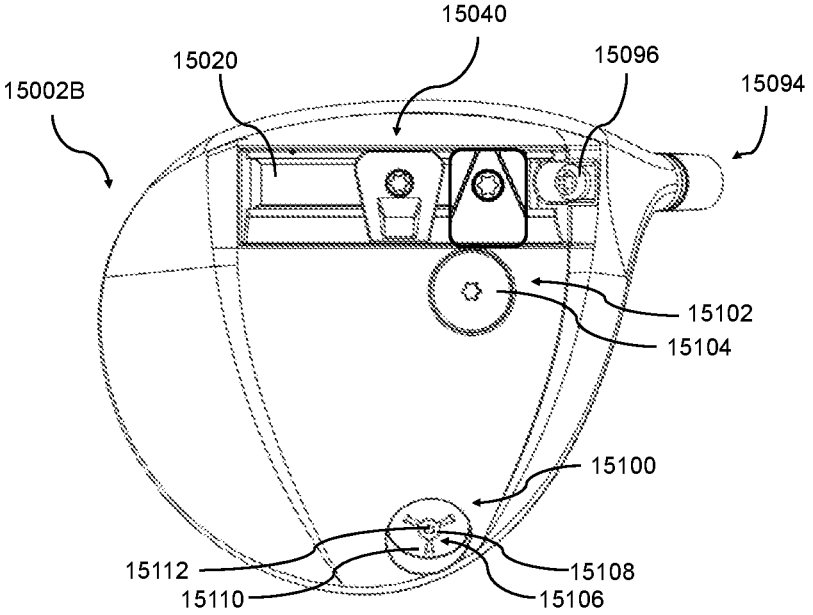
FIG. 50 is a bottom view of a golf club head, according to yet another embodiment.

In some embodiments, the adjustable sole piece (ASP) may be incorporated into a weight and possibly into a movable weight. For example, as shown in FIG. 50, golf club head 15002B includes a rearward weight port 15100, and a forward weight port 15102 with an installed ASP 15104. As shown, within the exposed rearward weight port is a raised platform 15106 that may be geometrically centered in the weight port. The platform 15106 may include a center post 15108 and two or more flared protrusions, projections, or ears, 15110 extending from opposite sides of the center post designed to engage the ASP. As shown in, the platform includes three protrusions, but more or less protrusions may be used to engage the ASP.

Similarly, the forward weight port 15102 may also include a similar platform for engaging the ASP so that the ASP may be interchangeable between the forward and rearward weight ports. Also as shown in FIG. 50, the weight assembly 15040, the adjustable sole piece 15102, and adjustable hosel screw 15096 may all include a socket with lobes that may be engaged by a single tool, such as, for example, a screwdriver, Torx wrench, or allan wrench.

Weight ports can be generally described as a structure coupled to the golf club head crown, golf club head skirt, golf club head sole or any combination thereof that defines a recess, cavity or hole on, about or within the golf club head. The weight port bottom defines a threaded opening 15112 for attachment of the weights 15102. The threaded opening 15112 is configured to receive and secure a threaded body of the weight assembly 15102. The threaded body may range from M2-M10, with the preferred embodiment having M5×0.8 threads. The threaded opening may be further defined by a boss extending either inward or outward relative to the weight port. Preferably, the boss has a length at least half the length of the body of the screw and, more preferably, the boss has a length 1.5 times a diameter of the body of the screw. Alternatively, the threaded opening may be formed without a boss.

As discussed in more detail in the applications referenced above, rotating the ASP causes different portions of the ASP to engage the protrusions, which in turn causes the ASP to extend different axial distances from the sole. Each axial distance corresponds to a change in face angle. In one embodiment, the ASP includes a plurality of steps at various heights, which engage the protrusions and allow for the axial distance adjustment.

Although not specifically shown, the forward weight port may also include protrusions designed to engage the ASP. This allows for a combined ASP and movable weight. In the forward position, the user may alter the face angle and achieve a low spinning driver due to the forward weight. Additionally or alternatively, a user may move the combination ASP and weight to the rearward port and thereby increase MOI, increase spin, and maintain the same face angle adjustability. Notably, the face adjustments may be made independent of loft and/or lie adjustments.

In some embodiments, both the forward and rearward weight ports may be designed to engage an ASP and the forward and rearward ASPs may work collaboratively to adjust the face angle. In other embodiments, the face angle may be adjusted by a single ASP that is either located in the forward or rearward weight port. A light weight, such as, for example, 1 gram may be used to cover either the forward or rearward weight port that is not in use.

Although a plurality of protrusions within a weight port are shown for engaging the ASP, many other designs exist that would also alter the face angle. For example, a wedge or trapezoid shape may be used instead. Rotating a wedge about an axis may cause changes in the face angle due to the varying distances of the wedge in contact with the ground.

The ASP may range in size and weight. The ASP may range in weight from 1 g to 50 g. Each combination weight and ASP may include indicia to indicate its weight, such as letters, numbers, patterns, or color coded to indicate weight or any combination thereof. Additionally or alternatively, each combination weight and ASP may include indicia to indicate adjustment to the face angle, such as neutral, open, and closed.

The ASP may allow for a range of adjustments between the open and closed positions allowing for a user to vary the amount the face is opened or closed. The ASP can change the face angle of the golf club head about 0.5 to about 12 degrees. For example, a user may adjust the face angle from neutral to 2° open or 4° open.

The multiple weight ports and ASP combined with a sliding weight 15040 in a weight track 15020 provides additional adjustability. The weight assembly as shown includes a window, which can be used to highlight various indicia along the sliding weight track. The indicia may indicate various degrees of draw or fade bias. The golf club head also includes an adjustable hosel 15094 and a screw 15096 for securing the adjustable hosel. The adjustable hosel may also be referred to as a FCT hosel, which stands for Flight Control Technology. Flight Control Technology allows for adjustment of loft, lie, and/or face angle. The adjustable hosel may allow a user to adjust the loft and/or lie of the golf club head.

Figure 51:
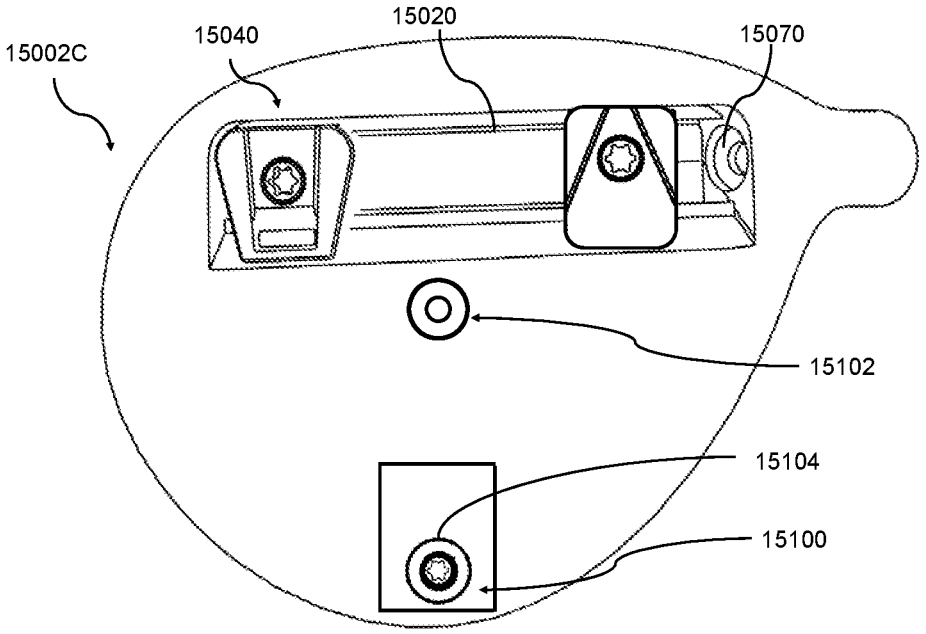
FIG. 51 is a bottom view of a golf club head, according to yet another embodiment.
Figure 52:
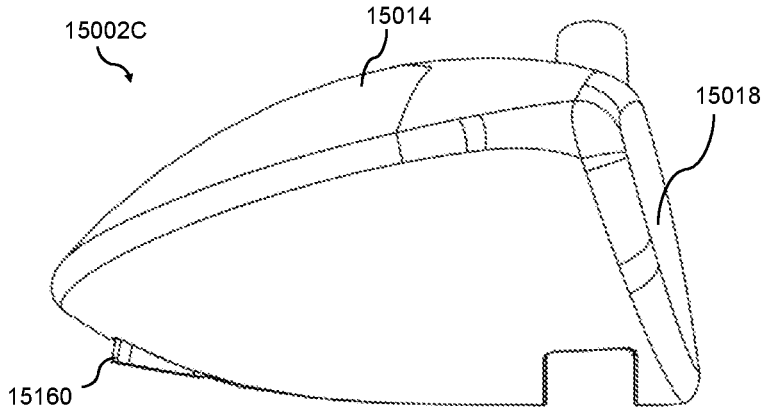
FIG. 52 is a toe view of the golf club head of FIG. 51.

Turning to FIGS. 51 and 52, another embodiment of golf club head 15002C is shown that is similar in most regards to the golf club head 15002B embodiment shown in FIG. 50. A significant difference is golf club head 15002C includes an aft winglet 15160. The aft winglet 15160 deviates from the curvature of the sole and provides a CG lowering platform. The platform may simply be additional sole or it may be designed to accept either a weight or a combination ASP and weight. As best shown in FIG. 52, the aft winglet 15160 deviates from the sole and provides a platform to further lower the CG.

The extended sole that is created from the aft winglet 15160 helps maximize MOI especially in the case of it holding an additional weight or ASP weight. Additionally, because aft winglet deviates from the sole any additional weight placed there would minimally impact the CG projection onto the face. Additionally, because the winglet there is less disruption to the aerodynamics of the club than there would be if the entire sole was lower. Moreover, if the entire sole was lowered it would increase the overall volume of the head and may run up against the current USGA volume limitations.

Composite Materials

Some current approaches to reducing structural mass of a metalwood club-head are directed to making at least a portion of the club-head of an alternative material. Whereas the bodies and face plates of most current metalwoods are made of titanium alloy, several club-heads are available that are made, at least in part, of components formed from either graphite/epoxy-composite (or other suitable composite material) and a metal alloy. Graphite composites have a density of about 1.5 g/cm$^3$, compared to titanium alloy which has a density of about 4.5 g/cm$^3$, which offers tantalizing prospects for providing more discretionary mass in the club-head. For example, considerable weight savings may be had by making the crown, sole, and/or face plate of composite materials.

Composite materials that are useful for making metal-wood club-head components often include a fiber portion and a resin portion. In general, the resin portion serves as a "matrix" in which the fibers are embedded in a defined manner. In a composite for club-heads, the fiber portion may be configured as multiple fibrous layers or plies that are impregnated with the resin component.

For example, in one group of such club-heads a portion of the body is made of carbon-fiber (graphite)/epoxy composite and a titanium alloy is used as the primary face-plate material. Other club-heads are made entirely of one or more composite materials. The ability to utilize lighter composite materials in the construction of the face plate can also provide some significant weight and other performance advantages To date there have been relatively few golf club head constructions involving a polymeric material as an integral component of the design. Although such materials possess the requisite light weight to provide for significant weight savings, it is often difficult to utilize these materials in areas of the club head subject to the stresses resulting from the high speed impact of the golf ball.

Any polymeric material used to construct the crown should exhibit high strength and rigidity over a broad temperature range as well as good wear and abrasion behavior and be resistant to stress cracking. Such properties include, a) a Tensile Strength of from about 50 to about 1,000 kpsi, preferably of from about 150 MPa to about 500 MPa, more preferably of from about 200 to about 400 MPa (as measured by ASTM D 638, or ISO 527);

b) a Tensile Modulus of from about 2 GPa to about 100 GPa, preferably of from about 10 GPa to about 80 GPa, more preferably of from about 10 GPa to about 70 GPa (as measured by ASTM D 638, or ISO 527);

c) a Flexural Strength from about 50 MPa to about 1000 MPa, more preferably of from about 100 MPa to about 750 MPa, even more preferably of from about 150 MPa to about 500 MPa (as measured by ASTM D 790 or ISO 178);

d) a Flexural Modulus of from about 2 GPa to about 50 GPa, more preferably of from about 5 to about 40, more preferably of from about 7 to about 30 GPa (as measured by ASTM D 790 or ISO 178);

e) a Tensile Elongation of greater than about 1%, preferably greater than about 1.5% even more preferably greater than about 3% as measured by ASTM D 638 or ISO 527.

Exemplary polymers may include without limitation, synthetic and natural rubbers, thermoset polymers such as thermoset polyurethanes or thermoset polyureas, as well as thermoplastic polymers including thermoplastic elastomers such as thermoplastic polyurethanes, thermoplastic polyureas, metallocene catalyzed polymer, unimodalethylene/carboxylic acid copolymers, unimodal ethylene/carboxylic acid/carboxylate terpolymers, bimodal ethylene/carboxylic acid copolymers, bimodal ethylene/carboxylic acid/carboxylate terpolymers, polyamides (PA), polyketones (PK), copolyamides, polyesters, copolyesters, polycarbonates, polyphenylene sulfide (PPS), cyclic olefin copolymers (COC), polyolefins, halogenated polyolefins [e.g. chlorinated polyethylene (CPE)], halogenated polyalkylene compounds, polyalkenamer, polyphenylene oxides, polyphenylene sulfides, diallylphthalate polymers, polyimides, polyvinyl chlorides, polyamide-ionomers, polyurethane ionomers, polyvinyl alcohols, polyarylates, polyacrylates, polyphenylene ethers, impact-modified polyphenylene ethers, polystyrenes, high impact polystyrenes, acrylonitrile-butadiene-styrene copolymers, styrene-acrylonitriles (SAN), acrylonitrile-styrene-acrylonitriles, styrene-maleic anhydride (S/MA) polymers, styrenic block copolymers including styrene-butadiene-styrene (SBS), styrene-ethylene-butylene-styrene, (SEBS) and styrene-ethylene-propylene-styrene (SEPS), styrenic terpolymers, functionalized styrenic block copolymers including hydroxylated, functionalized styrenic copolymers, and terpolymers, cellulosic polymers, liquid crystal polymers (LCP), ethylene-propylene-diene terpolymers (EPDM), ethylene-vinyl acetate copolymers (EVA), ethylene-propylene copolymers, propylene elastomers (such as those described in U.S. Pat. No. 6,525,157, to Kim et al, the entire contents of which is hereby incorporated by reference), ethylene vinyl acetates, polyureas, and polysiloxanes and any and all combinations thereof.

Of these most preferred are polyamides (PA), polyphthalimide (PPA), polyketones (PK), copolyamides, polyesters, copolyesters, polycarbonates, polyphenylene sulfide (PPS), cyclic olefin copolymers (COC), polyphenylene oxides, diallylphthalate polymers, polyarylates, polyacrylates, polyphenylene ethers, and impact-modified polyphenylene ethers and any and all combinations thereof.

In some embodiments, the crown may be formed from a composite material, such as a carbon composite, made of a composite including multiple plies or layers of a fibrous material (e.g., graphite, or carbon fiber including turbostratic or graphitic carbon fiber or a hybrid structure with both graphitic and turbostratic parts present. Examples of some of these composite materials for use in the metalwood golf clubs and their fabrication procedures are described in U.S. patent application Ser. No. 10/442,348 (now U.S. Pat. No. 7,267,620), Ser. No. 10/831,496 (now U.S. Pat. No. 7,140,974), Ser. Nos. 11/642,310, 11/825,138, 11/998,436, 11/895,195, 11/823,638, 12/004,386, 12,004,387, 11/960,609, 11/960,610, and 12/156,947, which are incorporated herein by reference. The composite material may be manufactured according to the methods described at least in U.S. patent application Ser. No. 11/825,138, the entire contents of which are herein incorporated by reference.

Alternatively, the crown may be formed from short or long fiber-reinforced formulations of the previously referenced polymers. Exemplary formulations include a Nylon 6/6 polyamide formulation which is 30% Carbon Fiber Filled and available commercially from RTP Company under the trade name RTP 285. The material has a Tensile Strength of 35000 psi (241 MPa) as measured by ASTM D 638; a Tensile Elongation of 2.0-3.0% as measured by ASTM D 638; a Tensile Modulus of $3.30\times10^6$ psi (22754 MPa) as measured by ASTM D 638; a Flexural Strength of 50000 psi (345 MPa) as measured by ASTM D 790; and a Flexural Modulus of $2.60\times10^6$ psi (17927 MPa) as measured by ASTM D 790.

Also included is a polyphthalamide (PPA) formulation which is 40% Carbon Fiber Filled and available commercially from RTP Company under the trade name RTP 4087 UP. This material has a Tensile Strength of 360 MPa as measured by ISO 527; a Tensile Elongation of 1.4% as measured by ISO 527; a Tensile Modulus of 41500 MPa as measured by ISO 527; a Flexural Strength of 580 MPa as measured by ISO 178; and a Flexural Modulus of 34500 MPa as measured by ISO 178.

Also included is a polyphenylene sulfide (PPS) formulation which is 30% Carbon Fiber Filled and available commercially from RTP Company under the trade name RTP 1385 UP. This material has a Tensile Strength of 255 MPa as measured by ISO 527; a Tensile Elongation of 1.3% as measured by ISO 527; a Tensile Modulus of 28500 MPa as measured by ISO 527; a Flexural Strength of 385 MPa as measured by ISO 178; and a Flexural Modulus of 23,000 MPa as measured by ISO 178.

In other embodiments, the crown is formed as a two layered structure comprising an injection molded inner layer and an outer layer comprising a thermoplastic composite laminate. The injection molded inner layer may be prepared from the thermoplastic polymers, with preferred materials including a polyamide (PA), or thermoplastic urethane (TPU) or a polyphenylene sulfide (PPS). Typically the thermoplastic composite laminate structures used to prepare the outer layer are continuous fiber reinforced thermoplastic resins. The continuous fibers include glass fibers (both roving glass and filament glass) as well as aramid fibers and carbon fibers. The thermoplastic resins which are impregnated into these fibers to make the laminate materials include polyamides (including but not limited to PA, PA6, PA12 and PA6), polypropylene (PP), thermoplastic polyurethane or polyureas (TPU) and polyphenylene sulfide (PPS).

The laminates may be formed in a continuous process in which the thermoplastic matrix polymer and the individual fiber structure layers are fused together under high pressure into a single consolidated laminate, which can vary in both the number of layers fused to form the final laminate and the thickness of the final laminate. Typically the laminate sheets are consolidated in a double-belt laminating press, resulting in products with less than 2 percent void content and fiber volumes ranging anywhere between 35 and 55 percent, in thicknesses as thin as 0.5 mm to as thick as 6.0 mm, and may include up to 20 layers. Further information on the structure and method of preparation of such laminate structures is disclosed in European patent No. EP1923420B1 issued on Feb. 25, 2009 to Bond Laminates GMBH, the entire contents of which are incorporated by reference herein.

The composite laminates structure of the outer layer may also be formed from the TEPEX® family of resin laminates available from Bond Laminates which preferred examples are TEPEX® dynalite 201, a PA66 polyamide formulation with reinforcing carbon fiber, which has a density of 1.4 g/cm$^3$, a fiber content of 45 vol %, a Tensile Strength of 785 MPa as measured by ASTM D 638; a Tensile Modulus of 53 GPa as measured by ASTM D 638; a Flexural Strength of 760 MPa as measured by ASTM D 790; and a Flexural Modulus of 45 GPa) as measured by ASTM D 790.

Another preferred example is TEPEX® dynalite 208, a thermoplastic polyurethane (TPU)-based formulation with reinforcing carbon fiber, which has a density of 1.5 g/cm$^3$, a fiber content of, 45 vol %, a Tensile Strength of 710 MPa as measured by ASTM D 638; a Tensile Modulus of 48 GPa as measured by ASTM D 638; a Flexural Strength of 745 MPa as measured by ASTM D 790; and a Flexural Modulus of 41 GPa as measured by ASTM D 790.

Another preferred example is TEPEX® dynalite 207, a polyphenylene sulfide (PPS)-based formulation with reinforcing carbon fiber, which has a density of 1.6 g/cm$^3$, a fiber content of 45 vol %, a Tensile Strength of 710 MPa as measured by ASTM D 638; a Tensile Modulus of 55 GPa as measured by ASTM D 638; a Flexural Strength of 650 MPa as measured by ASTM D 790; and a Flexural Modulus of 40 GPa as measured by ASTM D 790.

There are various ways in which the multilayered composite crown may be formed. In some embodiments the outer layer, is formed separately and discretely from the forming of the injection molded inner layer. The outer layer may be formed using known techniques for shaping thermoplastic composite laminates into parts including but not limited to compression molding or rubber and matched metal press forming or diaphragm forming.

The inner layer may be injection molded using conventional techniques and secured to the outer crown layer by bonding methods known in the art including but not limited to adhesive bonding, including gluing, welding (preferable welding processes are ultrasonic welding, hot element welding, vibration welding, rotary friction welding or high frequency welding (Plastics Handbook, Vol. 3/4, pages 106-107, Carl Hanser Verlag Munich & Vienna 1998)) or calendaring or mechanical fastening including riveting, or threaded interactions.

Before the inner layer is secured to the outer layer, the outer surface of the inner layer and/or the inner of the outer layer may be pretreated by means of one or more of the following processes (disclosed in more detail in Ehrenstein, "Handbuch Kunststoff-Verbindungstechnik", Carl Hanser Verlag Munich 2004, pages 494-504):

- Mechanical treatment, preferably by brushing or grinding,
- Cleaning with liquids, preferably with aqueous solutions or organics solvents for removal of surface deposits
- Flame treatment, preferably with propane gas, natural gas, town gas or butane
- Corona treatment (potential-loaded atmospheric pressure plasma)
- Potential-free atmospheric pressure plasma treatment
- Low pressure plasma treatment (air and $O_2$ atmosphere)
- UV light treatment
- Chemical pretreatment, e.g. by wet chemistry by gas phase pretreatment
- Primers and coupling agents In an especially preferred method of preparation a so called hybrid molding process may be used in which the composite laminate outer layer is insert molded to the injection molded inner layer to provide additional strength. Typically the composite laminate structure is introduced into an injection mold as a heated flat sheet or, preferably, as a preformed part. During injection molding, the thermoplastic material of the inner layer is then molded to the inner surface of the composite laminate structure the materials fuse together to form the crown as a highly integrated part. Typically the injection molded inner layer is prepared from the same polymer family as the matrix material used in the formation of the composite laminate structures used to form the outer layer so as to ensure a good weld bond.

In addition to being formed in the desired shape for the aft body of the club head, a thermoplastic inner layer may also be formed with additional features including one or more stiffening ribs to impart strength and/or desirable acoustical properties as well as one or more weight ports to allow placement of additional tungsten (or other metal) weights.

The thickness of the inner layer is typically of from about 0.25 to about 2 mm, preferably of from about 0.5 to about 1.25 mm.

The thickness of the composite laminate structure used to form the outer layer, is typically of from about 0.25 to about 2 mm, preferably of from about 0.5 to about 1.25 mm, even more preferably from 0.5 to 1 mm.

As described in detail in U.S. Pat. No. 6,623,378, filed Jun. 11, 2001, entitled "METHOD FOR MANUFACTURING AND GOLF CLUB HEAD" and incorporated by reference herein in its entirety, the crown or outer shell may be made of a composite material, such as, for example, a carbon fiber reinforced epoxy, carbon fiber reinforced polymer, or a polymer. Additionally, U.S. patent application Ser. Nos. 10/316,453 and 10/634,023 describe golf club heads with lightweight crowns. Furthermore, U.S. patent application Ser. No. 12/974,437 (now U.S. Pat. No. 8,608,591) describes golf club heads with lightweight crowns and soles.

Composite materials used to construct the crown should exhibit high strength and rigidity over a broad temperature range as well as good wear and abrasion behavior and be resistant to stress cracking. Such properties include, a) a Tensile Strength at room temperature of from about 7 ksi to about 330 ksi, preferably of from about 8 ksi to about 305 ksi, more preferably of from about 200 ksi to about 300 ksi, even more preferably of from about 250 ksi to about 300 ksi (as measured by ASTM D 638 and/or ASTM D 3039);

b) a Tensile Modulus at room temperature of from about 0.4 Msi to about 23 Msi, preferably of from about 0.46 Msi to about 21 Msi, more preferably of from about 0.46 Msi to about 19 Msi (as measured by ASTM D 638 and/or ASTM D 3039);

c) a Flexural Strength at room temperature of from about 13 ksi to about 300 ksi, from about 14 ksi to about 290 ksi, more preferably of from about 50 ksi to about 285 ksi, even more preferably of from about 100 ksi to about 280 ksi (as measured by ASTM D 790);

d) a Flexural Modulus at room temperature of from about 0.4 Msi to about 21 Msi, from about 0.5 Msi to about 20 Msi, more preferably of from about 10 Msi to about 19 Msi (as measured by ASTM D 790);

Composite materials that are useful for making club-head components comprise a fiber portion and a resin portion. In general the resin portion serves as a "matrix" in which the fibers are embedded in a defined manner. In a composite for club-heads, the fiber portion is configured as multiple fibrous layers or plies that are impregnated with the resin component. The fibers in each layer have a respective orientation, which is typically different from one layer to the next and precisely controlled. The usual number of layers for a striking face is substantial, e.g., forty or more. However for a sole or crown, the number of layers can be substantially decreased to, e.g., three or more, four or more, five or more, six or more, examples of which will be provided below. During fabrication of the composite material, the layers (each comprising respectively oriented fibers impregnated in uncured or partially cured resin; each such layer being called a "prepreg" layer) are placed superposedly in a "lay-up" manner. After forming the prepreg lay-up, the resin is cured to a rigid condition. If interested a specific strength may be calculated by dividing the tensile strength by the density of the material. This is also known as the strength-to-weight ratio or strength/weight ratio.

In tests involving certain club-head configurations, composite portions formed of prepreg plies having a relatively low fiber areal weight (FAW) have been found to provide superior attributes in several areas, such as impact resistance, durability, and overall club performance. (FAW is the weight of the fiber portion of a given quantity of prepreg, in units of $g/m^2$.) FAW values below 100 $g/m^2$, and more desirably below 70 $g/m^2$, can be particularly effective. A particularly suitable fibrous material for use in making prepreg plies is carbon fiber, as noted. More than one fibrous material can be used. In other embodiments, however, prepreg plies having FAW values below 70 $g/m^2$ and above 100 $g/m^2$ may be used. Generally, cost is the primary prohibitive factor in prepreg plies having FAW values below 70 $g/m^2$.

In particular embodiments, multiple low-FAW prepreg plies can be stacked and still have a relatively uniform distribution of fiber across the thickness of the stacked plies. In contrast, at comparable resin-content (R/C, in units of percent) levels, stacked plies of prepreg materials having a higher FAW tend to have more significant resin-rich regions, particularly at the interfaces of adjacent plies, than stacked plies of low-FAW materials. Resin-rich regions tend to reduce the efficacy of the fiber reinforcement, particularly since the force resulting from golf-ball impact is generally transverse to the orientation of the fibers of the fiber reinforcement. The prepreg plies used to form the panels desirably comprise carbon fibers impregnated with a suitable resin, such as epoxy. An example carbon fiber is "34-700" carbon fiber (available from Grafil, Sacramento, Calif.), having a tensile modulus of 234 Gpa (34 Msi) and a tensile strength of 4500 Mpa (650 Ksi). Another Grafil fiber that can be used is "TR50S" carbon fiber, which has a tensile modulus of 240 Gpa (35 Msi) and a tensile strength of 4900 Mpa (710 ksi). Suitable epoxy resins are types "301" and "350" (available from Newport Adhesives and Composites, Irvine, Calif.). An exemplary resin content (R/C) is between 33% and 40%, preferably between 35% and 40%, more preferably between 36% and 38%.

Figure 53:
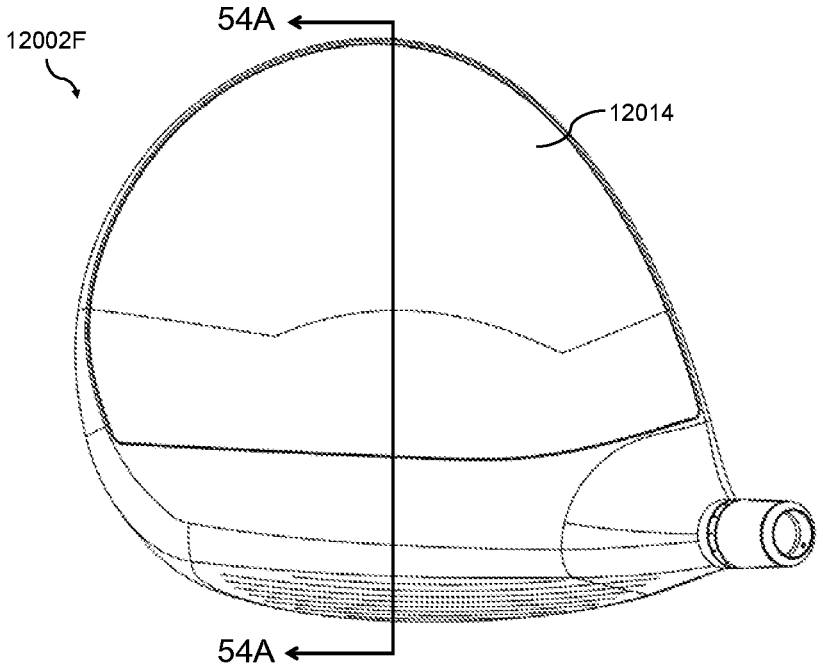
FIG. 53 is a top view of the golf club head of FIG. 46.
Figure 54A:
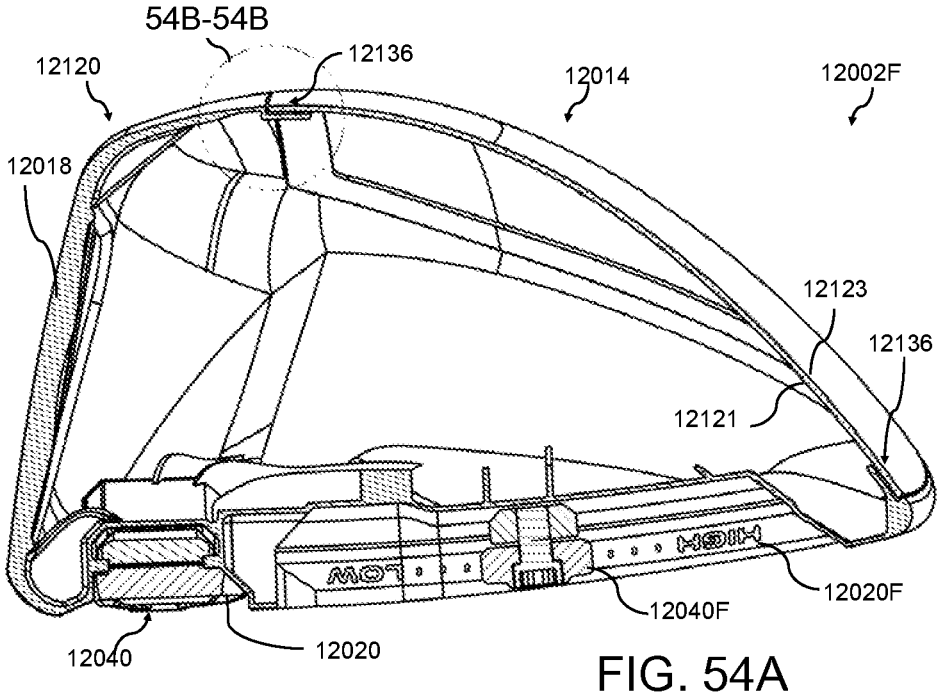
FIG. 54A is a cross-sectional view along line 54A-54A of the golf club head of FIG. 53.

Each of the golf club heads discussed throughout this application may include a separate crown, sole, and/or face that may be a composite, such as, for example, a carbon fiber reinforced epoxy, carbon fiber reinforced polymer, or a polymer crown, sole, and/or face. Alternatively, the crown, sole, and/or face may be made from a less dense material, such as, for example, Titanium or Aluminum. As an example, FIG. 53 shows a top view of golf club head 12002F with a composite crown 12014, and FIG. 54A shows a section view detailing the geometry. As shown in FIGS. 54 and 55, the sole, face, and a portion of the crown may all be cast from either steel (~8.05 $g/cm^3$) or titanium (~4.43 $g/cm^3$) while a majority of the crown may be made from a less dense material, such as for example, a material having a density of about 1.5 $g/cm^3$ or some other material having a density less than about 4.43 $g/cm^3$. In other words, the crown could be some other metal or a composite. Additionally or alternatively, the face may be welded in place rather than cast as part of the sole.

By making the crown, sole, and/or face out of a less dense material, it may provide cost savings or it may allow for weight to be redistributed from the crown, sole, and/or face to other areas of the club head, such as, for example, low and/or forward.

U.S. Pat. No. 8,163,119 discloses composite articles and methods for making composite articles, which is incorporated by reference herein in the entirety. This patent discloses the usual number of layers for a striking plate is substantial, e.g., fifty or more. However, improvements have been made in the art such that the layers may be decreased to between 30 and 50 layers. As already discussed for a sole and/or crown the layers can be substantially decreased down to three, four, five, six, seven, or more layers.

The tables below provide examples of possible layups. These layups show possible crown and/or sole construction using unidirectional plies unless noted as woven plies. The construction shown is for a quasi-isotropic layup. A single layer ply has a thickness of ranging from about 0.065 mm to about 0.080 mm for a standard FAW of 70 gsm with about 36% to about 40% resin content. The thickness of each individual ply may be altered by adjusting either the FAW or the resin content, and therefore the thickness of the entire layup may be altered by adjusting these parameters.

| ply 1 | ply 2 | ply 3 | ply 4 | ply 5 | ply 6 | ply 7 | ply 8 | AW g/m$^2$ |
|---|---|---|---|---|---|---|---|---|
| 0 | −60 | +60 | | | | | | 290-360 |
| 0 | −45 | +45 | 90 | | | | | 390-480 |
| 0 | +60 | 90 | −60 | 0 | | | | 490-600 |
| 0 | +45 | 90 | −45 | 0 | | | | 490-600 |
| 90 | +45 | 0 | −45 | 90 | | | | 490-600 |
| +45 | 90 | 0 | 90 | −45 | | | | 490-600 |
| +45 | 0 | 90 | 0 | −45 | | | | 490-600 |
| −60 | −30 | 0 | +30 | 60 | 90 | | | 590-720 |
| 0 | 90 | +45 | −45 | 90 | 0 | | | 590-720 |
| 90 | 0 | +45 | −45 | 0 | 90 | | | 590-720 |
| 0 | 90 | 45 | −45 | −45 | 45 | 0/90 woven | | 680-840 |
| 90 | 0 | 45 | −45 | −45 | 45 | 90/0 woven | | 680-840 |
| +45 | −45 | 90 | 0 | 0 | 90 | −45/45 woven | | 680-840 |
| 0 | 90 | 45 | −45 | −45 | 45 | 90 UD | | 680-840 |
| 0 | 90 | 45 | −45 | 0 | −45 | 45 | 0/90 woven | 780-960 |
| 90 | 0 | 45 | −45 | 0 | −45 | 45 | 90/0 woven | 780-960 |

The Area Weight (AW) is calculated by multiplying the density times the thickness. For the plies shown above made from composite material the density is about 1.5 g/cm$^3$ and for titanium the density is about 4.5 g/cm$^3$. Depending on the material used and the number of plies the composite crown and/or sole thickness ranges from about 0.195 mm to about 0.9 mm, preferably from about 0.25 mm to about 0.75 mm, more preferably from about 0.3 mm to about 0.65 mm, even more preferably from about 0.36 mm to about 0.56 mm. It should be understood that although these ranges are given for both the crown and sole together it does not necessarily mean the crown and sole will have the same thickness or be made from the same materials. In certain embodiments, the sole may be made from either a titanium alloy or a steel alloy. Similarly the main body of the club may be made from either a titanium alloy or a steel alloy. The titanium will typically range from 0.4 mm to about 0.9 mm, preferably from 0.4 mm to about 0.8 mm, more preferably from 0.4 mm to about 0.7 mm, even more preferably from 0.45 mm to about 0.6 mm. In some instances, the crown and/or sole may have non-uniform thickness, such as, for example varying the thickness between about 0.45 mm and about 0.55 mm.

A lot of discretionary mass may be freed up by using composite material in the crown and/or sole especially when combined with thin walled titanium construction (0.4 mm to 0.9 mm) in other parts of the club. The thin walled titanium construction increases the manufacturing difficulty and ultimately that fewer parts are cast at a time. In the past, 100 plus heads could be cast at a single time, however due to the thin and thinner wall construction less heads are cast per cluster to achieve the desired combination of high yield and low material usage.

As discussed in U.S. Pat. No. 7,513,296, herein incorporated by reference in the entirety, an important strategy for obtaining more discretionary mass is to reduce the wall thickness of the club-head. For a typical titanium-alloy "metal-wood" club-head having a volume of 460 cm$^3$ (i.e., a driver) and a crown area of 100 cm$^2$, the thickness of the crown is typically about 0.8 mm, and the mass of the crown is about 36 g. Thus, reducing the wall thickness by 0.2 mm (e.g., from 1 mm to 0.8 mm) can yield a discretionary mass "savings" of 9.0 g.

The following examples will help to illustrate the possible discretionary mass "savings" by making a composite crown rather than a titanium-alloy crown. For example, reducing the material thickness to about 0.73 mm yields an additional discretionary mass "savings" of about 25.0 g over a 0.8 mm titanium-alloy crown. For example, reducing the material thickness to about 0.73 mm yields an additional discretionary mass "savings" of about 25 g over a 0.8 mm titanium-alloy crown or 34 g over a 1.0 mm titanium-alloy crown. Additionally, a 0.6 mm composite crown yields an additional discretionary mass "savings" of about 27 g over a 0.8 mm titanium-alloy crown. Moreover, a 0.4 mm composite crown yields an additional discretionary mass "savings" of about 30 g over a 0.8 mm titanium-alloy crown. The crown can be made even thinner yet to achieve even greater weight savings, for example, about 0.32 mm thick, about 0.26 mm thick, about 0.195 mm thick. However, the crown thickness must be balanced with the overall durability of the crown during normal use and misuse. For example, an unprotected crown i.e. one without a head cover could potentially be damaged from colliding with other woods or irons in a golf bag.

Figure 54B:
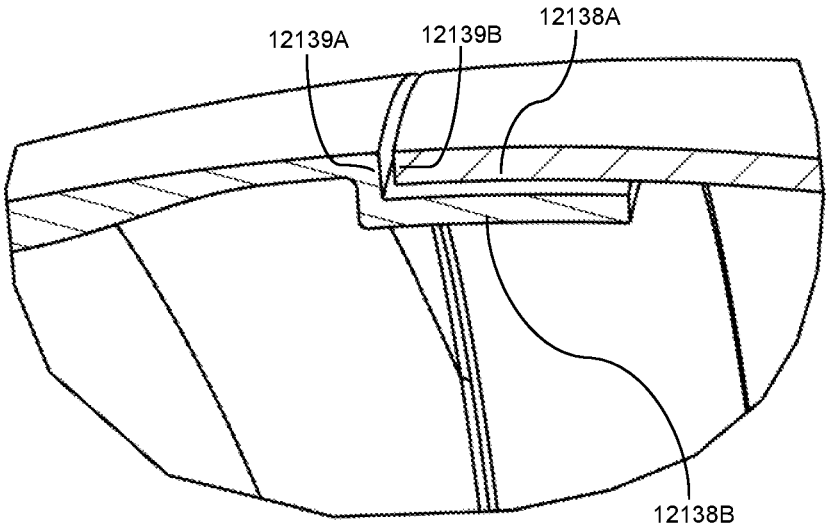
FIG. 54B is a close-up cross-sectional view of the golf club head of FIG. 54A.

As discussed in the patents referenced above, and as best seen in FIGS. 54 and 55, the outer shell or composite crown 12014 preferably is attached to a strike/sole plate combination 12120. To improve the strength of the connection between the composite crown 12014 and the strike/sole plate combination 12120, the composite crown 12014 and the strike/sole plate combination 12120 preferably include interlocking joints 12136, which is additionally shown in FIG. 54B.

In the illustrated embodiment, the joint 12136 comprises mating sections 12138A, 12138B formed on the composite crown 12014 and the strike/sole plate combination 12120 respectively. Each mating section 12138A, 12138B preferably includes abutment surfaces 12139A, 12139B that is transverse to the outer surface 12123 of the composite crown 12014. More preferably, the abutment surface lies substantially normal to the outer surface 12123 of the composite crown 12014. The abutment 12139A, 12139B surfaces help to align the composite crown 12014 with the strike/sole plate combination 12120 and to prevent lateral movement of these two components 12014, 12120 with respect to each other.

Each mating section 12138B, preferably includes an attachment surface at least two (2) times, and preferably, four (4) times as wide as the thickness of the composite crown 12014. For example, the ledge length or length of mating section 12138B may range from about 3 mm to about 8 mm, preferably from about 4 mm to about 7 mm, more preferably from about 5.5 mm to about 6.5 mm. Additionally, the mating section 12138A may range in thickness from about 0.3 mm to about 2 mm, preferably from about 0.5 mm to about 1.2 mm, more preferably from about 0.6 mm to about 1.0 mm, even more preferably from about 0.6 mm to about 0.8 mm.

The attachment surfaces preferably provide a surface for an adhesive and are generally parallel to the outer surface 12123 of the composite crown 12014 and midway between the inner surface 12121 and outer surface 12123 of the composite crown 12014. This arrangement is preferred because it permits a longer attachment surface and thicker mating sections 12138A, 12138B, which increases the strength of the joint 12136 and the bond between the composite crown 12014 with the strike/sole plate combination 12120 respectively. The attachment surfaces may extend along the entire perimeter of the composite crown 12014 (360 degrees). Alternatively, instead of a lap joint as shown, the composite crown may overlay the club body and then be polished for fit and finish.

The mating sections 12138A, 12138B, preferably extend completely along the interface between the composite crown 12014 with the strike/sole plate combination 12120. However, it should be appreciated that, in a modified arrangement, the mating sections 12138A, 12138B could extend only partially along the interface between the composite crown 12014 with the strike/sole plate combination 12120. In the illustrated arrangement, each piece 12138A, 12138B includes two abutment surfaces 12139A, 12139B, which are separated by the attachment surfaces. That is, the abutment surfaces and the attachment surfaces form interlocking steps. However, it should be appreciated that the mating sections can be formed into a variety of other shapes giving due consideration to the preference of providing a secure connection between the composite crown 12014 with the strike/sole plate combination 12120. For example, the mating sections 12138A, 12138B can comprise an interlocking tongue and groove arrangement or a matching inclined surface arrangement, each of which includes abutment surfaces and attachment surfaces.

To permanently secure the composite crown 12014 with the strike/sole plate combination 12120, an adhesive, such as, for example, an epoxy is applied to one or both of the mating sections 12138A, 12138B, preferably, along the attachment surfaces. In a modified arrangement, the composite crown 12014 with the strike/sole plate combination 12120 by fasteners that can extend through the joint 12136. In some embodiments, the strike/sole plate combination 12120 may include bumps or pads to help locate the crown. The bumps provide a bond gap and help with achieving a flush fit. The bumps or pads range from about 0.1 mm to about 0.4 mm in height, preferably about 0.15 mm in height. Alternatively, but similarly, spacers may be used that will also help to achieve a flush fit between the crown and the strike/sole plate combination 12120. Another advantage of using either spacers or bumps is less grinding is required due to variations in the strike/sole plate combination 12120 and variations in the composite crown 12014.

Figure 55A:
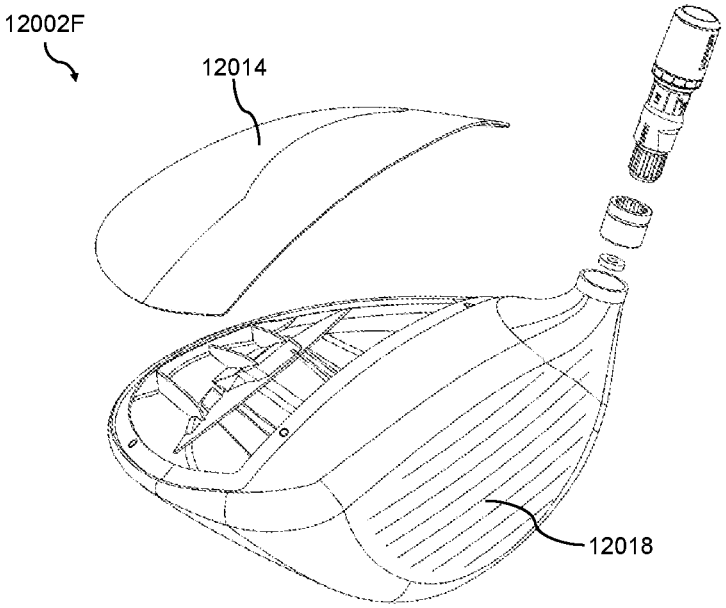
FIG. 55A is an exploded crown view of the golf club head of FIG. 46.

Turning to FIG. 55A, an exploded view is shown of the composite crown 12014 with the strike/sole plate combination 12120. Also visible in this view is the adjustable loft, lie, and/or face angle (PCT) hosel 12094.

Overall by using a composite crown and thin wall sections, the mass savings are at least 25 g, such as at least 30 g, such as at least 35 g, such as at least 40 g, such as at least 45 g, such as at least 50 g, such as at least 55 g. Much of this weight was put back into the club head in the form of front and rear sliding weight tracks or the T-track for short. Incorporating the front and rear sliding weight tracks into the sole not only required large amounts of mass for the structure, but required additional mass to improve the sound of the club above 2900 Hz.

The sound of the club can improved in several ways. One way is to increase the wall thickness, however a more efficient use of discretionary mass is to use ribs. By proper rib placement, the first mode frequency can be increased from well below 2900 Hz to at least 2900 Hz, such as at least 3000 Hz, such as at least 3100 Hz, such as at least 3200 Hz, such as at least 3300 Hz, such as at least 3400 Hz, such as at least 3500 Hz, such as at least 3600 Hz.

Figure 55B:
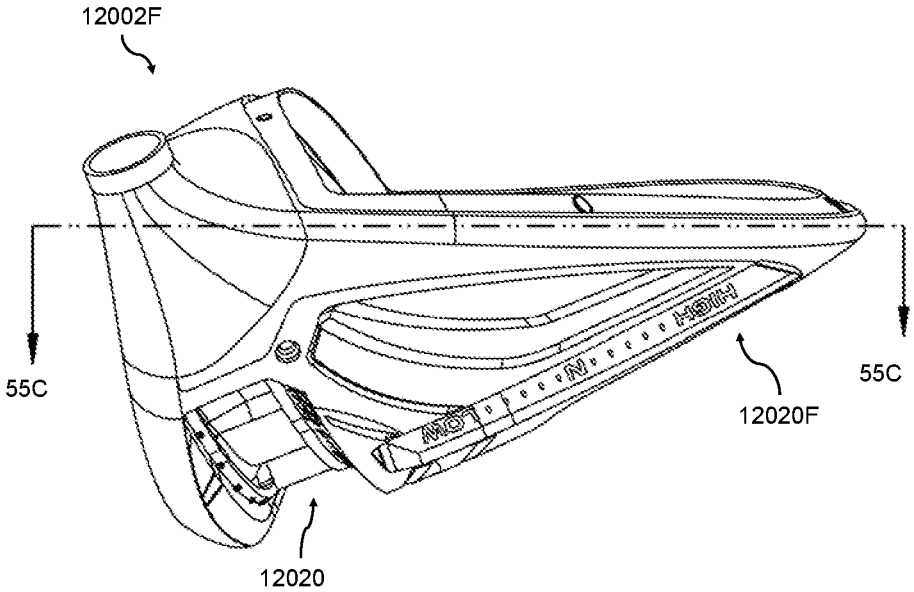
FIG. 55B is a heel view of the golf club head of FIG. 46 with the crown removed.
Figure 55C:
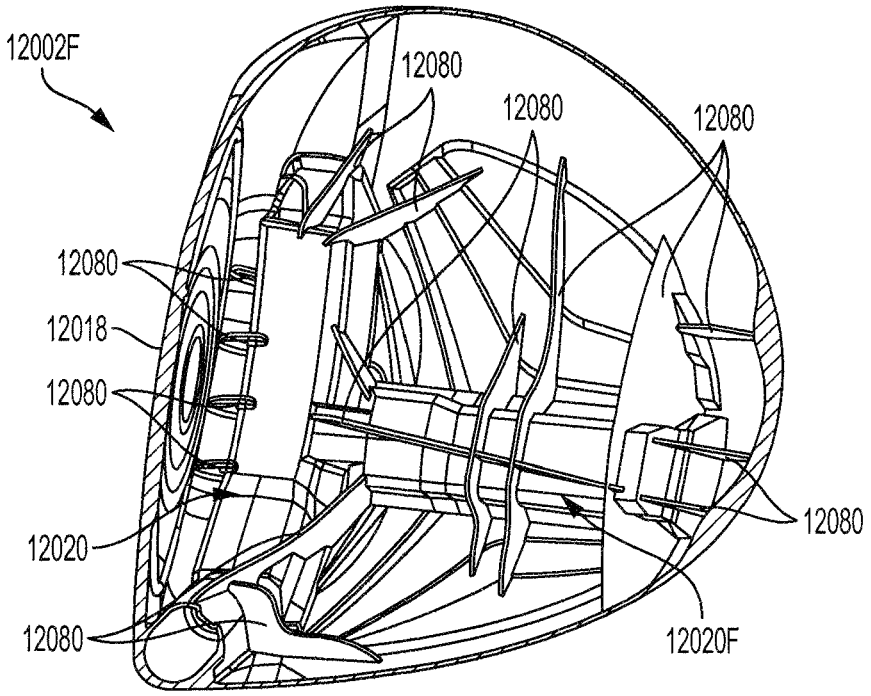
FIG. 55C is a cross-sectional view along line 55C-55C of the golf club head of FIG. 55B.

As shown in FIG. 55A, several ribs are visible with the crown removed. FIG. 55B shows the crown completely removed and is used to generate the cross-section view shown in FIG. 55C. Turning to FIG. 55C, the backside of face plate 12018 is shown with an optional variable face thickness or VFT (concentric circles), additionally the structure for the front and rearward sliding weight tracks 12020 and 12020F are visible. As shown, several ribs 12080 are attached to the weight tracks. This is to stiffen the overall structure and increase the first mode frequency to at least 3400 Hz.

Figure 55D:
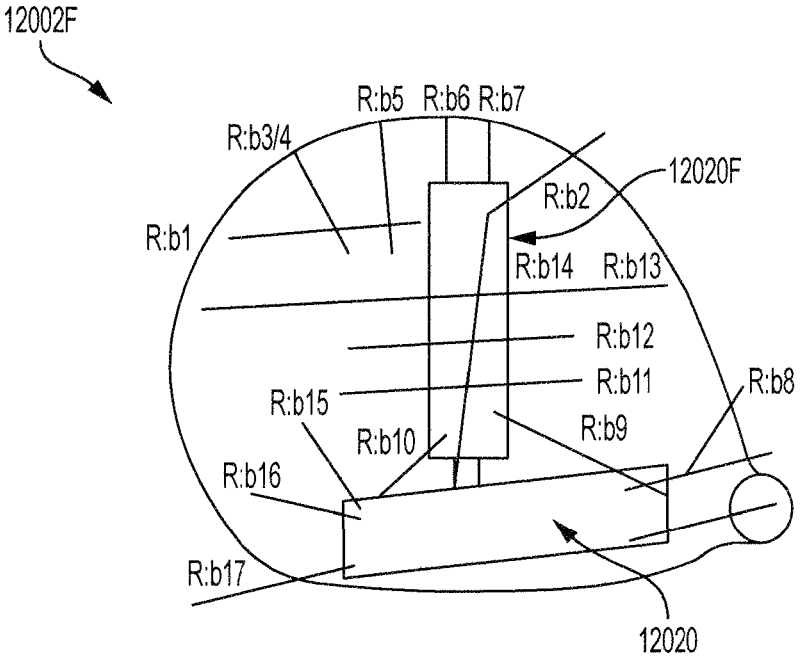
FIG. 55D is a cross-sectional view along line 55C-55C of the golf club head of FIG. 55B showing a sample rib configuration.

Each rib has an associated mass and an associated benefit in terms of frequency (Hz) improvement. Accordingly, fewer ribs may be used to reduce the overall club weight, however the first mode frequency will be impacted, and in most cases will decrease. A sample rib pattern is shown in FIG. 55D, which is similar to that shown in FIG. 55C. Table 14 below shows the impact of selectively removing a single rib at a time. For example, removing rib 13 causes a 404 Hz detriment to the first mode frequency from 3411 Hz to 3006 Hz, whereas removing rib 5 improved the first mode frequency by 34 Hz. There is an array of satisfactory designs, one that was chosen was to remove ribs 5, 11, and 17 to achieve a first mode frequency of 3421 Hz.

TABLE 14

| Rib | 1st Mode | Mass | Hz Penalty | Mass of Rib | Hz/g |
|---|---|---|---|---|---|
| 0 | 3411 | 206.6 | | | — |
| 1 | 3410 | 206.3 | 1 | 0.3 | 3.3 |
| 2 | 3336 | 206 | 74 | 0.3 | 246.7 |
| 3 | 3375 | 205.9 | 36 | 0.4 | 90.0 |
| 4 | 3434 | 206.5 | −23 | 0.1 | −230.0 |
| 5 | 3444 | 206.4 | −34 | 0.2 | −170.0 |
| 6 | 3336 | 206 | 74 | 0.3 | 246.7 |
| 7 | 3370 | 206.1 | 40 | 0.2 | 200.0 |
| 8 | 3378 | 205.8 | 32 | 0.5 | 64.0 |
| 9 | 3305 | 205.7 | 105 | 0.6 | 175.0 |
| 10 | 3352 | 205.2 | 58 | 1.1 | 52.7 |
| 11 | 3388 | 205.7 | 22 | 0.6 | 36.7 |
| 12 | 3374 | 205.6 | 36 | 0.7 | 51.4 |
| 13 | 3006 | 205.2 | 404 | 1.1 | 367.3 |
| 14 | 3381 | 205.8 | 29 | 0.5 | 58.0 |
| 15 | 3248 | 205.7 | 162 | 0.6 | 270.0 |
| 16 | 3377 | 206.1 | 33 | 0.2 | 165.0 |
| 17 | 3404 | 206 | 6 | 0.3 | 20.0 |
| Total | | | 1055 | 8 | 131.9 |

Notably, the strike or face plate 15018 may be cast as one piece along with the other structure including the sole plate as discussed in the patents referenced above, or the face plate 15018 may be welded to the golf club body. A single cast structure has some cost savings, however a separate welded face allows for greater customization.

Forward Slot and Rearward Track

In some implementations, a channel, slot, or some other member may be provided to increase the coefficient of restitution of the golf club head. For example, some embodiments of the golf club head may include a channel, a slot, or other member that increases or enhances the perimeter flexibility of the striking face of the golf club head in order to increase the coefficient of restitution (COR) and/or characteristic time of the golf club head.

In some instances, the channel, slot, or other mechanism is located in the forward portion of the sole of the club head, adjacent to or near to the forwardmost edge of the sole. Further detail concerning these features that increase or enhance COR of the golf club head is provided in U.S. patent application Ser. Nos. 13/338,197, 13/469,031, 13/828,675, filed Dec. 27, 2011, May 10, 2012, and Mar. 14, 2013, respectively, all entitled "FAIRWAY WOOD CG PROJECTION" and incorporated by reference herein in their entirety. Additional detail concerning these features that increase or enhance COR can also be found in U.S. patent application Ser. No. 13/839,727, filed Mar. 15, 2013, entitled "GOLF CLUB WITH COEFFICIENT OF RESTITUTION FEATURE" and incorporated by reference herein in its entirety.

In some instances, the channel, slot, or other mechanism is located in the forward portion of the crown of the club head, adjacent to or near to the forwardmost edge of the crown. Further detail concerning these features is provided in U.S. Pat. No. 8,235,844, filed Jun. 1, 2010, entitled "Hollow golf club head" and incorporated by reference herein in its entirety, U.S. Pat. No. 8,241,143, filed Dec. 13, 2011, entitled "Hollow golf club head having sole stress reducing feature" and incorporated by reference herein in its entirety, and U.S. Pat. No. 8,241,144, filed Dec. 14, 2011, entitled "Hollow golf club head having crown stress reducing feature" and incorporated by reference herein in its entirety.

Turning attention to FIGS. 56A-56E, golf club head 18002A includes many similar or identical features to golf club head 12000 combined in unique and distinct ways. Thus, for the sake of brevity, each feature of golf club head 18002A will not be redundantly explained. Rather, key distinctions between golf club head 18002A and golf club head 12000 will be described in detail and the reader should reference the discussion above for features substantially similar between the two golf club heads.

Figure 56A:
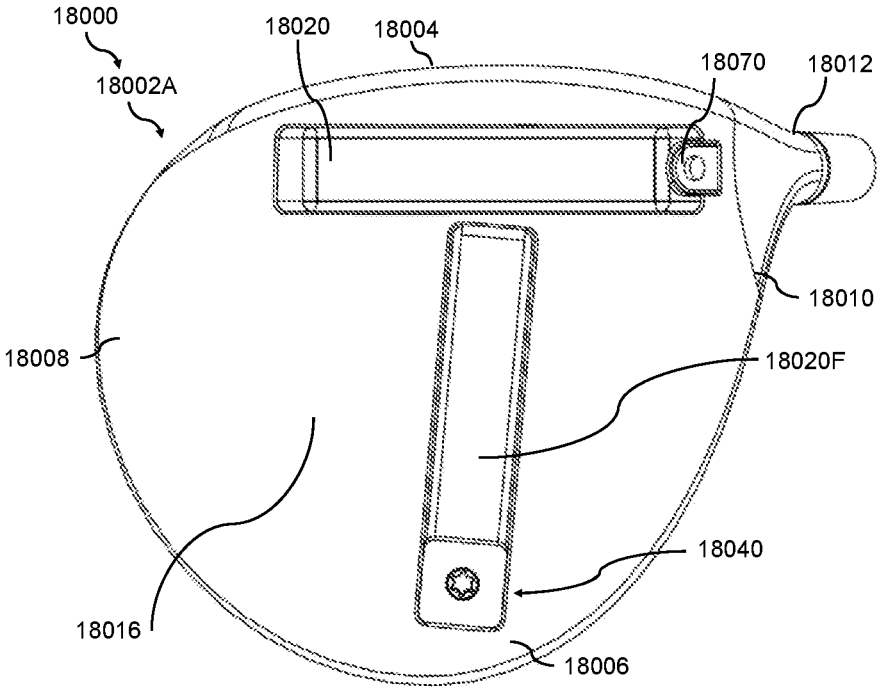
FIG. 56A is a bottom view of a golf club head, according to yet another embodiment.

FIG. 56A shows an embodiment of a golf club head 18002A with a forward channel 18020 and a rearward weight track 18020F in the sole of the club head. The forward channel 18020 allows for greater perimeter flexibility to increase COR, decrease spin, and may impact other launch conditions. The rearward weight track 18020F allows a user to adjust the CG position of the golf club head, which in turn adjusts a number of factors including ball spin and MOI.

Golf club head 18000 includes several of the structures and features of the previous embodiments, including a hollow body 18002A, a forward channel 18020, a rearward track 18020F, and a slidable weight assembly 18040. The body 18002A (and thus the whole club head 18000) includes a front portion 18004, a rear portion 18006, a toe portion 18008, a heel portion 18010, a hosel 18012, a crown 18014 and a sole 18016. The front portion 18004 forms an opening that receives a face plate 18018, which can be a variable thickness, composite, and/or metal face plate, as described herein. The illustrated club head 18000 can also comprise an adjustable shaft connection system for coupling a shaft to the hosel 18012 via a hosel opening 18070.

Figure 56B:
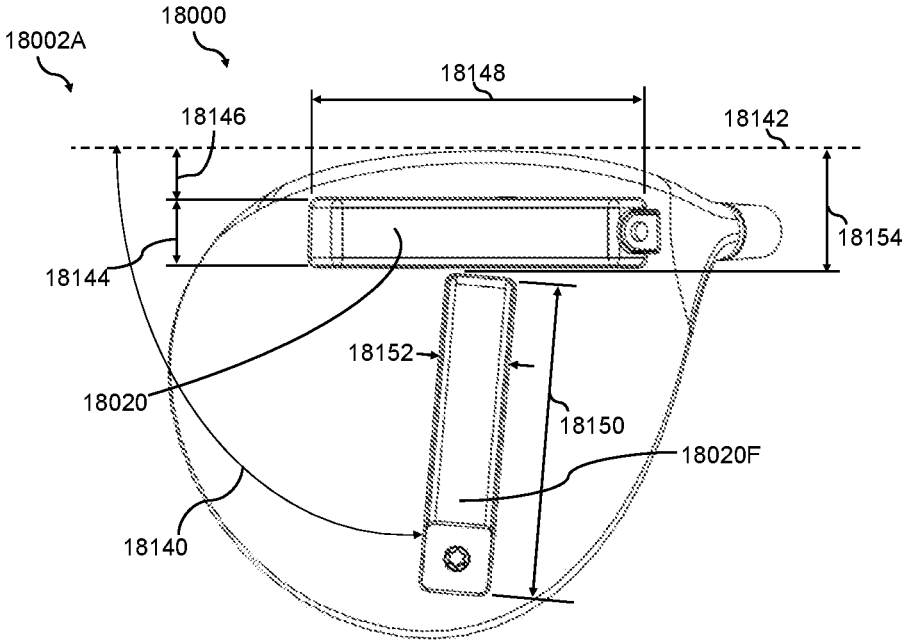
FIG. 56B is a bottom view of the golf club head of FIG. 56A.

As shown in FIG. 56B, the rearward weight track 18020F may be at an angle 18140 relative a vertical plane 18142 intersecting a center of a face plate 18018. The particular angle of the rearward weight track 18020F would depend on the golf club head geometry. In some embodiments, angling the track may help reduce any draw or fade bias compared to a track parallel the y-axis of golf club head especially when shifting the weight along the rearward track 18020F. Angle 18140 is between about 0 degrees and about 180 degrees, such as between about 20 degrees and about 160 degrees, such as between about 40 degrees and about 140 degrees, such as between about 60 degrees and about 120 degrees, such as between about 70 degrees and about 110 degrees.

Figure 56C:
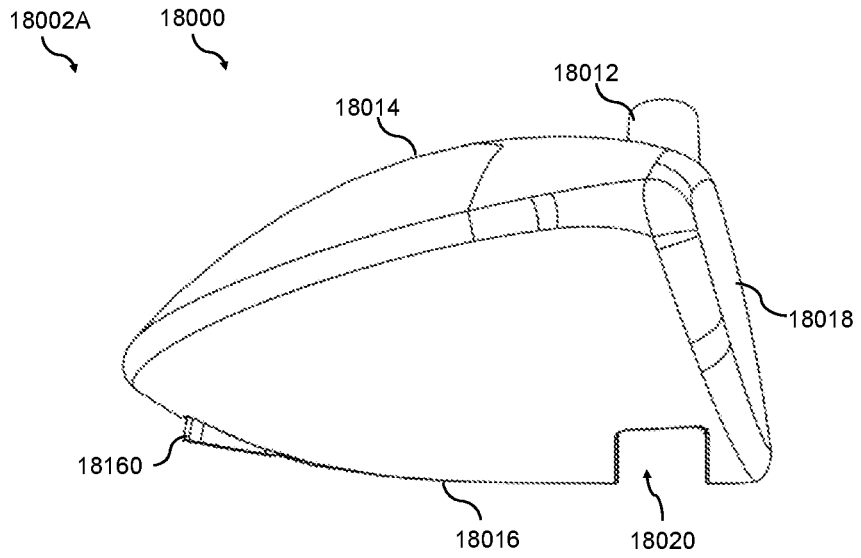
FIG. 56C is a toe view of the golf club head of FIG. 56A.

As shown in FIG. 56C, golf club head 18002A includes an aft winglet 18160. The aft winglet 18160 deviates from the curvature of the sole and provides a CG lowering platform. As best shown in FIG. 56C, the aft winglet 18160 deviates from the sole and provides a platform to further lower the CG when sliding the slidable weight assembly 18040 rearward.

A rearward weight track provides a user with additional adjustability. As discussed above, moving the weight closer to the striking face may produce a lower spinning ball due to a lower and more forward CG. This would also allow a user to increase club head loft, which in general higher lofted clubs are considered to be "easier" to hit. Moving the weight rearward towards the rear of the club allows for increased MOI and a higher spinning ball. Clubs with higher MOI are generally considered "easier" to hit. Accordingly, the rearward weight track allows for at least both spin and MOI adjustment.

Figure 56D:
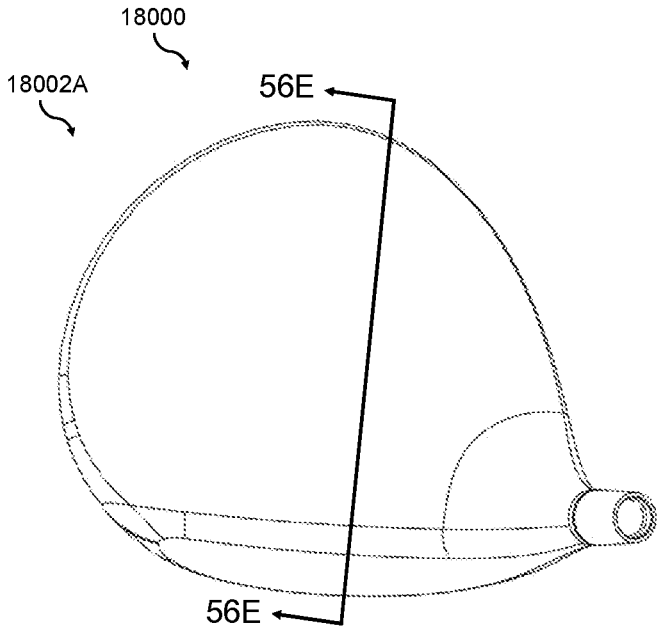
FIG. 56D is a top view of the golf club head of FIG. 56A.
Figure 56E:
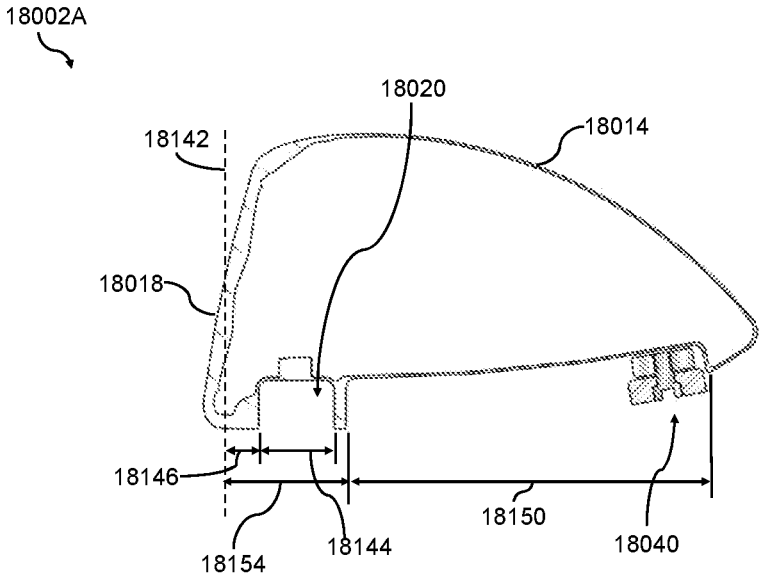
FIG. 56E is a cross-sectional view along line 56E-56E of the golf club head of FIG. 56D.

In the embodiments shown, and as most clearly seen in FIGS. 56B and 56E, the forward channel is offset from the face by a forward channel offset distance 18146, which is the minimum distance between a first vertical plane passing through the center of the face plate 18018 and the forward channel 18020 at the same x-coordinate as the center of the face plate 18018 is between about 5 mm and about 50 mm, such as between about 10 mm and about 40 mm, such as between about 25 mm and about 30 mm. Similarly, the rearward track is offset from the face by a rearward track offset distance 18154, which is the minimum distance between a first vertical plane passing through the center of the face plate 18018 and the rearward track 18020F at the same x-coordinate as the center of the face plate 18018 is between about 12 mm and about 50 mm, such as between about 15 mm and about 40 mm, such as between about 20 mm and about 30 mm.

In the embodiments shown, both the forward channel 18020 and rearward track 18020F have a certain channel/track width 18144, 18152, respectively. Channel/track width may be measured as the horizontal distance between a first channel wall and a second channel wall. For both the forward channel and rearward track, widths 18144 and 18152 may be between about 5 mm and about 20 mm, such as between about 10 mm and about 18 mm, such as between about 12 mm and about 16 mm. In the embodiments shown, the depth of the channel or track (i.e., the vertical distance between the bottom channel wall and an imaginary plane containing the regions of the sole adjacent the front and rear edges of the channel) may be between about 6 mm and about 20 mm, such as between about 8 mm and about 18 mm, such as between about 10 mm and about 16 mm.

In the embodiments shown, both the forward channel 18020 and rearward track 18020F have a certain channel/track length 18148, 18150, respectively. Channel/track length may be measured as the horizontal distance between a third channel wall and a fourth channel wall. For both the forward channel and rearward track, lengths 18148 and

18150 may be between about 30 mm and about 120 mm, such as between about 50 mm and about 100 mm, such as between about 60 mm and about 90 mm.

Additionally or alternatively, the length of the channel may be a percentage of the striking face length. For example, the channel may be between about 30% and about 100% of the striking face length, such as between about 50% and about 90%, such as between about 60% and about 80% mm of the striking face length.

FIG. 56D shows a crown view of golf club head 18002A. FIG. 56E is a section view taken through the crown and rearward track. FIG. 56E shows another view of the rearward track, sliding weight assembly in the rearward track, and the forward channel. In some instances, the forward channel may hold a sliding weight, or it may be a feature to improve and/or increase the coefficient of restitution (COR feature) across the face. In regards to a COR feature, the channel may take on various forms such as a channel or through slot.

Figure 57A:
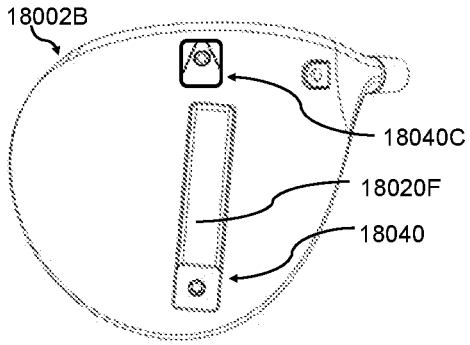
FIG. 57A is a bottom view of a golf club head, according to yet another embodiment.
Figure 57B:
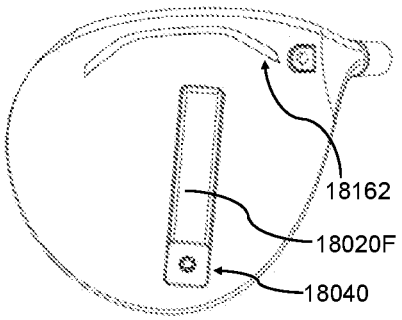
FIG. 57B is a bottom view of a golf club head, according to yet another embodiment.
Figure 57C:
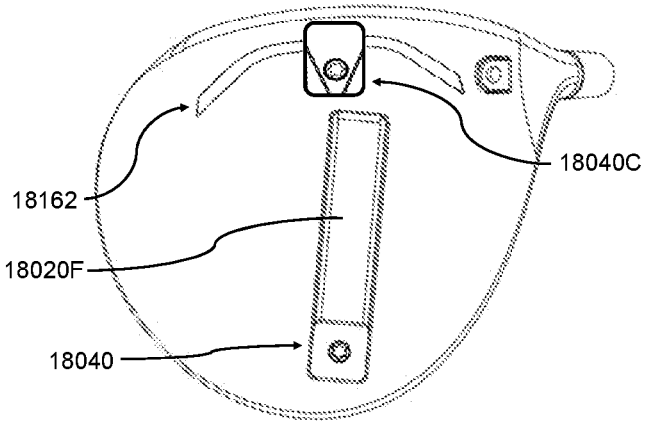
FIG. 57C is a bottom view of a golf club head, according to yet another embodiment.
Figure 57D:
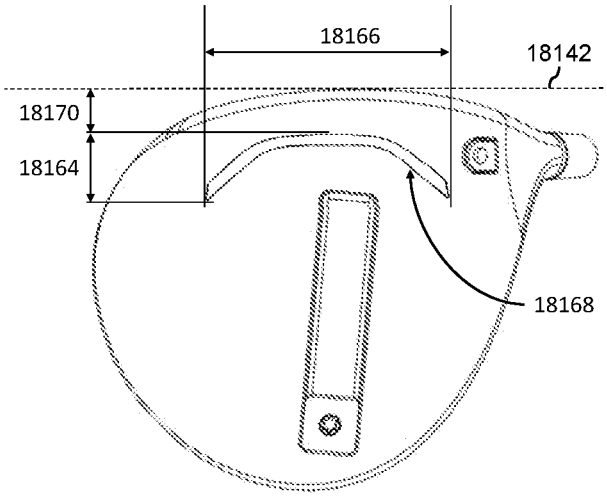
FIG. 57D is a bottom view of the golf club head of FIG. 56B.

FIGS. 57A-57C show additional embodiments including a rear weight track. As shown in FIG. 57A, the golf club head 18002B includes a rear weight track 18020F with at least one weight assembly 18040C in the forward position. More than one weight may be used in the forward position and/or there may be several weight ports strategically placed on the club head body. For example, golf club head 18002B may include a toe weight port and a heel weight port. A user could then move more weight to either the toe or heel to promote either a draw or fade bias by. Additionally, as discussed above, splitting discretionary weight between a forward and rearward position produces a higher MOI club, whereas moving all the weight to the forward portion of the club produces a golf club with a low and forward CG. Accordingly, a user could select between a "forgiving" higher MOI club, or a club that produces a lower spinning ball.

FIG. 57B shows a rear weight track 18020F with a forward slot 18162. The forward slot 18162 allows for greater perimeter flexibility thereby maintaining and/or increasing COR across the striking face. Additionally or alternatively, toe and heel weight ports may be included in this embodiment.

FIG. 57C shows a rear weight track 18020F with a forward slot 18162, and a forward weight 18040C. The forward slot enhances the COR across the face of the golf club. The forward weight provides additional weight in the forward position of the club. The forward weight overhangs the forward slot. As discussed above, this can allow for a high MOI club by moving the sliding weight to the rearward position, or a low and forward CG golf club by moving the sliding weight to the forward position. Additionally or alternatively, toe and heel weight ports may be included in this embodiment.

Additionally or alternatively, the forward weight may be interchangeable with the sliding weight, and/or the weight may be interchangeable with other weights installed in weight ports. Either the forward weight or sliding weight may range from 1 g to 50 g. The range of weights allows for swing weight adjustability, greater MOI adjustment, and/or spin adjustment among other things.

The slot shown in FIGS. 57B and 57C, may be a through slot as discussed above and in U.S. patent application Ser. No. 13/839,727, filed Mar. 15, 2013, entitled "GOLF CLUB WITH COEFFICIENT OF RESTITUTION FEATURE". The slot may include a slot width 18164, a slot length 18166, and slot perimeter 18168.

In the embodiments shown, the slot width 18164 may be between about 5 mm and about 20 mm, such as between about 10 mm and about 18 mm, such as between about 12 mm and about 16 mm, or it may be larger or smaller. The slot length 18166 may be between about 30 mm and about 120 mm, such as between about 50 mm and about 100 mm, such as between about 60 mm and about 90 mm, or it may be larger or smaller. The slot perimeter 18168 may be between about 70 mm and about 280 mm, such as between about 120 mm and about 240 mm, such as between about 160 mm and about 200 mm, or it may be larger or smaller.

In the embodiments shown, a distance 18170 between a vertical plane 18142 intersecting the center of the face plate 18018 and the slot 18162 at the same x-coordinate as the center of the face plate 18018 may be between about 5 mm and about 25 mm, such as between about 8 mm and about 18 mm, such as between about 10 mm and about 15 mm.

Additionally or alternatively, the length of the slot may be a percentage of the striking face length. For example, the slot may be between about 30% and about 100% of the striking face length, such as between about 50% and about 90%, such as between about 60% and about 80% mm of the striking face length.

The slot may be made up of curved sections, or several segments that may be a combination of curved and straight segments. The slot may be machined or cast into the head. Although shown in the sole of the club, the slot may be incorporated into the crown of the club.

The slot or channel may be filled with a material to prevent dirt and other debris from entering the slot or channel and possibly the cavity of the club head in the case of a through slot. The filling material may be any relatively low modulus materials including polyurethane, elastomeric rubber, polymer, various rubbers, foams, and fillers. The plugging material should not substantially prevent deformation of the golf club head when in use as this would counteract the perimeter flexibility.

The geometry of the rearward track is similar to the geometry of the forward track. Additionally, the method of installing the weight in the rearward track is similar to the method already discussed above with respect to the forward track. Notably, the rearward track geometry and the weight geometry must be designed to accommodate for the curvature of the sole.

Perimeter Flexibility

Figure 60A:
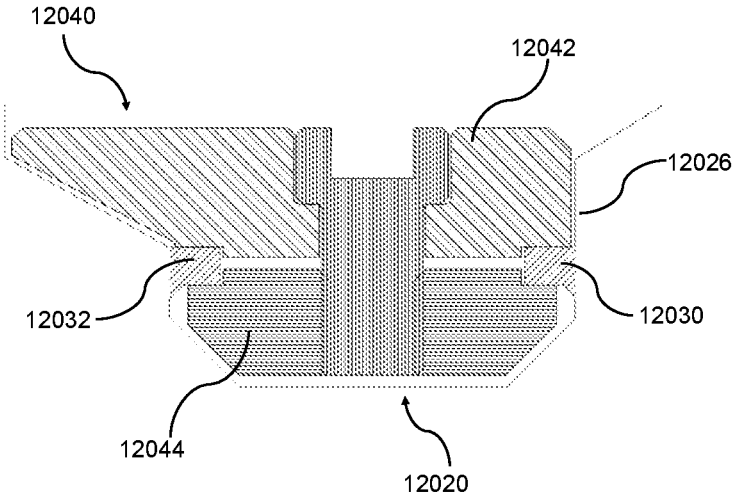
FIGS. 60A-D are cross-sectional views of a weight assembly according to different embodiments.

As discussed above, the forward channel 12020 may provide additional perimeter flexibility. However, perimeter flexibility may be impacted due to the interaction with the installed weight assembly 12040. As shown in FIG. 60A, there is almost no gap between the front channel wall 12026 and the weight assembly 12040. In some instances, it has been found that the weight assembly can act as a bridge across the channel transferring load across the weight assembly to an aft portion of the club head. This limits how high the perimeter flexibility can be due to the weight assembly creating a localized area of rigidity. As a result, in some instances the coefficient of restitution (COR) and/or characteristic time of the golf club head may vary along the channel depending on the weight position within the channel. Accordingly, it is desirable to limit or eliminate the possible impact of the weight assembly on perimeter flexibility to obtain a more constant COR/CT along the channel independent of the weight position.

Multiple approaches exist for limiting or eliminating the effect of the installed weight assembly on the perimeter flexibility. The following are examples of possible solutions to the problem.

Figure 60B:
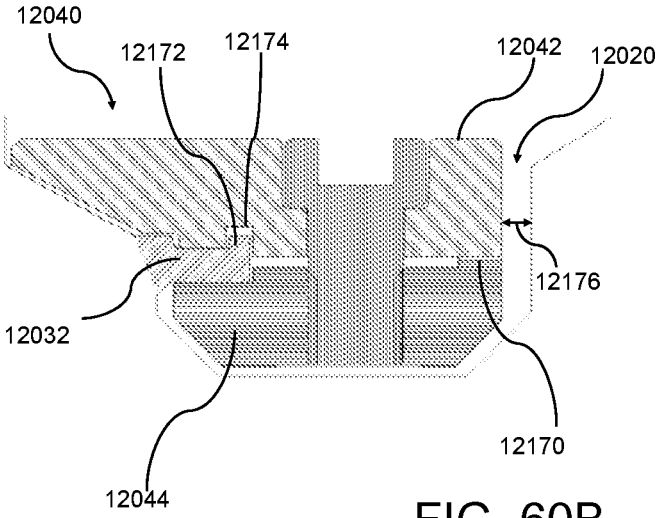

A first approach is to secure the weight assembly 12040 solely to the aft or rear channel ledge 12032. This configuration is shown in FIG. 60B. A protrusion 12170 on the forward end of one or both of the washer 12042 and mass member 12044 can be designed in order to maintain planar contact between the rear channel ledge 12032 and the weight assembly 12040 clamping surfaces during tightening. This would eliminate any interaction of the weight assembly with the perimeter flexibility. However, the weight assembly would be unsupported at one end resulting in a cantilever beam which would be more susceptible to loosening over time and/or experiencing vibrational ringing during impact.

One method to help insure the cantilevered weight would not rotate during tightening or use, is to optionally include a ridge 12172 that extends transverse to the rear channel ledge 12032 that would have a mating groove 12174 on one side of the weight assembly as shown in FIG. 60B. This mating ridge/groove system would minimize rotation during tightening and thus insure that an engineered gap 12176 between the forward part of the weight assembly 12040 and the channel 12020 remains large enough to not have contact and increase the stiffness after tightening or use.

Figure 60C:
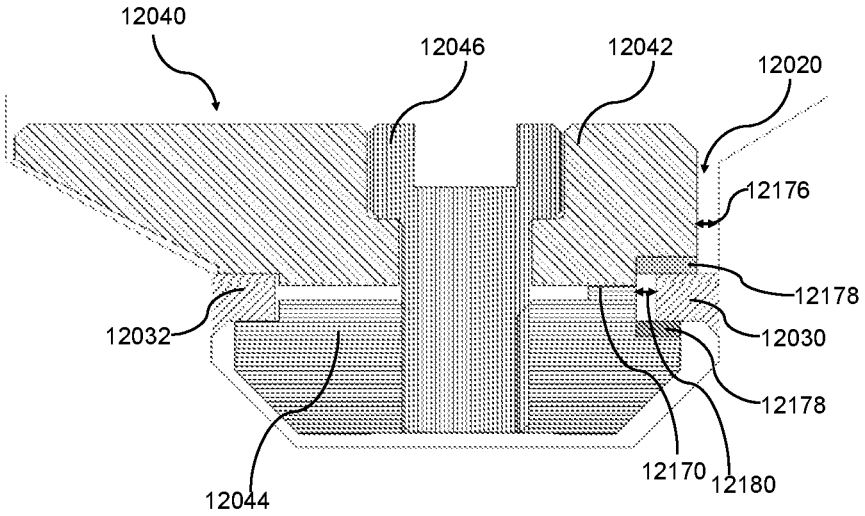

A second approach is to limit the interaction of the weight assembly with the channel. This can be done by having a majority of the clamping force transferred to the rear channel ledge 12032 (i.e., metal-to-metal contact), and by providing a gap 12180 between the front channel ledge 12030 and the weight assembly 12040. The reduced clamping load on the forward channel ledge 12030 combined with the gap 12180 allows the channel to deflect more during impact. However, a portion of the weight assembly may still be supported by the front channel ledge. The portion of the weight assembly that is supported by the front channel ledge would include a softer material 12178 (i.e., lower hardness than the metals used in the weight assembly) that would reduce transverse deflections and vibrations without substantially adding front-back stiffness across the channel. This configuration is shown in FIG. 60C.

Figure 60D:
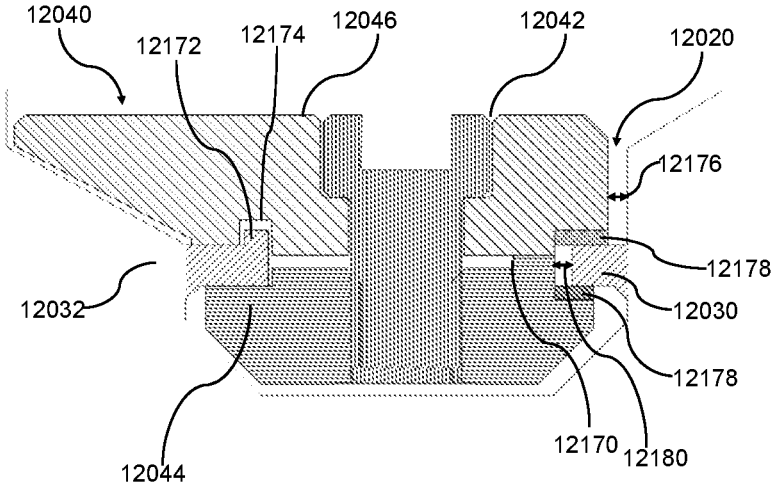

A protrusion 12070 on the forward end of one or both of the washer 12042 and mass member 12044 can be designed in order to maintain planer contact between the aft ledge and the weight assembly clamping surfaces during tightening which would bottom out before significant clamping pressure develops on the softer material. This approach could also benefit from the anti-rotation ridge 12172 and groove 12174 system described herein, and shown in FIG. 60D.

Design Parameters for Golf Club Heads with Slidably Repositionable Weight(s)

Although the following discussion cites features related to golf club head 12000 and its variations (e.g. 12002A-F), the many design parameters discussed below substantially apply to golf club heads 9300, 13000, 15000, and 18000 due to the common features of the club heads. With that in mind, in some embodiments of the golf clubs described herein, the location, position or orientation of features of the golf club head, such as the golf club head 9300, 13000, 15000, and 18000, can be referenced in relation to fixed reference points, e.g., a golf club head origin, other feature locations or feature angular orientations. The location or position of a weight or weight assembly, such as the weight assembly 9340, 12040A-F, 13040, 15040, 18040A-F is typically defined with respect to the location or position of the weight's or weight assembly's center of gravity. When a weight or weight assembly is used as a reference point from which a distance, i.e., a vectorial distance (defined as the length of a straight line extending from a reference or feature point to another reference or feature point) to another weight or weight assembly location is determined, the reference point is typically the center of gravity of the weight or weight assembly.

The location of the weight assembly on a golf club head can be approximated by its coordinates on the head origin coordinate system. The head origin coordinate system includes an origin at the ideal impact location 10160 of the golf club head, which is disposed at the geometric center of the striking surface 10122 (see FIG. 28). As described herein, the head origin coordinate system includes an x-axis and a y-axis. The origin x-axis extends tangential to the face plate at the origin and generally parallel to the ground when the head is ideally positioned with the positive x-axis extending from the origin towards a heel of the golf club head and the negative x-axis extending from the origin to the toe of the golf club head. The origin y-axis extends generally perpendicular to the origin x-axis and parallel to the ground when the head is ideally positioned with the positive y-axis extending from the head origin towards the rear portion of the golf club. The head origin can also include an origin z-axis extending perpendicular to the origin x-axis and the origin y-axis and having a positive z-axis that extends from the origin towards the top portion of the golf club head and negative z-axis that extends from the origin towards the bottom portion of the golf club head.

As described herein, in some of the embodiments of the golf club head 12000 described herein, the channel 12020 extends generally from a heel end 12022 oriented toward the heel portion 12010 to a toe end 12024 oriented toward the toe portion 12008, with both the heel end 12022 and toe end 12024 being at or near the same distance from the front portion of the club head. As a result, in these embodiments, the weight assembly 12040 that is slidably retained within the channel 12020 is capable of a relatively large amount of adjustment in the direction of the x-axis, while having a relatively small amount of adjustment in the direction of the y-axis. In some alternative embodiments, the heel end 12022 and toe end 12024 may be located at varying distances from the front portion, such as having the heel end 12022 further rearward than the toe end 12024, or having the toe end 12022 further rearward than the heel end 12022. In these alternative embodiments, the weight assembly 12040 that is slidably retained within the channel 12020 is capable of a relatively large amount of adjustment in the direction of the x-axis, while also having from a small amount to a larger amount of adjustment in the direction of the y-axis.

For example, in some embodiments of a golf club head 12000 having a weight assembly 12040 that is adjustably positioned within a channel 12020, the weight assembly 12040 can have an origin x-axis coordinate between about −50 mm and about 65 mm, depending upon the location of the weight assembly within the channel 12020. In specific embodiments, the weight assembly 12040 can have an origin x-axis coordinate between about −45 mm and about 60 mm, or between about −40 mm and about 55 mm, or between about −35 mm and about 50 mm, or between about −30 mm and about 45 mm, or between about −25 mm and about 40 mm, or between about −20 mm and about 35 mm. Thus, in some embodiments, the weight assembly 12040 is provided with a maximum x-axis adjustment range (Max $\Delta x$) that is greater than 50 mm, such as greater than 60 mm, such as greater than 70 mm, such as greater than 80 mm, such as greater than 90 mm, such as greater than 100 mm, such as greater than 110 mm.

On the other hand, in some embodiments of the golf club head 12000 having a weight assembly 12040 that is adjustably positioned within a channel 12020, the weight assembly 12040 can have an origin y-axis coordinate between about 5 mm and about 60 mm. More specifically, in certain embodiments, the weight assembly 12040 can have an origin y-axis coordinate between about 5 mm and about 50 mm, between about 5 mm and about 45 mm, or between about 5 mm and about 40 mm, or between about 10 mm and about 40 mm, or between about 5 mm and about 35 mm. Thus, in some embodiments, the weight assembly 12040 is provided with a maximum y-axis adjustment range (Max Δy) that is less than 40 mm, such as less than 30 mm, such as less than 20 mm, such as less than 10 mm, such as less than 5 mm, such as less than 3 mm. Additionally or alternatively, in some embodiments having a rearward track, the weight assembly 12040 is provided with a maximum y-axis adjustment range (Max Δy) that is less than 110 mm, such as less than 80 mm, such as less than 60 mm, such as less than 40 mm, such as less than 30 mm, such as less than 15 mm.

In some embodiments, a golf club head can be configured to have a constraint relating to the relative distances that the weight assembly can be adjusted in the origin x-direction and origin y-direction. Such a constraint can be defined as the maximum y-axis adjustment range (Max Δy) divided by the maximum x-axis adjustment range (Max Δx). According to some embodiments, the value of the ratio of (Max Δy)/(Max Δx) is between 0 and about 0.8. In specific embodiments, the value of the ratio of (Max Δy)/(Max Δx) is between 0 and about 0.5, or between 0 and about 0.2, or between 0 and about 0.15, or between 0 and about 0.10, or between 0 and about 0.08, or between 0 and about 0.05, or between 0 and about 0.03, or between 0 and about 0.01.

As discussed above, in some embodiments, the mass of the weight assembly 12040 is between about 1 g and about 50 g, such as between about 3 g and about 40 g, such as between about 5 g and about 25 g. In some alternative embodiments, the mass of the weight assembly 12040 is between about 5 g and about 45 g, such as between about 9 g and about 35 g, such as between about 9 g and about 30 g, such as between about 9 g and about 25 g.

In some embodiments, a golf club head can be configured to have constraints relating to the product of the mass of the weight assembly and the relative distances that the weight assembly can be adjusted in the origin x-direction and/or origin y-direction. One such constraint can be defined as the mass of the weight assembly ($M_{WA}$) multiplied by the maximum x-axis adjustment range (Max Δx). According to some embodiments, the value of the product of $M_{WA}$ x (Max Δx) is between about 250 g·mm and about 4950 g·mm. In specific embodiments, the value of the product of $M_{WA}$ x (Max Δx) is between about 500 g·mm and about 4950 g·mm, or between about 1000 g·mm and about 4950 g·mm, or between about 1500 g·mm and about 4950 g·mm, or between about 2000 g·mm and about 4950 g·mm, or between about 2500 g·mm and about 4950 g·mm, or between about 3000 g·mm and about 4950 g·mm, or between about 3500 g·mm and about 4950 g·mm, or between about 4000 g·mm and about 4950 g·mm.

Another constraint relating to the product of the mass of the weight assembly and the relative distances that the weight assembly can be adjusted in the origin x-direction and/or origin y-direction can be defined as the mass of the weight assembly ($M_{WA}$) multiplied by the maximum y-axis adjustment range (Max Δy). According to some embodiments, the value of the product of $M_{WA}$ x (Max Δy) is between about 0 g·mm and about 1800 g·mm. In specific embodiments, the value of the product of $M_{WA}$ x (Max Δy) is between about 0 g·mm and about 1500 g·mm, or between about 0 g·mm and about 1000 g·mm, or between about 0 g·mm and about 500 g·mm, or between about 0 g·mm and about 250 g·mm, or between about 0 g·mm and about 150 g·mm, or between about 0 g·mm and about 100 g·mm, or between about 0 g·mm and about 50 g·mm, or between about 0 g·mm and about 25 g·mm.

As noted above, one advantage obtained with a golf club head having a slidably repositionable weight assembly, such as the golf club head 12000 having the weight assembly 12040, is in providing the end user of the golf club with the capability to adjust the location of the CG of the club head over a range of locations relating to the position of the repositionable weight. In particular, the present inventors have found that there is a distance advantage to providing a center of gravity of the club head that is lower and more forward relative to comparable golf clubs that do not include a weight assembly such as the weight assembly 12040 described herein.

In some embodiments, the golf club head 12000 has a CG with a head origin x-axis coordinate (CGx) between about −10 mm and about 10 mm, such as between about −4 mm and about 9 mm, such as between about −3 mm and about 8 mm, such as between about −2 mm to about 5 mm, such as between about −0.8 mm to about 8 mm, such as between about 0 mm to about 8 mm. In some embodiments, the golf club head 12000 has a CG with a head origin y-axis coordinate (CGy) greater than about 15 mm and less than about 50 mm, such as between about 22 mm and about 43 mm, such as between about 24 mm and about 40 mm, such as between about 26 mm and about 35 mm. In some embodiments, the golf club head 12000 has a CG with a head origin z-axis coordinate (CGz) greater than about −8 mm and less than about 3 mm, such as between about −6 mm and about 0 mm. In some embodiments, the golf club head 12000 has a CG with a head origin z-axis coordinate (CGz) that is less than 0 mm, such as less than −2 mm, such as less than −4 mm, such as less than −5 mm, such as less than −6 mm.

As described herein, by repositioning the slidable weight assembly 12040 within the channel 12020 of the golf club head 12000, the location of the CG of the club head is adjusted. For example, in some embodiments of a golf club head 12000 having a weight assembly 12040 that is adjustably positioned within a channel 12020, the club head is provided with a maximum CGx adjustment range (Max ΔCGx) attributable to the repositioning of the weight assembly 12040 that is greater than 2 mm, such as greater than about 3 mm, such as greater than about 4 mm, such as greater than about 5 mm, such as greater than about 6 mm, such as greater than about 8 mm, such as greater than 10 mm.

Moreover, in some embodiments of the golf club head 12000 having a weight assembly 12040 that is adjustably positioned within a forward channel 12020, the club head is provided with a CGy adjustment range (Max ΔCGy) that is less than 6 mm, such as less than 3 mm, such as less than 1 mm, such as less than 0.5 mm, such as less than 0.25 mm, such as less than 0.1 mm. However, in some cases where a rear weight port is provided and/or a rearward weight track the club head may be provided with a CGy adjustment range (Max ΔCGy) that is greater than 2 mm, such as greater than about 3 mm, such as greater than about 4 mm, such as greater than about 5 mm, such as greater than about 6 mm, such as greater than about 8 mm, such as greater than 10 mm, such as greater than 12 mm.

In some embodiments, a golf club head can be configured to have a constraint relating to the relative amounts that the CG is able to be adjusted in the origin x-direction and origin y-direction. Such a constraint can be defined as the maximum CGy adjustment range (Max ΔCGy) divided by the maximum CGx adjustment range (Max ΔCGx). According to some embodiments, the value of the ratio of (Max ΔCGy)/(Max ΔCGx) is between 0 and about 0.8. In specific embodiments, the value of the ratio of (Max ΔCGy)/(Max ΔCGx) is between 0 and about 0.5, or between 0 and about 0.2, or between 0 and about 0.15, or between 0 and about 0.10, or between 0 and about 0.08, or between 0 and about 0.05, or between 0 and about 0.03, or between 0 and about 0.01.

In some embodiments, a golf club head can be configured such that only one of the above constraints apply. In other embodiments, a golf club head can be configured such that more than one of the above constraints apply. In still other embodiments, a golf club head can be configured such that all of the above constraints apply.

Table 15 below lists various properties of golf club heads 9300, 12000, and 13000 having a weight assembly retained within a channel.

TABLE 15

| | Golf Club Head | | | | |
|---|---|---|---|---|---|
| | 9300 | 12000 | 12000 with Winglets | 12000C-F | 13000 |
| Slidable weight assembly (g) | 20 | 25 | 25 | 20 g Sliding Wt., 15 g Wt. or Sliding Wt. | 25 |
| volume (cc) | 427 | 446 | 466 | 460 | 150 |
| deltal (mm) | 14 | 9.4 | 8.1 | 10.8-15.1 | 8 |
| max CGx (mm) | 5.8 | 6.6 | 5.8 | 6.7 | 6.9 |
| min CGx (mm) | 0.5 | −0.7 | −0.7 | 0.4 | 0.6 |
| max CGz (mm) | −1.1 | −2.3 | −3.6 | −4.3 | −3.1 |
| min CGz (mm) | −2.2 | −3.5 | −4 | −5.2 | −3.7 |
| max CGy (mm) | 28.9 | 26.6 | 25.5 | 32.3 | 17 |
| min CGy (mm) | 27.3 | 26.4 | 25.3 | 28 | 13.3 |
| distance of weight assembly to striking face (mm) | 29.4 | 15.7 | 15.7 | 15.7 | 15 |
| Z-Up (mm) | 29.9 | 26.8 | 27.3 | 26.8 | 15.3 |
| Ixx (kg · mm$^2$) | 216 | 222 | 229 | 230-300 | 111 |
| Iyy (kg · mm$^2$) | 277 | 274 | 291 | 265-290 | 198 |
| Izz (kg · mm$^2$) | 358 | 350 | 366 | 360-440 | 245 |
| channel ledge radius (mm) | 61 | 60.7 | 112 | 112 | 95 |
| bottom of channel to bottom of ledge (mm) | 5 | 4 | 4.5 | 4.5 | 5 |
| channel length (mm) | 74.5 | 73 | 70 | 72 | 78.8 |
| channel width (mm) | 16 | 16 | 16 | 16 | 16 |
| channel depth (mm) | 10.5 | 11 | 10.5 | 10.5 | 10 |

Figure 40:
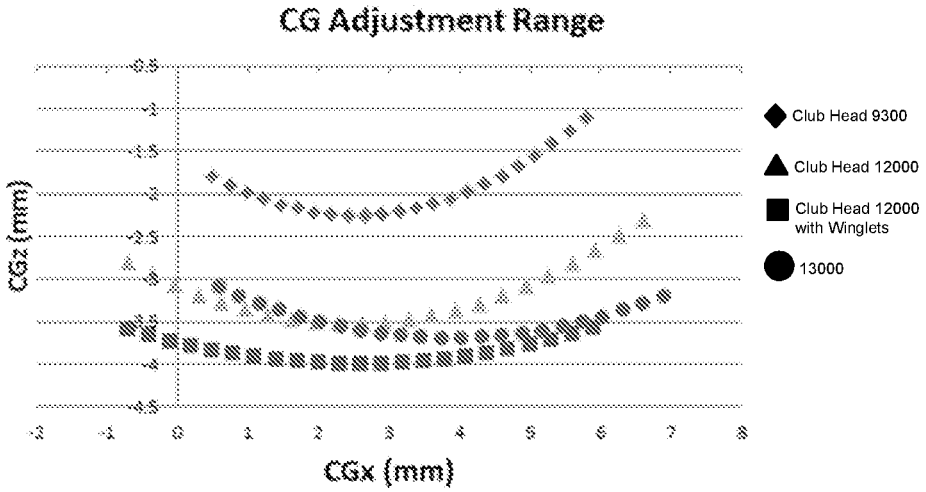
FIG. 40 is a graph showing different CGz and CGx values of different embodiments of golf club heads as the location of a slidable weight assembly is changed.

In addition, FIG. 40 illustrates the x-axis and z-axis movement of the CG as the weight assembly is adjusted through various positions within the channel of club heads 9300, 12000, 12000 with winglets, and 13000 (fairway).

As shown, for club head 9300 the range of adjustment for CGx is from 5.8 mm near the heel to 0.5 mm near the toe, providing a Max ΔCGx of 5.3 mm. In addition, the range of adjustment for CGz is from −1.1 mm near the heel to −2.2 mm near the toe, providing a Max ΔCGz of 1.1 mm. Furthermore, the range of adjustment for CGy is from 27.3 mm to 28.9 mm, providing a Max ΔCGy of 1.6 mm.

As shown, for club head 12000 the range of adjustment for CGx is from 6.6 mm near the heel to −0.7 mm near the toe, providing a Max ΔCGx of 7.3 mm. In addition, the range of adjustment for CGz is from −2.3 mm near the heel to −3.5 mm near the toe, providing a Max ΔCGz of 1.2 mm. Furthermore, the range of adjustment for CGy is from 26.4 mm to 26.6 mm, providing a Max ΔCGy of 0.2 mm.

As shown, for club head 12000 with winglets the range of adjustment for CGx is from 5.8 mm near the heel to −0.7 mm near the toe, providing a Max ΔCGx of 6.5 mm. In addition, the range of adjustment for CGz is from −3.6 mm near the heel to −4.0 mm near the toe, providing a Max ΔCGz of 0.4 mm. Furthermore, the range of adjustment for CGy is from 25.3 mm to 25.5 mm, providing a Max ΔCGy of 0.2 mm. If a lighter weight is used and/or the channel is shorter the Max ΔCGx could be approximately 5 mm, 4 mm, or 3 mm. If the Max ΔCGx is less than 3 mm, then there is not a substantial performance difference between the extreme positions of the channel. Similarly, if the a heavier weight is used and/or the channel has a smaller radius of curvature, the Max ΔCGz could be approximately 2 mm, 1.5 mm, 1 mm or 0.5 mm.

As shown, for club heads 12000C-F the range of adjustment for CGx is from 6.9 mm near the heel to 0.6 mm near the toe, providing a Max ΔCGx of 6.3 mm. In addition, the range of adjustment for CGz is from −3.1 mm near the heel to −3.7 mm near the toe, providing a Max ΔCGz of 0.6 mm. Furthermore, the range of adjustment for CGy is from 32.3 mm to 28 mm, providing a Max ΔCGy of 4.3 mm. If a lighter weight is used or if the weight ports are closer together, then the Max ΔCGy could be 3 mm, or 2 mm. If a heavier weight is used or the weight ports are further apart, then the Max ΔCGy could be 5 mm or 6 mm.

Notably, comparing the Ixx and Izz values for 12000 with winglets to 12000 with an additional movable weight shows a significant improvement. Ixx improved from 229 kg·mm$^2$ to 300 kg·mm$^2$ and Izz improved from 366 kg·mm$^2$ to 440 kg·mm$^2$.

As shown, for club head 13000 the range of adjustment for CGx is from 6.9 mm near the heel to 0.6 mm near the toe, providing a Max ΔCGx of 6.3 mm. In addition, the range of adjustment for CGz is from −3.1 mm near the heel to −3.7 mm near the toe, providing a Max ΔCGz of 0.6 mm. Furthermore, the range of adjustment for CGy is from 13.3 mm to 13.3 mm, providing a Max ΔCGy of 0.0 mm.

Unexpectedly the location of the weight bearing channel in the front portion of the club head can lead to unexpected synergies in golf club performance. First, because $\Delta_1$ (delta 1) is relatively small, dynamic lofting is reduced; thereby reducing spin that otherwise may reduce distance. Additionally, because the projection of the CG is below the center-face, the gear effect biases the golf ball to rotate toward the projection of the CG—or, in other words, with forward spin. This is countered by the loft of the golf club head imparting back spin. The overall effect is a relatively low spin profile. However, because the CG is below the center face (and, thereby, below the ideal impact location) as measured along the z-axis, the golf ball will tend to rise higher on impact. The result is a high launching but lower spinning golf shot on purely struck shots, which leads to better ball flight (higher and softer landing) with more distance due to less energy loss from spin.

Figure 58:
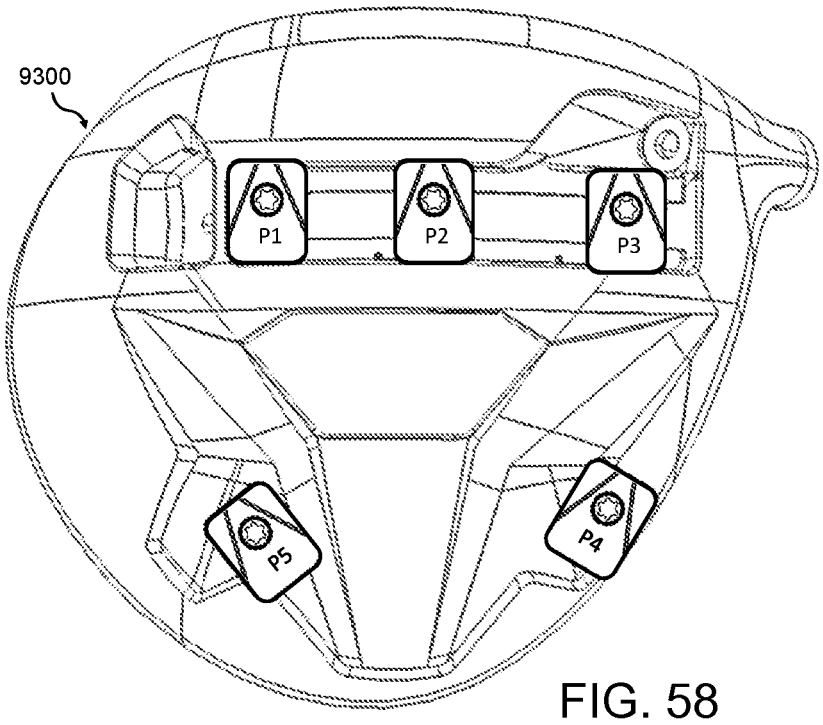
FIG. 58 is a bottom view of a golf club head according to an embodiment showing multiple weight positions P1-P5.

Table 16 below lists various measurements taken during a robot testing of golf club head 9300. In the robot test, a 30 g weight was positioned at five different positions along the sole of the golf club head and then used to hit a multitude of shots at center face. FIG. 58 shows golf club head 9300 with a 30 g weight positioned at five positions P1-P5.

TABLE 16

| | Position 1 | Position 2 | Position 3 | Position 4 | Position 5 |
|---|---|---|---|---|---|
| 30 g Weight Position | Toe-Front | Center-Front | Heel-Front | Back Heel | Back Toe |
| Backspin (rpm) | 2562.6 | 2632.5 | 3002.7 | 3378.8 | 3172.1 |
| Launch Angle (deg) | 11.6 | 11.5 | 11 | 11.2 | 11.8 |
| Ball Speed (mph) | 162.5 | 161.4 | 161.2 | 156.9 | 157.7 |
| Predicted carry (yards) | 278.7 | 275.4 | 265.5 | 253.1 | 259.6 |
| Z–Up | 27.5 | 25.9 | 29.2 | 28.8 | 27.4 |
| CGx (mm) | −2.5 | 4.46 | 6.3 | 5.9 | −3.4 |
| CGy (mm) | 27.4 | 27.7 | 28.1 | 36.4 | 36 |
| CGz (mm) | −2.6 | −3.5 | −1 | −1.4 | −2.8 |
| deltal (mm) | −12.1 | −12 | −12.8 | −21.1 | −20.7 |
| Ixx (kg · mm$^2$) | 224.1 | 231 | 213.6 | 292.4 | 311.5 |
| Izz (kg · mm$^2$) | 373.2 | 371 | 378 | 466.2 | 456.2 |
| CG Projected on Face | 2.4 | 1.6 | 4.1 | 5.3 | 3.8 |

As can be seen in Table 16, movement of the 30 g weight from front to back resulted in a delta 1 increase of 9 mm and an rpm increase of over 800 rpms. This resulted in a reduction in ball speed by about 5 mph and a loss in predicted carry distance of about 20 yards. Additionally, the longest predicted carry shots occurred when the 30 g weight was in the forward position. Notably, CGx moved about 9 mm from the heel to toe positions, and over that range CGz changed less than about 2.5 mm.

Importantly, Izz and Ixx each increased by about 100 kg·mm$^2$ by moving the weight from the front to the back of the club. However, despite this being a more "forgiving" position the predicted carry distances were the shortest likely due to increased spin and reduced ball speed.

As shown in Table 16, for club head 9300 with a 30 g weight the range of adjustment for CGx is from 6.3 mm near the heel to −2.5 mm near the toe, providing a Max ΔCGx of 8.8 mm. In addition, the range of adjustment for CGz is from −1 mm near the heel to −3.5 mm near the center, providing a Max ΔCGz of 2.5 mm. Furthermore, the range of adjustment for CGy is from 27.4 mm to 36.4 mm, providing a Max ΔCGy of 9 mm. If a lighter weight is used and/or the channel is shorter the Max ΔCGx could be approximately 5 mm, 4 mm, or 3 mm. If the Max ΔCGx is less than 3 mm, then there is not a substantial performance difference between the extreme positions of the channel. Similarly, if a heavier weight is used and/or the channel has a smaller radius of curvature, the Max ΔCGz could be approximately 4 mm, 3 mm, 2 mm, 1.5 mm, 1 mm or 0.5 mm.

Figure 59:
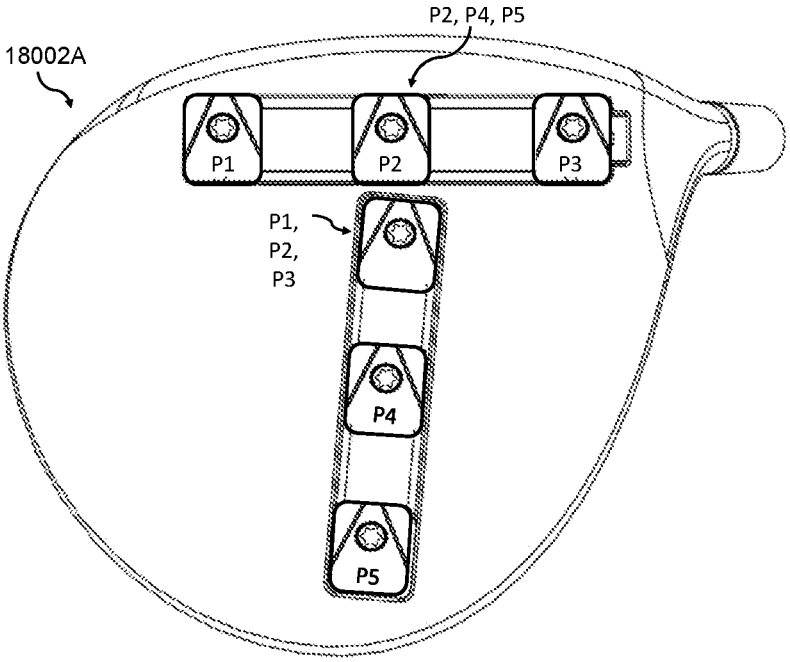
FIG. 59 is a bottom view of a golf club head according to an embodiment showing multiple weight positions P1-P5.

Table 17 below lists various parameters for golf club head 18000 using a 15 g weight in the front track and a 15 g weight in the rear track. FIG. 59 shows golf club head 18000 with the 15 g weights positioned at five positions P1-P5.

TABLE 17

| | Position 1 | Position 2 | Position 3 | Position 4 | Position 5 |
|---|---|---|---|---|---|
| 15 g-15 g Weight Position | Toe-Front | Center-Front | Heel-Front | Center-Middle | Center-Back |
| Z UP (mm): | 25.3 | 24.9 | 25.6 | 25 | 25.3 |
| CGX (mm): | 1.35 | 3.59 | 5.74 | 3.59 | 3.59 |
| CGy (mm) | 28.4 | 28.5 | 28.6 | 30.6 | 32.8 |

TABLE 17-continued

| | Position 1 | Position 2 | Position 3 | Position 4 | Position 5 |
|---|---|---|---|---|---|
| CGZ (mm): | −4.13 | −4.53 | −3.81 | −4.4 | −4.11 |
| DELTA-1 (mm): | 12.8 | 12.8 | 12.8 | 14.9 | 17.1 |
| Ixx (kg-mm2): | 232 | 235 | 231 | 251 | 289 |
| Izz (kg-mm2): | 368 | 357 | 370 | 373 | 413 |
| CG Projected on Face | 1.7 | 1.3 | 2.0 | 1.9 | 2.6 |

As can be seen in Table 17, movement of the 15 g weight from positions 1-3 (front) to position 5 (back) resulted in a delta 1 increase of about 4.3 mm, which would be a predicted rpm increase of about 350 rpms due to the combination of dynamic lofting and change in CGz. Notably, CGx moved about 4.4 mm from the position 1 (toe) to position 3 (heel), and over that range CGz changes less than about 0.7 mm.

Importantly, Izz and Ixx each increase by about 60 kg·mm$^2$ by moving the 15 g weight in the rearward track from positions 1-3 (front) to position 5 (back). In positions 4 and 5, the club would be considered more "forgiving." However, this club is slightly less "forgiving" compared to club 9300 with the weight in positions 4 and 5. Forgiving, however, does not result in distance as proved out by the data captured in Table 16 from the robot test of club 9300. Accordingly, it is expected that this club would perform better at positions 4 and 5 compared to club 9300 due to the lower CG projection on the face (5.3 vs 2.6) and smaller delta 1 value (21.1 vs 17.1).

As shown in Table 17, for club head 18000 with two 15 g weights the range of adjustment for CGx is from 5.74 mm near the heel to 1.35 mm near the toe, providing a Max ΔCGx of about 4.4 mm. In addition, the range of adjustment for CGz is from −3.81 mm near the heel to −4.53 mm near the center, providing a Max ΔCGz of about 0.7 mm. Furthermore, the range of adjustment for CGy is from 28.4 mm to 32.8 mm, providing a Max ΔCGy of about 4.4 mm. If a lighter weight is used and/or the channel is shorter the Max ΔCGx could be approximately 5 mm, 4 mm, or 3 mm. If the Max ΔCGx is less than 3 mm, then there is not a substantial performance difference between the extreme positions of the channel. Similarly, if a heavier weight is used and/or the channel has a smaller radius of curvature, the Max ΔCGz could be approximately 3 mm, 2 mm, 1.5 mm, 1 mm or 0.5 mm.

Additional Details

The following are additional details about structure that may be or are already incorporated into the embodiments discussed above. In some instances, the following discussion provides more in depth discussion. It should be understood that the features described below are compatible with the embodiments discussed above. For example, each of the embodiments discussed above may or may not include an adjustable lie/loft connection assembly as discussed below. Additionally, each of the embodiments discussed above may or may not include a composite face insert as discussed below.

Adjustable Lie/Loft Connection Assembly

As used herein, a shaft that is "removably attached" to a club head means that the shaft can be connected to the club head using one or more mechanical fasteners, such as a screw or threaded ferrule, without an adhesive, and the shaft can be disconnected and separated from the head by loosening or removing the one or more mechanical fasteners without the need to break an adhesive bond between two components.

FIG. 1A shows an embodiment of a golf club assembly that has a removable shaft that can be supported at various positions relative to the head to vary the shaft loft and/or the lie angle of the club. The assembly comprises a club head 3000 having a hosel 3002 defining a hosel opening 3004. The hosel opening 3004 is dimensioned to receive a shaft sleeve 3006, which in turn is secured to the lower end portion of a shaft 3008. The shaft sleeve 3006 can be adhesively bonded, welded or secured in equivalent fashion to the lower end portion of the shaft 3008. In other embodiments, the shaft sleeve 3006 can be integrally formed with the shaft 3008. As shown, a ferrule 3010 can be disposed on the shaft just above the shaft sleeve 3006 to provide a transition piece between the shaft sleeve and the outer surface of the shaft 3008.

The hosel opening 3004 is also adapted to receive a hosel insert 200, which can be positioned on an annular shoulder 3012 inside the club head. The hosel insert 200 can be secured in place by welding, an adhesive, or other suitable techniques. Alternatively, the insert can be integrally formed in the hosel opening. The club head 3000 further includes an opening 3014 in the bottom or sole of the club head that is sized to receive a screw 400. The screw 400 is inserted into the opening 3014, through the opening in shoulder 3012, and is tightened into the shaft sleeve 3006 to secure the shaft to the club head. Additionally, the shaft sleeve 3006 is configured to support the shaft at different positions relative to the club head to achieve a desired shaft loft and/or lie angle.

Figure 1B:
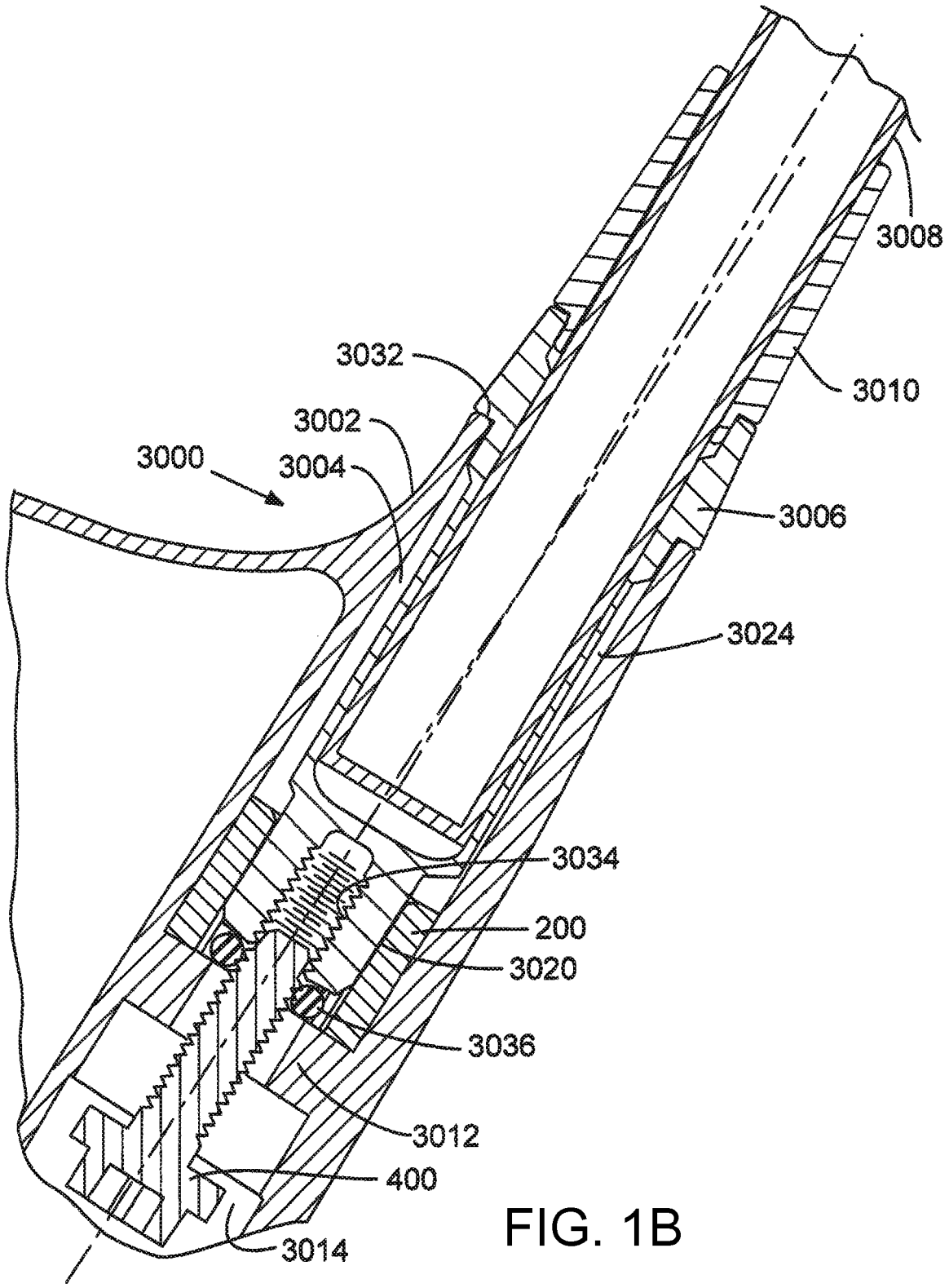
FIG. 1B shows the golf club head of FIG. 1A with the screw loosened to permit removal of the shaft from the club head.

If desired, a screw capturing device, such as in the form of an o-ring or washer 3036, can be placed on the shaft of the screw 400 above shoulder 3012 to retain the screw in place within the club head when the screw is loosened to permit removal of the shaft from the club head. The ring 3036 desirably is dimensioned to frictionally engage the threads of the screw and has an outer diameter that is greater than the central opening in shoulder 3012 so that the ring 3036 cannot fall through the opening. When the screw 400 is tightened to secure the shaft to the club head, as depicted in FIG. 1A, the ring 3036 desirably is not compressed between the shoulder 3012 and the adjacent lower surface of the shaft sleeve 3006. FIG. 1B shows the screw 400 removed from the shaft sleeve 3006 to permit removal of the shaft from the club head. As shown, in the disassembled state, the ring 3036 captures the distal end of the screw to retain the screw within the club head to prevent loss of the screw. The ring 3036 desirably comprises a polymeric or elastomeric material, such as rubber, Viton, Neoprene, silicone, or similar materials. The ring 3036 can be an o-ring having a circular cross-sectional shape as depicted in the illustrated embodiment. Alternatively, the ring 3036 can be a flat washer having a square or rectangular cross-sectional shape. In other embodiments, the ring 3036 can various other cross-sectional profiles.

Figure 2:
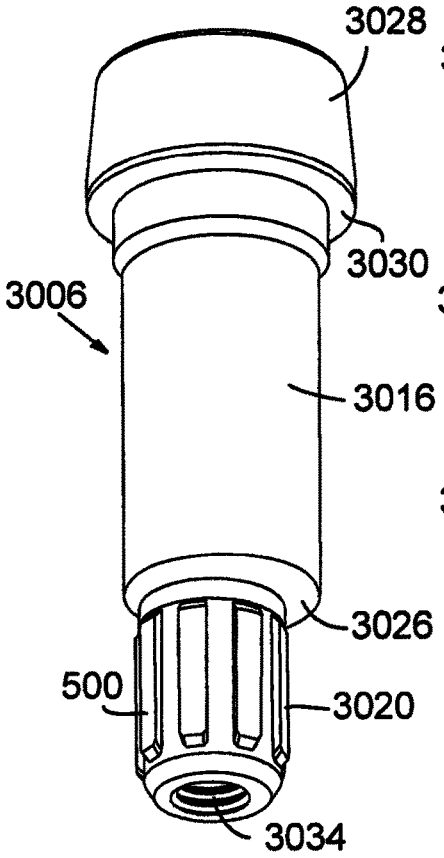
FIG. 2 is a perspective view of the shaft sleeve of the assembly shown in FIG. 43.
Figure 3:
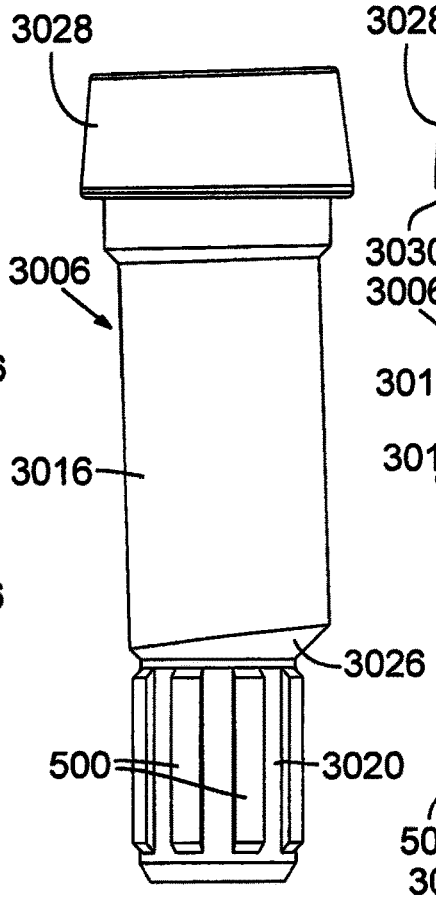
FIG. 3 is a side elevation view of the shaft sleeve of FIG. 2.
Figure 4:
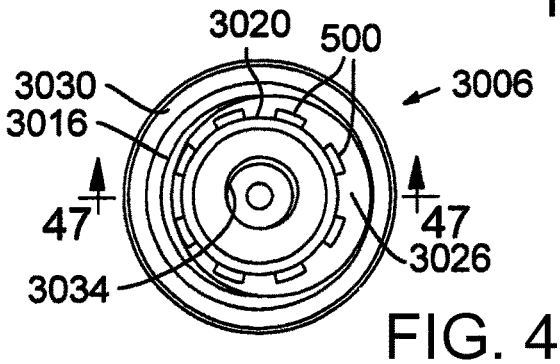
FIG. 4 is a bottom plan view of the shaft sleeve of FIG. 2.

The shaft sleeve 3006 is shown in greater detail in FIGS. 2-4. The shaft sleeve 3006 in the illustrated embodiment comprises an upper portion 3016 having an upper opening 3018 for receiving and a lower portion 3020 located below the lower end of the shaft. The lower portion 3020 can have a threaded opening 3034 for receiving the threaded shaft of the screw 400. The lower portion 3020 of the sleeve can comprise a rotation prevention portion configured to mate with a rotation prevention portion of the hosel insert 200 to restrict relative rotation between the shaft and the club head. As shown, the rotation prevention portion can comprise a plurality of longitudinally extending external splines 500 that are adapted to mate with corresponding internal splines 240 of the hosel insert 200.

The upper portion 3016 of the sleeve extends at an offset angle 3022 relative to the lower portion 3020. As shown in FIG. 1A, when inserted in the club head, the lower portion 3020 is co-axially aligned with the hosel insert 200 and the hosel opening 3004, which collectively define a longitudinal axis B. The upper portion 3016 of the shaft sleeve 3006 defines a longitudinal axis A and is effective to support the shaft 3008 along axis A, which is offset from longitudinal axis B by offset angle 3022. Inserting the shaft sleeve at different angular positions relative to the hosel insert is effective to adjust the shaft loft and/or the lie angle, as further described below.

Figure 5:
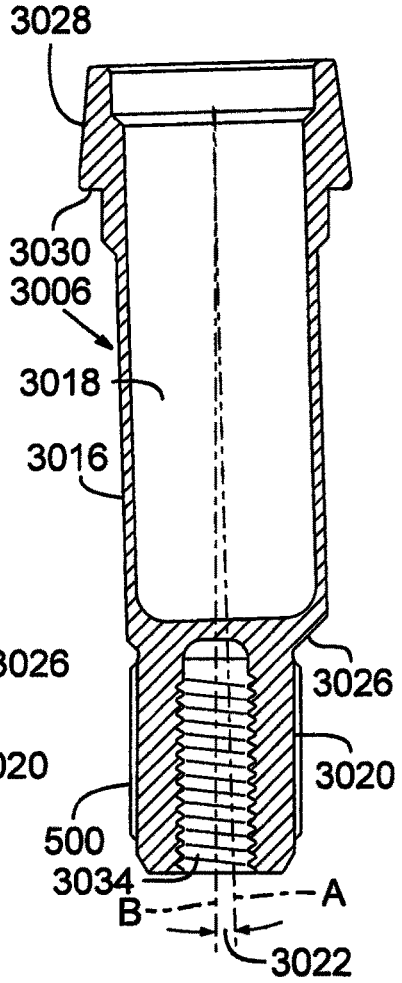
FIG. 5 is a cross-sectional view of the shaft sleeve taken along line 47-47 of FIG. 4.
Figure 43A:
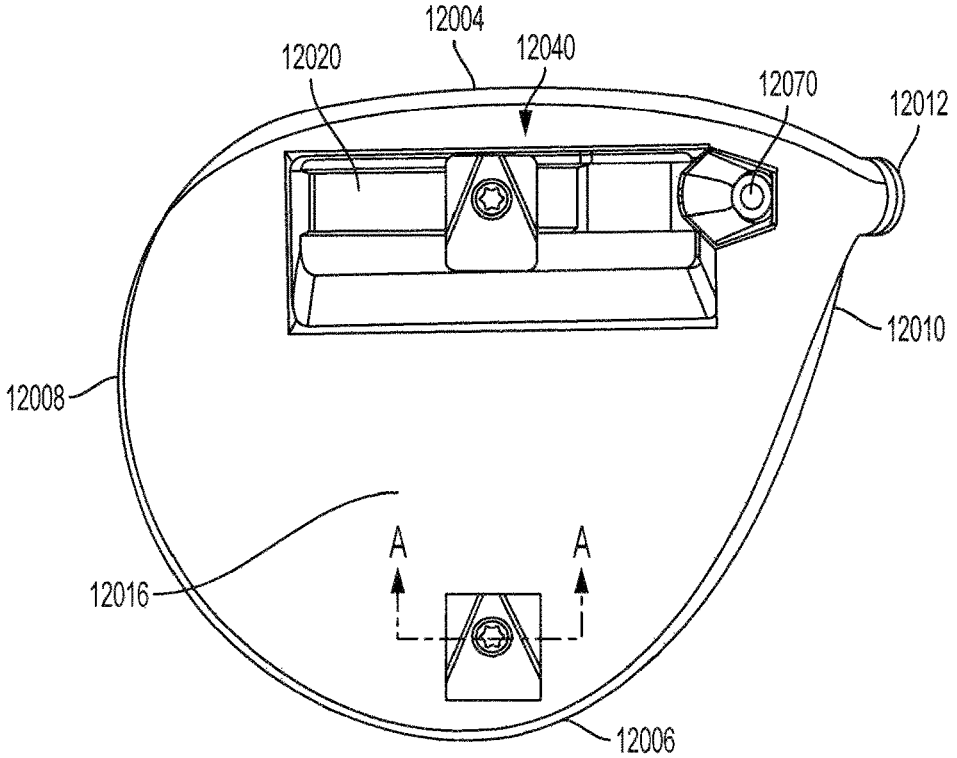
FIG. 43A is a bottom view of a golf club head, according to yet another embodiment.
Figure 43B:
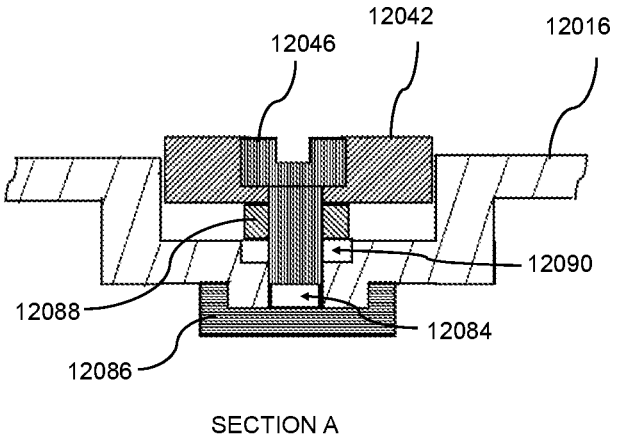
FIG. 43B is a cross-sectional view along line A-A of the golf club head of FIG. 43A.

As best shown in FIG. 5, the upper portion 3016 of the shaft sleeve desirably has a constant wall thickness from the lower end of opening 3018 to the upper end of the shaft sleeve. A tapered surface portion 3026 extends between the upper portion 3016 and the lower portion 3020. The upper portion 3016 of the shaft sleeve has an enlarged head portion 3028 that defines an annular bearing surface 3030 that contacts an upper surface 3032 of the hosel 3002 (FIG. 43). The bearing surface 3030 desirably is oriented at a 90-degree angle with respect to longitudinal axis B so that when the shaft sleeve is inserted in to the hosel, the bearing surface 3030 can make complete contact with the opposing surface 3032 of the hosel through 360 degrees.

As further shown in FIG. 1A, the hosel opening 3004 desirably is dimensioned to form a gap 3024 between the outer surface of the upper portion 3016 of the sleeve and the opposing internal surface of the club head. Because the upper portion 3016 is not co-axially aligned with the surrounding inner surface of the hosel opening, the gap 3024 desirably is large enough to permit the shaft sleeve to be inserted into the hosel opening with the lower portion extending into the hosel insert at each possible angular position relative to longitudinal axis B. For example, in the illustrated embodiment, the shaft sleeve has eight external splines 500 that are received between eight internal splines 240 of the hosel insert 200.

Figure 6:
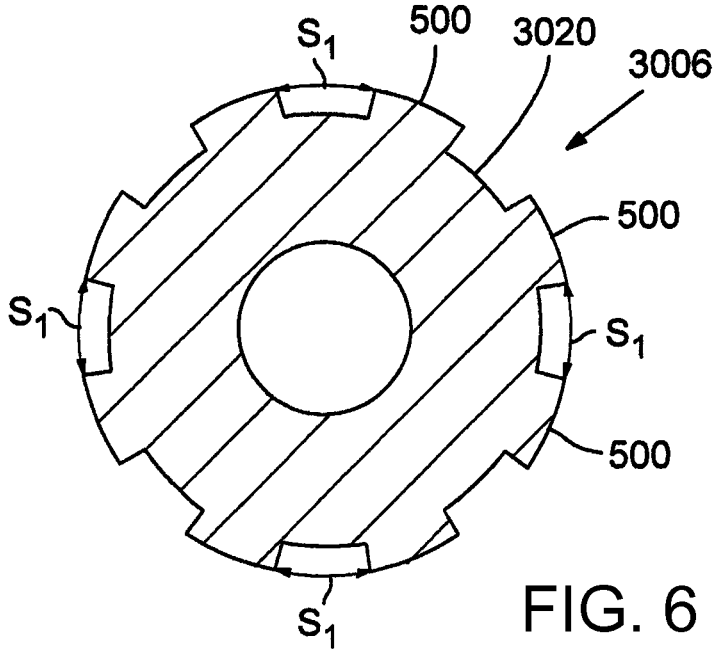
FIG. 6 is a cross-sectional view of another embodiment of a shaft sleeve and FIG. 7 is a top plan view of a hosel insert that is adapted to receive the shaft sleeve.
Figure 7:
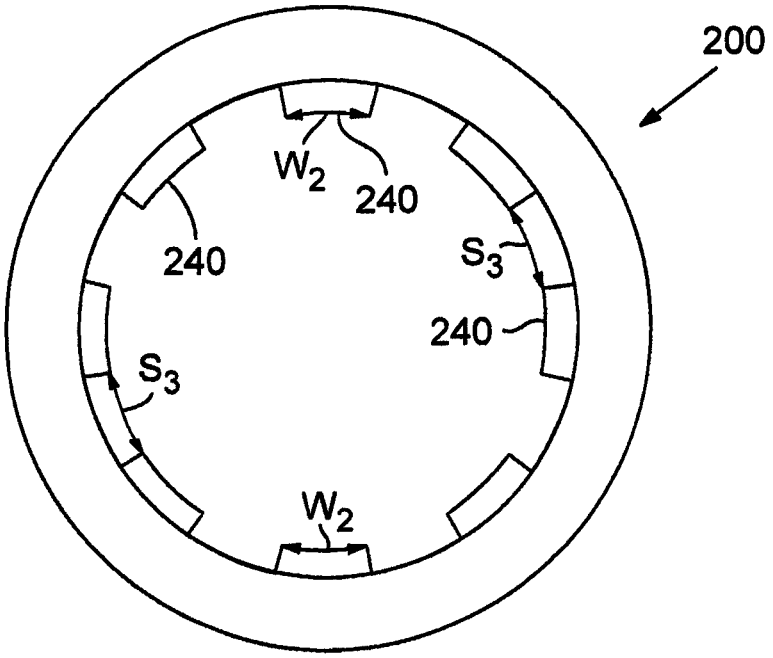

Other shaft sleeve and hosel insert configurations can be used to vary the number of possible angular positions for the shaft sleeve relative to the longitudinal axis B. FIGS. 6 and 7, for example, show an alternative shaft sleeve and hosel insert configuration in which the shaft sleeve 3006 has eight equally spaced splines 500 with radial sidewalls 502 that are received between eight equally spaced splines 240 of the hosel insert 200. Each spline 500 is spaced from an adjacent spline by spacing $S_1$ dimensioned to receive a spline 240 of the hosel insert having a width $W_2$. This allows the lower portion 3020 of the shaft sleeve to be inserted into the hosel insert 200 at eight angularly spaced positions around longitudinal axis B. In a specific embodiment, the spacing $S_1$ is about 23 degrees, the arc angle of each spline 500 is about 22 degrees, and the width $W_2$ is about 22.5 degrees.

Figure 8:
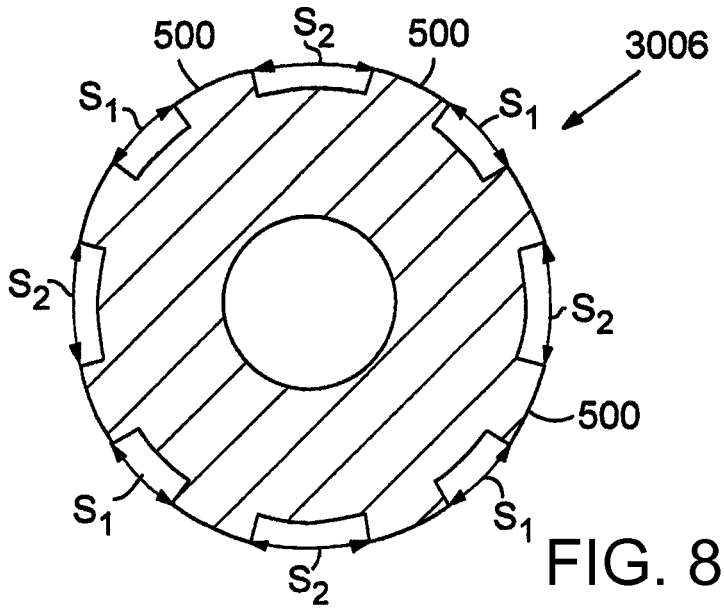
FIG. 8 is a cross-sectional view of another embodiment of a shaft sleeve and FIG. 9 is a top plan view of a hosel insert that is adapted to receive the shaft sleeve.
Figure 9:
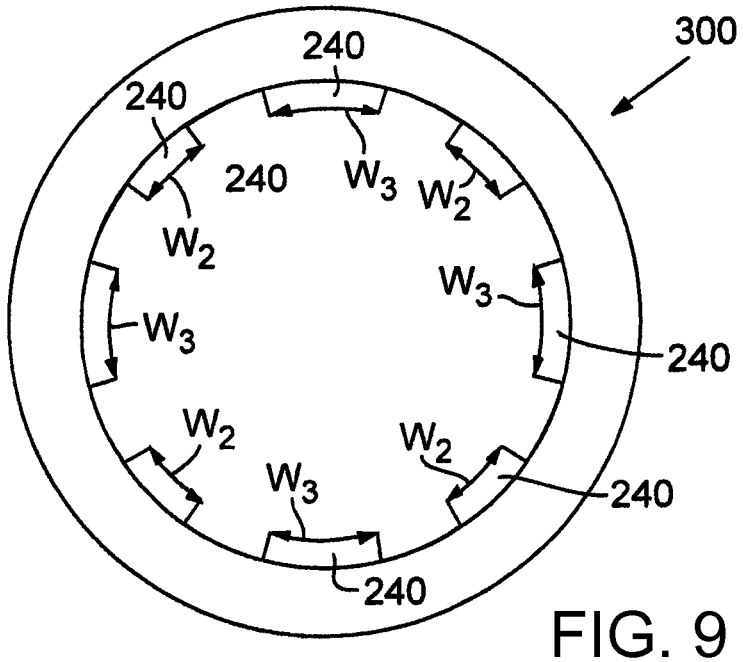

FIGS. 50 and 51 show another embodiment of a shaft sleeve and hosel insert configuration. In the embodiment of FIGS. 8 and 9, the shaft sleeve 3006 (FIG. 8) has eight splines 500 that are alternately spaced by spline-to-spline spacing $S_1$ and $S_2$, where $S_2$ is greater than $S_1$. Each spline has radial sidewalls 502 providing the same advantages previously described with respect to radial sidewalls. Similarly, the hosel insert 200 (FIG. 9) has eight splines 240 having alternating widths $W_2$ and $W_3$ that are slightly less than spline spacing $S_1$ and $S_2$, respectively, to allow each spline 240 of width $W_2$ to be received within spacing $S_1$ of the shaft sleeve and each spline 240 of width $W_3$ to be received within spacing $S_2$ of the shaft sleeve. This allows the lower portion 3020 of the shaft sleeve to be inserted into the hosel insert 200 at four angularly spaced positions around longitudinal axis B. In a particular embodiment, the spacing $S_1$ is about 19.5 degrees, the spacing $S_2$ is about 29.5 degrees, the arc angle of each spline 500 is about 20.5 degrees, the width $W_2$ is about 19 degrees, and the width $W_3$ is about 29 degrees. In addition, using a greater or fewer number of splines on the shaft sleeve and mating splines on the hosel insert increases and decreases, respectively, the number of possible positions for shaft sleeve.

As can be appreciated, the assembly shown in FIGS. 1A-9 permits a shaft to be supported at different orientations relative to the club head to vary the shaft loft and/or lie angle. An advantage of the assembly of FIGS. 1A-9 is that it includes fewer pieces, and therefore is less expensive to manufacture and has less mass (which allows for a reduction in overall weight).

Other shaft sleeve and hosel insert configurations can be used to vary the number of possible angular positions for the shaft sleeve relative to the longitudinal axis B. FIGS. 48 and 49, for example, show an alternative shaft sleeve and hosel insert configuration in which the shaft sleeve 3006 has eight equally spaced splines 500 with radial sidewalls 502 that are received between eight equally spaced splines 240 of the hosel insert 200. Each spline 500 is spaced from an adjacent spline by spacing $S_1$ dimensioned to receive a spline 240 of the hosel insert having a width $W_2$. This allows the lower portion 3020 of the shaft sleeve to be inserted into the hosel insert 200 at eight angularly spaced positions around longitudinal axis B. In a specific embodiment, the spacing $S_1$ is about 23 degrees, the arc angle of each spline 500 is about 22 degrees, and the width $W_2$ is about 22.5 degrees.

FIGS. 50 and 51 show another embodiment of a shaft sleeve and hosel insert configuration. In the embodiment of FIGS. 50 and 51, the shaft sleeve 3006 (FIG. 8) has eight splines 500 that are alternately spaced by spline-to-spline spacing $S_1$ and $S_2$, where $S_2$ is greater than $S_1$. Each spline has radial sidewalls 502 providing the same advantages previously described with respect to radial sidewalls. Similarly, the hosel insert 200 (FIG. 9) has eight splines 240 having alternating widths $W_2$ and $W_3$ that are slightly less than spline spacing $S_1$ and $S_2$, respectively, to allow each spline 240 of width $W_2$ to be received within spacing $S_1$ of the shaft sleeve and each spline 240 of width $W_3$ to be received within spacing $S_2$ of the shaft sleeve. This allows the lower portion 3020 of the shaft sleeve to be inserted into the hosel insert 200 at four angularly spaced positions around longitudinal axis B. In a particular embodiment, the spacing $S_1$ is about 19.5 degrees, the spacing $S_2$ is about 29.5 degrees, the arc angle of each spline 500 is about 20.5 degrees, the width $W_2$ is about 19 degrees, and the width $W_3$ is about 29 degrees. In addition, using a greater or fewer number of splines on the shaft sleeve and mating splines on the hosel insert increases and decreases, respectively, the number of possible positions for shaft sleeve.

As can be appreciated, the assembly shown in FIGS. 43-51 is similar to the permits a shaft to be supported at different orientations relative to the club head to vary the shaft loft and/or lie angle. An advantage of the assembly of FIGS. 43-51 is that it includes fewer pieces, and therefore is less expensive to manufacture and has less mass (which allows for a reduction in overall weight).

Figure 10:
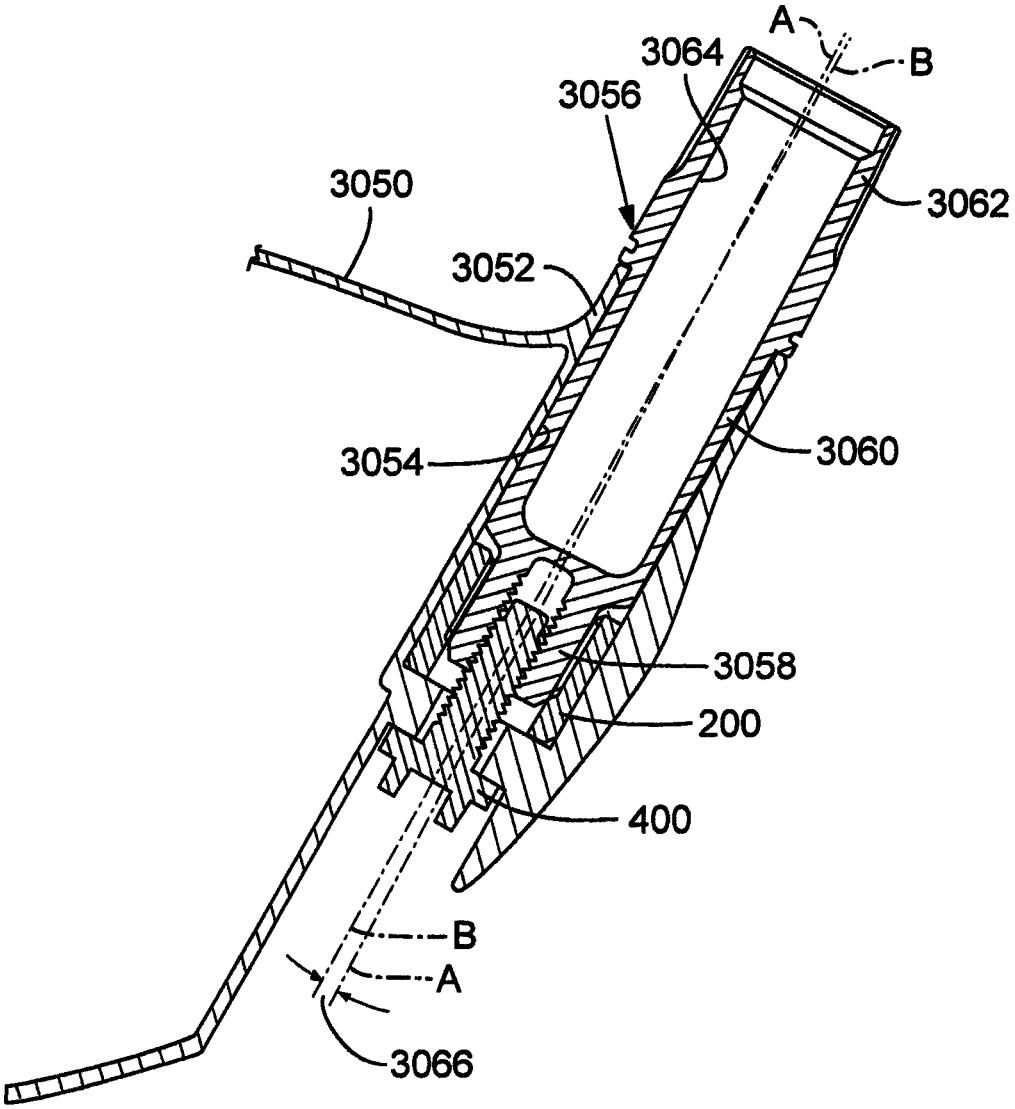
FIG. 10 is an enlarged cross-sectional view of a golf club head having a removable shaft, in accordance with another embodiment.

FIG. 10 shows another embodiment of a golf club assembly that is similar to the embodiment shown in FIG. 1A. The embodiment of FIG. 10 includes a club head 3050 having a hosel 3052 defining a hosel opening 3054, which in turn is adapted to receive a hosel insert 200. The hosel opening 3054 is also adapted to receive a shaft sleeve 3056 mounted on the lower end portion of a shaft (not shown in FIG. 10) as described herein.

The shaft sleeve 3056 has a lower portion 3058 including splines that mate with the splines of the hosel insert 200, an intermediate portion 3060 and an upper head portion 3062. The intermediate portion 3060 and the head portion 3062 define an internal bore 3064 for receiving the tip end portion of the shaft. In the illustrated embodiment, the intermediate portion 3060 of the shaft sleeve has a cylindrical external surface that is concentric with the inner cylindrical surface of the hosel opening 3054. In this manner, the lower and intermediate portions 3058, 3060 of the shaft sleeve and the hosel opening 3054 define a longitudinal axis B. The bore 3064 in the shaft sleeve defines a longitudinal axis A to support the shaft along axis A, which is offset from axis B by a predetermined angle 3066 determined by the bore 3064. As described herein, inserting the shaft sleeve 3056 at different angular positions relative to the hosel insert 200 is effective to adjust the shaft loft and/or the lie angle.

Figure 11:
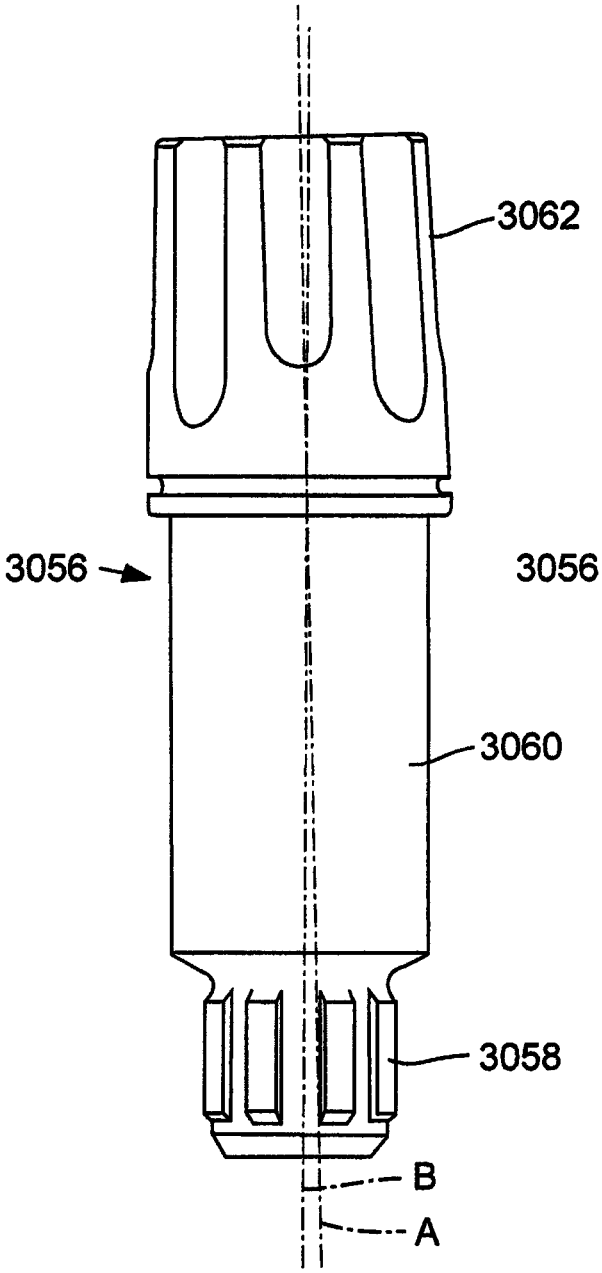
FIGS. 11 and 12 are front elevation and cross-sectional views, respectively, of the shaft sleeve of the assembly shown in FIG. 10.
Figure 12:
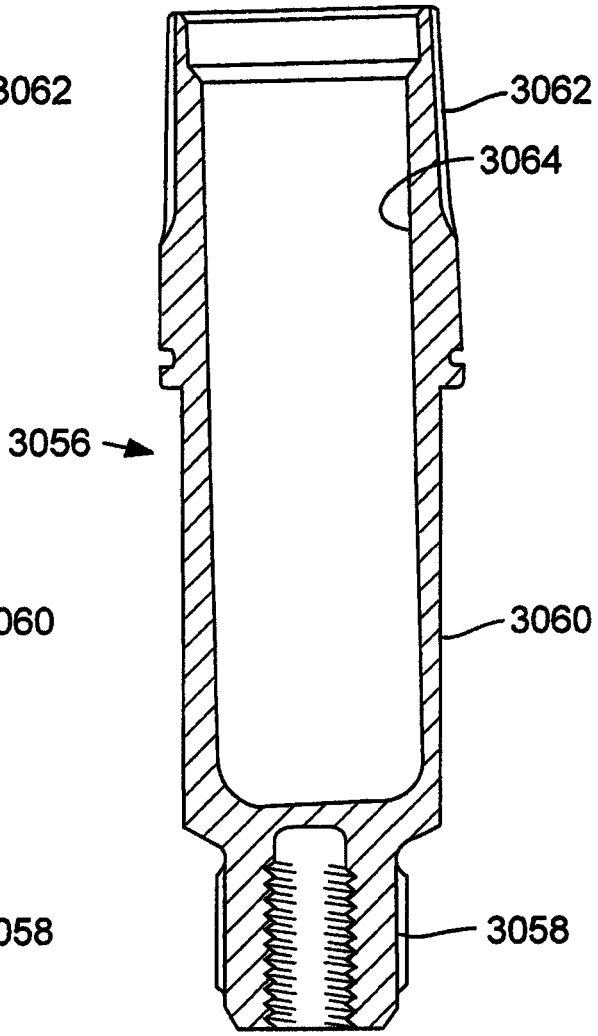

In this embodiment, because the intermediate portion 3060 is concentric with the hosel opening 3054, the outer surface of the intermediate portion 3060 can contact the adjacent surface of the hosel opening, as depicted in FIG. 10. This allows easier alignment of the mating features of the assembly during installation of the shaft and further improves the manufacturing process and efficiency. FIGS. 11 and 12 are enlarged views of the shaft sleeve 3056. As shown, the head portion 3062 of the shaft sleeve (which extends above the hosel 3052) can be angled relative to the intermediate portion 3060 by the angle 3066 so that the shaft and the head portion 3062 are both aligned along axis A. In alternative embodiments, the head portion 3062 can be aligned along axis B so that it is parallel to the intermediate portion 3060 and the lower portion 3058.

Materials

The components of the head-shaft connection assemblies disclosed in the present specification can be formed from any of various suitable metals, metal alloys, polymers, composites, or various combinations thereof.

In addition to those noted above, some examples of metals and metal alloys that can be used to form the components of the connection assemblies include, without limitation, carbon steels (e.g., 1020 or 8620 carbon steel), stainless steels (e.g., 304 or 410 stainless steel), PH (precipitation-hardenable) alloys (e.g., 17-4, C450, or C455 alloys), titanium alloys (e.g., 3-2.5, 6-4, SP700, 15-3-3-3, 10-2-3, or other alpha/near alpha, alpha-beta, and beta/near beta titanium alloys), aluminum/aluminum alloys (e.g., 3000 series alloys, 5000 series alloys, 6000 series alloys, such as 6061-T6, and 7000 series alloys, such as 7075), magnesium alloys, copper alloys, and nickel alloys.

Some examples of composites that can be used to form the components include, without limitation, glass fiber reinforced polymers (GFRP), carbon fiber reinforced polymers (CFRP), metal matrix composites (MMC), ceramic matrix composites (CMC), and natural composites (e.g., wood composites).

Some examples of polymers that can be used to form the components include, without limitation, thermoplastic materials (e.g., polyethylene, polypropylene, polystyrene, acrylic, PVC, ABS, polycarbonate, polyurethane, polyphenylene oxide (PPO), polyphenylene sulfide (PPS), polyether block amides, nylon, and engineered thermoplastics), thermosetting materials (e.g., polyurethane, epoxy, and polyester), copolymers, and elastomers (e.g., natural or synthetic rubber, EPDM, and Teflon®).

Mass Characteristics

A golf club head has a head mass defined as the combined masses of the body, weight ports, and weights. The total weight mass is the combined masses of the weight or weights installed on a golf club head. The total weight port mass is the combined masses of the weight ports and any weight port supporting structures, such as ribs.

In one embodiment, the rear weight is the heaviest weight being between about 15 grams to about 20 grams. In certain embodiments, the lighter weights can be about 1 gram to about 6 grams. In one embodiment, a single heavy weight of 16 g and two lighter weights of 1 g is preferred.

In some embodiments, a golf club head is provided with three weight ports having a total weight port mass between about 1 g and about 12 g. In certain embodiments, the weight port mass without ribs is about 3 g for a combined weight port mass of about 9 g. In some embodiments, the total weight port mass with ribbing is about 5 g to about 6 g for a combined total weight port mass of about 15 g to about 18 g.

Volume Characteristics

The golf club head of the present application has a volume equal to the volumetric displacement of the club head body. In several embodiments, a golf club head of the present application can be configured to have a head volume between about 110 $cm^3$ and about 600 $cm^3$. In more particular embodiments, the head volume is between about 250 $cm^3$ and about 500 $cm^3$, 400 $cm^3$ and about 500 $cm^3$, 390 $cm^3$ and about 420 $cm^3$, or between about 420 $cm^3$ and 475 $cm^3$. In one exemplary embodiment, the head volume is about 390 to about 410 $cm^3$.

Moments of Inertia and CG Location

Golf club head moments of inertia are defined about axes extending through the golf club head CG. As used herein, the golf club head CG location can be provided with reference to its position on a golf club head origin coordinate system. The golf club head origin is positioned on the face plate at approximately the geometric center, i.e. the intersection of the midpoints of a face plate's height and width.

The head origin coordinate system includes an x-axis and a y-axis. The origin x-axis extends tangential to the face plate and generally parallel to the ground when the head is ideally positioned with the positive x-axis extending from the origin towards a heel of the golf club head and the negative x-axis extending from the origin to the toe of the golf club head. The origin y-axis extends generally perpendicular to the origin x-axis and parallel to the ground when the head is ideally positioned with the positive y-axis extending from the head origin towards the rear portion of the golf club. The head origin can also include an origin z-axis extending perpendicular to the origin x-axis and the origin y-axis and having a positive z-axis that extends from the origin towards the top portion of the golf club head and negative z-axis that extends from the origin towards the bottom portion of the golf club head.

In some embodiments, the golf club head has a CG with a head origin x-axis (CGx) coordinate between about −10 mm and about 10 mm and a head origin y-axis (CGy) coordinate greater than about 15 mm or less than about 50 mm. In certain embodiments, the club head has a CG with an origin x-axis coordinate between about −5 mm and about 5 mm, an origin y-axis coordinate greater than about 0 mm and an origin z-axis (CGz) coordinate less than about 0 mm.

More particularly, in specific embodiments of a golf club head having specific configurations, the golf club head has a CG with coordinates approximated in Table 8 below. The golf club head in Table 8 has three weight ports and three weights. In configuration 1, the heaviest weight is located in the back most or rear weight port. The heaviest weight is located in a heel weight port in configuration 2, and the heaviest weight is located in a toe weight port in configuration 3.

TABLE 8

| Configuration | CG origin x-axis coordinate (mm) | CG Y origin y-axis coordinate (mm) | CG Z origin z-axis coordinate (mm) |
|---|---|---|---|
| 1 | 0 to 5 | 31 to 36 | 0 to −5 |
| | 1 to 4 | 32 to 35 | −1 to −4 |
| | 2 to 3 | 33 to 34 | −2 to −3 |
| 2 | 3 to 8 | 27 to 32 | 0 to −5 |
| | 4 to 7 | 28 to 31 | −1 to −4 |
| | 5 to 6 | 29 to 30 | −2 to −3 |
| 3 | −2 to 3 | 27 to 32 | 0 to −5 |
| | −1 to 2 | 28 to 31 | −1 to −4 |
| | 0 to 1 | 29 to 30 | −2 to −3 |

Table 8 emphasizes the amount of CG change that can be possible by moving the movable weights. In one embodiment, the movable weight change can provide a CG change in the x-direction (heel-toe) of between about 2 mm and about 10 mm in order to achieve a large enough CG change to create significant performance change to offset or enhance the possible loft, lie, and face angel adjustments described herein. A substantial change in CG is accomplished by having a large difference in the weight that is moved between different weight ports and having the weight ports spaced far enough apart to achieve the CG change. In certain embodiments, the CG is located below the center face with a CGz of less than 0. The CGx is between about −2 mm (toe-ward) and 8 mm (heel-ward) or even more preferably between about 0 mm and about 6 mm. Furthermore, the CGy can be between about 25 mm and about 40 mm (aft of the center-face).

A moment of inertia of a golf club head is measured about a CG x-axis, CG y-axis, and CG z-axis which are axes similar to the origin coordinate system except with an origin located at the center of gravity, CG.

In certain embodiments, the golf club head of the present invention can have a moment of inertia ($I_{xx}$) about the golf club head CG x-axis between about 70 $kg \cdot mm^2$ and about 400 $kg \cdot mm^2$. More specifically, certain embodiments have a moment of inertia about the CG x-axis between about 200 $kg \cdot mm^2$ to about 300 $kg \cdot mm^2$ or between about 200 $kg \cdot mm^2$ and about 500 $kg \cdot mm^2$.

In several embodiments, the golf club head of the present invention can have a moment of inertia ($I_{zz}$) about the golf club head CG z-axis between about 200 $kg \cdot mm^2$ and about 600 $kg \cdot mm^2$. More specifically, certain embodiments have a moment of inertia about the CG z-axis between about 400 $kg \cdot mm^2$ to about 500 $kg \cdot mm^2$ or between about 350 $kg \cdot mm^2$ and about 600 $kg \cdot mm^2$.

In several embodiments, the golf club head of the present invention can have a moment of inertia ($I_{yy}$) about the golf club head CG y-axis between about 200 kg·mm$^2$ and 400 kg·mm$^2$. In certain specific embodiments, the moment of inertia about the golf club head CG y-axis is between about 250 kg·mm$^2$ and 350 kg·mm$^2$.

The moment of inertia can change depending on the location of the heaviest removable weight as illustrated in Table 9 below. Again, in configuration 1, the heaviest weight is located in the back most or rear weight port. The heaviest weight is located in a heel weight port in configuration 2, and the heaviest weight is located in a toe weight port in configuration 3.

TABLE 9

| Configuration | $I_{xx}$ (kg · mm$^2$) | $I_{yy}$ (kg · mm$^2$) | $I_{zz}$ (kg · mm$^2$) |
|---|---|---|---|
| 1 | 250 to 300 | 250 to 300 | 410 to 460 |
| | 260 to 290 | 260 to 290 | 420 to 450 |
| | 270 to 280 | 270 to 280 | 430 to 440 |
| 2 | 200 to 250 | 270 to 320 | 380 to 430 |
| | 210 to 240 | 280 to 310 | 390 to 420 |
| | 220 to 230 | 290 to 300 | 400 to 410 |
| 3 | 200 to 250 | 280 to 330 | 400 to 450 |
| | 210 to 240 | 290 to 320 | 410 to 440 |
| | 220 to 230 | 300 to 310 | 420 to 430 |

Thin Wall Construction

According to some embodiments of a golf club head of the present application, the golf club head has a thin wall construction. Among other advantages, thin wall construction facilitates the redistribution of material from one part of a club head to another part of the club head. Because the redistributed material has a certain mass, the material may be redistributed to locations in the golf club head to enhance performance parameters related to mass distribution, such as CG location and moment of inertia magnitude. Club head material that is capable of being redistributed without affecting the structural integrity of the club head is commonly called discretionary weight. In some embodiments of the present invention, thin wall construction enables discretionary weight to be removed from one or a combination of the striking plate, crown, skirt, or sole and redistributed in the form of weight ports and corresponding weights.

Thin wall construction can include a thin sole construction, i.e., a sole with a thickness less than about 0.9 mm but greater than about 0.4 mm over at least about 50% of the sole surface area; and/or a thin skirt construction, i.e., a skirt with a thickness less than about 0.8 mm but greater than about 0.4 mm over at least about 50% of the skirt surface area; and/or a thin crown construction, i.e., a crown with a thickness less than about 0.8 mm but greater than about 0.4 mm over at least about 50% of the crown surface area. In one embodiment, the club head is made of titanium and has a thickness less than 0.65 mm over at least 50% of the crown in order to free up enough weight to achieve the desired CG location.

More specifically, in certain embodiments of a golf club having a thin sole construction and at least one weight and two weight ports, the sole, crown and skirt can have respective thicknesses over at least about 50% of their respective surfaces between about 0.4 mm and about 0.9 mm, between about 0.8 mm and about 0.9 mm, between about 0.7 mm and about 0.8 mm, between about 0.6 mm and about 0.7 mm, or less than about 0.6 mm. According to a specific embodiment of a golf club having a thin skirt construction, the thickness of the skirt over at least about 50% of the skirt surface area can be between about 0.4 mm and about 0.8 mm, between about 0.6 mm and about 0.7 mm or less than about 0.6 mm.

The thin wall construction can be described according to areal weight as defined by the equation (Eq. 5) below:

$$AW=\rho \cdot t \qquad \text{Eq. 5}$$

In the above equation, AW is defined as areal weight, ρ is defined as density, and t is defined as the thickness of the material. In one exemplary embodiment, the golf club head is made of a material having a density, ρ, of about 4.5 g/cm$^3$ or less. In one embodiment, the thickness of a crown or sole portion is between about 0.04 cm and about 0.09 cm. Therefore the areal weight of the crown or sole portion is between about 0.18 g/cm$^2$ and about 0.41 g/cm$^2$. In some embodiments, the areal weight of the crown or sole portion is less than 0.41 g/cm$^2$ over at least about 50% of the crown or sole surface area. In other embodiments, the areal weight of the crown or sole is less than about 0.36 g/cm$^2$ over at least about 50% of the entire crown or sole surface area.

In certain embodiments, the thin wall construction is implemented according to U.S. patent application Ser. No. 11/870,913 and U.S. Pat. No. 7,186,190, which are incorporated by reference herein in their entirety.

Variable Thickness Faceplate

According to some embodiments, a golf club head face plate can include a variable thickness faceplate. Varying the thickness of a faceplate may increase the size of a club head COR zone, commonly called the sweet spot of the golf club head, which, when striking a golf ball with the golf club head, allows a larger area of the face plate to deliver consistently high golf ball velocity and shot forgiveness. Also, varying the thickness of a faceplate can be advantageous in reducing the weight in the face region for reallocation to another area of the club head.

Figure 13A:
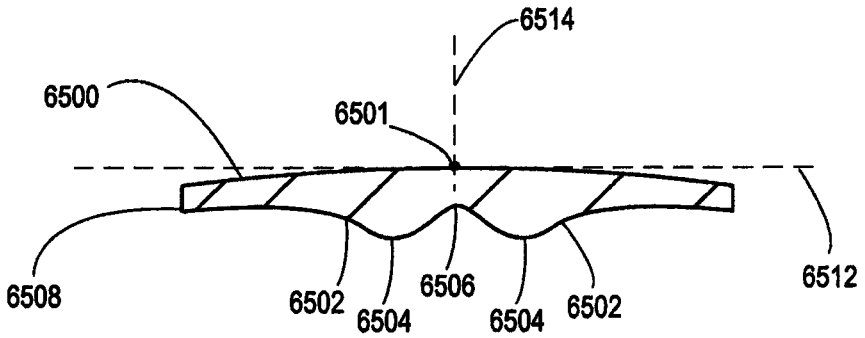
FIG. 13A is a cross-sectional view of a golf club head face plate protrusion.
Figure 13B:
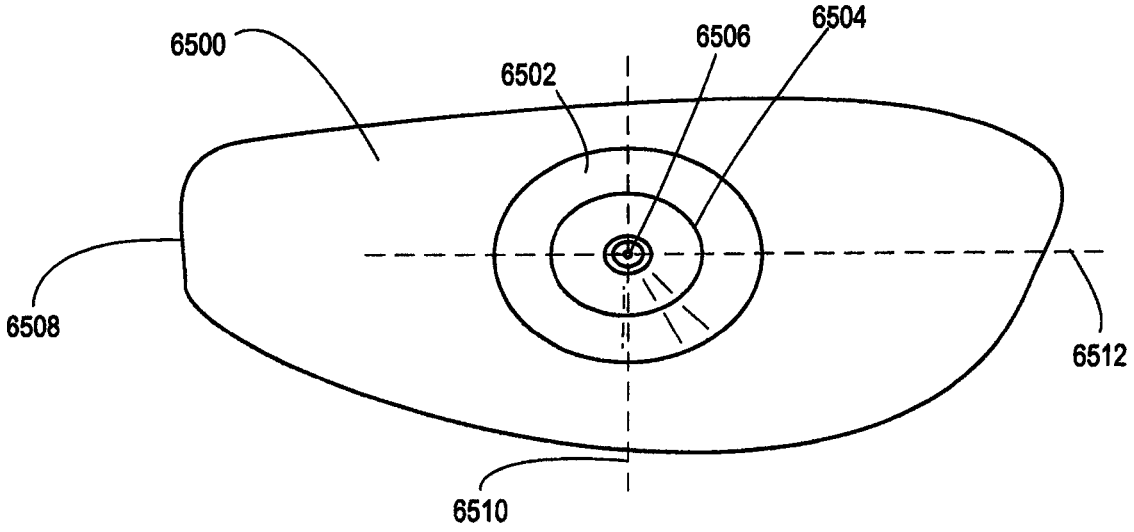
FIG. 13B is a rear view of a golf club face plate protrusion.

A variable thickness face plate 6500, according to one embodiment of a golf club head illustrated in FIGS. 13A and 13B, includes a generally circular protrusion 6502 extending into the interior cavity towards the rear portion of the golf club head. When viewed in cross-section, as illustrated in FIG. 13A, protrusion 6502 includes a portion with increasing thickness from an outer portion 6508 of the face plate 6500 to an intermediate portion 6504. The protrusion 6502 further includes a portion with decreasing thickness from the intermediate portion 6504 to an inner portion 6506 positioned approximately at a center of the protrusion preferably proximate the golf club head origin. An origin x-axis 6512 and an origin z-axis 6510 intersect near the inner portion 6506 across an x-z plane. However, the origin x-axis 6512, origin z-axis 6510, and an origin y-axis 6514 pass through an ideal impact location 6501 located on the striking surface of the face plate. In certain embodiments, the inner portion 6506 can be aligned with the ideal impact location with respect to the x-z plane.

In some embodiments of a golf club head having a face plate with a protrusion, the maximum face plate thickness is greater than about 4.8 mm, and the minimum face plate thickness is less than about 2.3 mm. In certain embodiments, the maximum face plate thickness is between about 5 mm and about 5.4 mm and the minimum face plate thickness is between about 1.8 mm and about 2.2 mm. In yet more particular embodiments, the maximum face plate thickness is about 5.2 mm and the minimum face plate thickness is about 2 mm. The face thickness should have a thickness change of at least 25% over the face (thickest portion compared to thinnest) in order to save weight and achieve a higher ball speed on off-center hits.

In some embodiments of a golf club head having a face plate with a protrusion and a thin sole construction or a thin skirt construction, the maximum face plate thickness is greater than about 3.0 mm and the minimum face plate thickness is less than about 3.0 mm. In certain embodiments, the maximum face plate thickness is between about 3.0 mm and about 4.0 mm, between about 4.0 mm and about 5.0 mm, between about 5.0 mm and about 6.0 mm or greater than about 6.0 mm, and the minimum face plate thickness is between about 2.5 mm and about 3.0 mm, between about 2.0 mm and about 2.5 mm, between about 1.5 mm and about 2.0 mm or less than about 1.5 mm.

In certain embodiments, a variable thickness face profile is implemented according to U.S. patent application Ser. No. 12/006,060, U.S. Pat. Nos. 6,997,820, 6,800,038, and 6,824,475, which are incorporated herein by reference in their entirety.

Distance Between Weight Ports

In some embodiments of a golf club head having at least two weight ports, a distance between the first and second weight ports is between about 5 mm and about 200 mm. In more specific embodiments, the distance between the first and second weight ports is between about 5 mm and about 100 mm, between about 50 mm and about 100 mm, or between about 70 mm and about 90 mm. In some specific embodiments, the first weight port is positioned proximate a toe portion of the golf club head and the second weight port is positioned proximate a heel portion of the golf club head.

In some embodiments of the golf club head having first, second and third weight ports, a distance between the first and second weight port is between about 40 mm and about 100 mm, and a distance between the first and third weight port, and the second and third weight port, is between about 30 mm and about 90 mm. In certain embodiments, the distance between the first and second weight port is between about 60 mm and about 80 mm, and the distance between the first and third weight port, and the second and third weight port, is between about 50 mm and about 80 mm. In a specific example, the distance between the first and second weight port is between about 80 mm and about 90 mm, and the distance between the first and third weight port, and the second and third weight port, is between about 70 mm and about 80 mm. In some embodiments, the first weight port is positioned proximate a toe portion of the golf club head, the second weight port is positioned proximate a heel portion of the golf club head and the third weight port is positioned proximate a rear portion of the golf club head.

In some embodiments of the golf club head having first, second, third and fourth weights ports, a distance between the first and second weight port, the first and fourth weight port, and the second and third weight port is between about 40 mm and about 100 mm; a distance between the third and fourth weight port is between about 10 mm and about 80 mm; and a distance between the first and third weight port and the second and fourth weight port is about 30 mm to about 90 mm. In more specific embodiments, a distance between the first and second weight port, the first and fourth weight port, and the second and third weight port is between about 60 mm and about 80 mm; a distance between the first and third weight port and the second and fourth weight port is between about 50 mm and about 70 mm; and a distance between the third and fourth weight port is between about 30 mm and about 50 mm. In some specific embodiments, the first weight port is positioned proximate a front toe portion of the golf club head, the second weight port is positioned proximate a front heel portion of the golf club head, the third weight port is positioned proximate a rear toe portion of the golf club head and the fourth weight port is positioned proximate a rear heel portion of the golf club head.

Product of Distance Between Weight Ports and the Maximum Weight

As mentioned above, the distance between the weight ports and weight size contributes to the amount of CG change made possible in a system having the sleeve assembly described herein.

In some embodiments of a golf club head of the present application having two, three or four weights, a maximum weight mass multiplied by the distance between the maximum weight and the minimum weight is between about 450 g·mm and about 2,000 g·mm or about 200 g·mm and 2,000 g·mm. More specifically, in certain embodiments, the maximum weight mass multiplied by the weight separation distance is between about 500 g·mm and about 1,500 g·mm, between about 1,200 g·mm and about 1,400 g·mm.

When a weight or weight port is used as a reference point from which a distance, i.e., a vectorial distance (defined as the length of a straight line extending from a reference or feature point to another reference or feature point) to another weight or weights port is determined, the reference point is typically the volumetric centroid of the weight port.

When a movable weight club head and the sleeve assembly are combined, it is possible to achieve the highest level of club trajectory modification while simultaneously achieving the desired look of the club at address. For example, if a player prefers to have an open club face look at address, the player can put the club in the "R" or open face position. If that player then hits a fade (since the face is open) shot but prefers to hit a straight shot, or slight draw, it is possible to take the same club and move the heavy weight to the heel port to promote draw bias. Therefore, it is possible for a player to have the desired look at address (in this case open face) and the desired trajectory (in this case straight or slight draw).

In yet another advantage, by combining the movable weight concept with an adjustable sleeve position (effecting loft, lie and face angle) it is possible to amplify the desired trajectory bias that a player may be trying to achieve.

For example, if a player wants to achieve the most draw possible, the player can adjust the sleeve position to be in the closed face position or "L" position and also put the heavy weight in the heel port. The weight and the sleeve position work together to achieve the greater draw bias possible. On the other hand, to achieve the greatest fade bias, the sleeve position can be set for the open face or "R" position and the heavy weight is placed in the top port.

Product of Distance Between Weight Ports, the Maximum Weight, and the Maximum Loft Change As described herein, the combination of a large CG change (measured by the heaviest weight multiplied by the distance between the ports) and a large loft change (measured by the largest possible change in loft between two sleeve positions, Δloft) results in the highest level of trajectory adjustability. Thus, a product of the distance between at least two weight ports, the maximum weight, and the maximum loft change is important in describing the benefits achieved by the embodiments described herein.

In one embodiment, the product of the distance between at least two weight ports, the maximum weight, and the maximum loft change is between about 50 mm·g·deg and about 6,000 mm·g·deg or even more preferably between about 500 mm·g·deg and about 3,000 mm·g·deg. In other words, in certain embodiments, the golf club head satisfies the following expressions in Eq. 6 and Eq. 7.

$$50\ \text{mm·g·degrees} < Dwp \cdot Mhw \cdot \Delta\text{loft} < 6{,}000\ \text{mm·g·degrees} \quad \text{Eq. 6}$$

$$500\ \text{mm·g·degrees} < Dwp \cdot Mhw \cdot \Delta\text{loft} < 3{,}000\ \text{mm·g·degrees} \quad \text{Eq. 7}$$

In the above expressions, Dwp, is the distance between two weight port centroids (mm), Mhw, is the mass of the heaviest weight (g), and Δloft is the maximum loft change (degrees) between at least two sleeve positions. A golf club head within the ranges described herein will ensure the highest level of trajectory adjustability.

Torque Wrench

Figure 14:
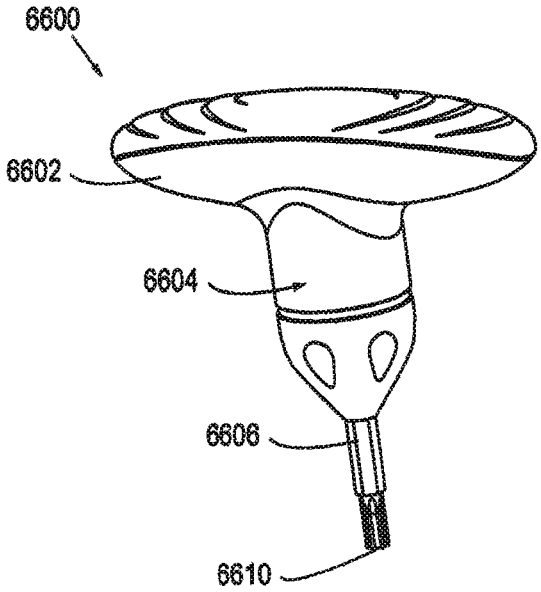
FIG. 14 is an isometric view of a tool.

With respect to FIG. 14, the torque wrench 6600 includes a grip 6602, a shank 6606 and a torque limiting mechanism housed inside the torque wrench. The grip 6602 and shank 6606 form a T-shape and the torque-limiting mechanism is located between the grip 6602 and shank 6606 in an intermediate region 6604. The torque-limiting mechanism prevents over-tightening of the movable weights, the adjustable sleeve, and the adjustable sole features of the embodiments described herein. In use, once the torque limit is met, the torque-limiting mechanism of the exemplary embodiment will cause the grip 6602 to rotationally disengage from the shank 6606. Preferably, the wrench 6600 is limited to between about 30 inch-lbs. and about 50 inch-lbs of torque. More specifically, the limit is between about 35 inch-lbs. and about 45 inch-lbs. of torque. In one exemplary embodiment, the wrench 6600 is limited to about 40 inch-lbs. of torque.

The use of a single tool or torque wrench 6600 for adjusting the movable weights, adjustable sleeve or adjustable loft system, and adjustable sole features provides a unique advantage in that a user is not required to carry multiple tools or attachments to make the desired adjustments.

The shank 6606 terminates in an engagement end i.e. tip 6610 configured to operatively mate with the movable weights, adjustable sleeve, and adjustable sole features described herein. In one embodiment, the engagement end or tip 6610 is a bit-type drive tip having one single mating configuration for adjusting the movable weights, adjustable sleeve, and adjustable sole features. The engagement end can be comprised of lobes and flutes spaced equidistantly about the circumference of the tip.

In certain embodiments, the single tool 6600 is provided to adjust the sole angle and the adjustable sleeve (i.e. affecting loft angle, lie angle, or face angle) only. In another embodiment, the single tool 6600 is provided to adjust the adjustable sleeve and movable weights only. In yet other embodiments, the single tool 6600 is provided to adjust the movable weights and sole angle only.

Composite Face Insert

Figure 15A:
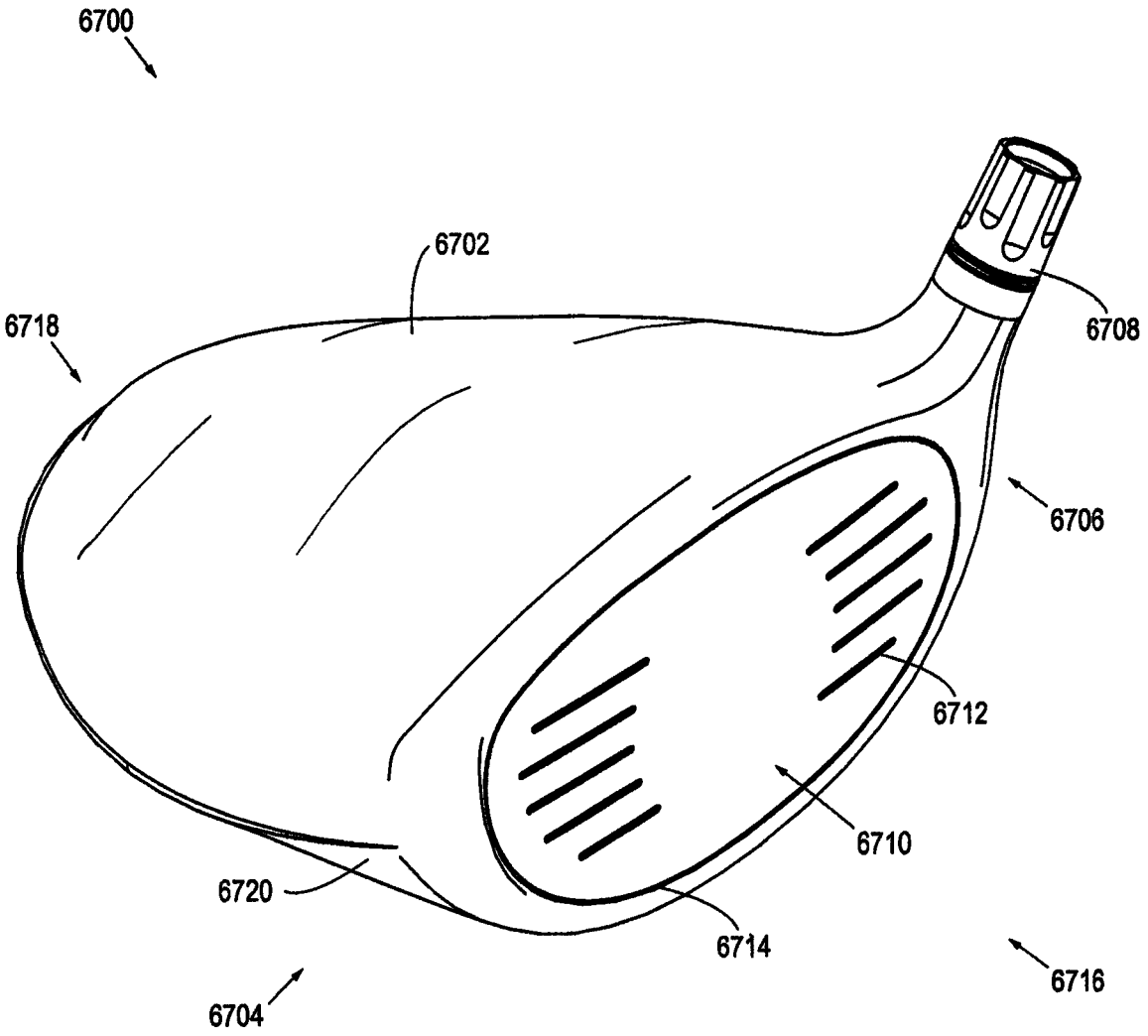
FIG. 15A is an isometric view of a golf club head.

FIG. 15A shows an isometric view of a golf club head 6700 including a crown portion 6702, a sole portion 6720, a rear portion 6718, a front portion 6716, a toe region 6704, heel region 6706, and a sleeve 6708. A face insert 6710 is inserted into a front opening inner wall 6714 located in the front portion 6716. The face insert 6710 can include a plurality of score lines.

Figure 15B:
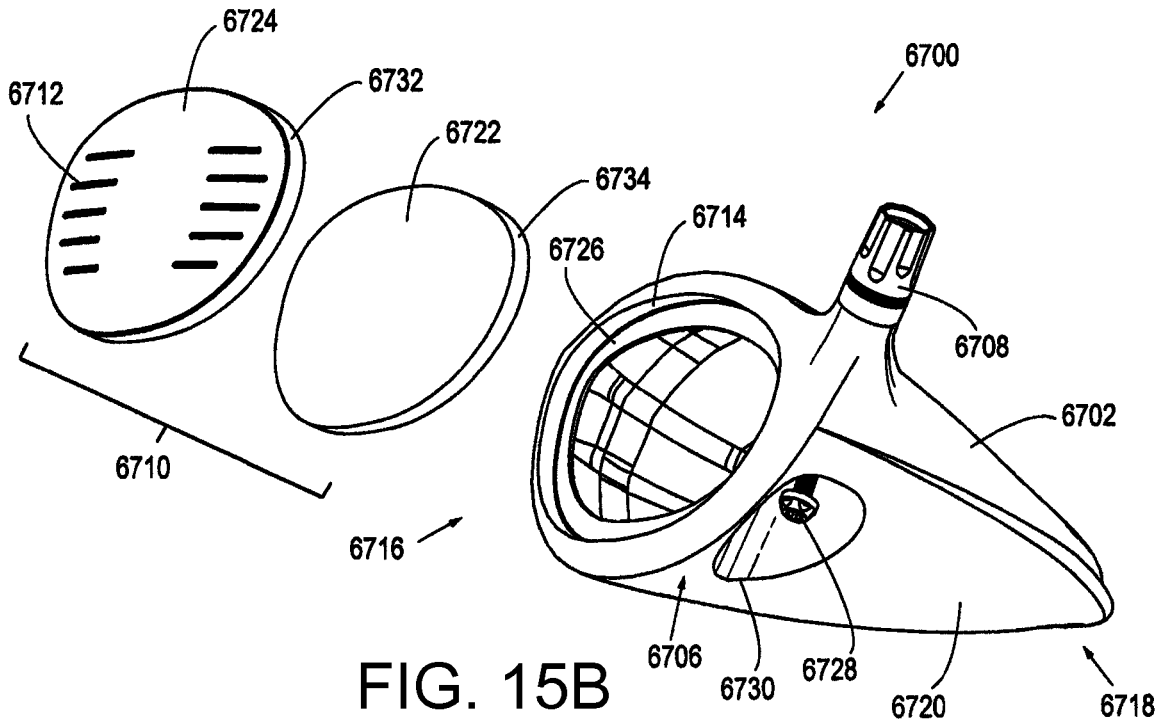
FIG. 15B is an exploded view of the golf club head of FIG. 15A.
Figure 15C:
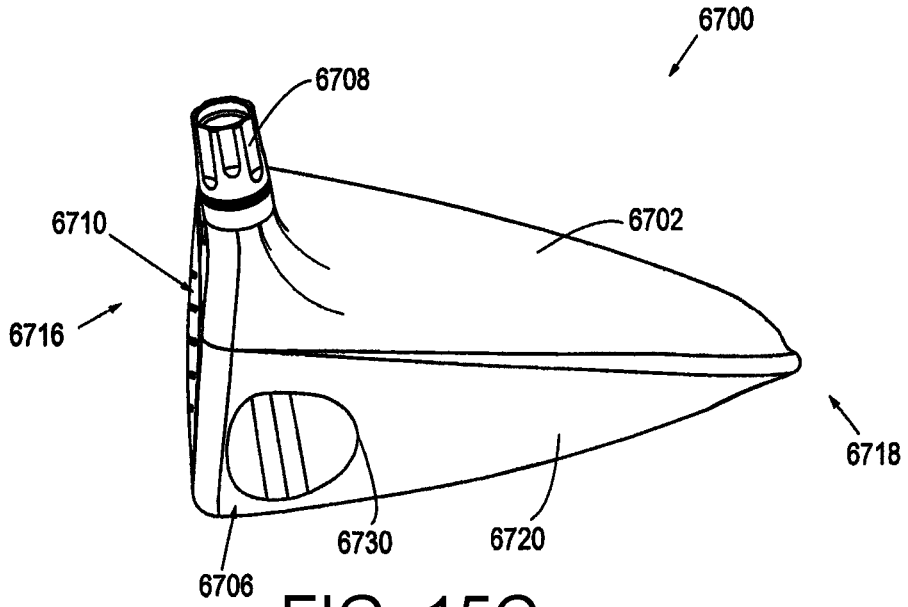
FIG. 15C is a side view of the golf club head of FIG. 15A.

FIG. 15B illustrates an exploded assembly view of the golf club head 6700 and a face insert 6710 including a composite face insert 6722 and a metallic cap 6724. In certain embodiments, the metallic cap 6724 is a titanium alloy, such as 6-4 titanium or CP titanium. In some embodiments, the metallic cap 6725 includes a rim portion 6732 that covers a portion of a side wall 6734 of the composite insert 6722.

In other embodiments, the metallic cap 6724 does not have a rim portion 6732 but includes an outer peripheral edge that is substantially flush and planar with the side wall 6734 of the composite insert 6722. A plurality of score lines 6712 can be located on the metallic cap 6724. The composite face insert 6710 has a variable thickness and is adhesively or mechanically attached to the insert ear 6726 located within the front opening and connected to the front opening inner wall 6714. The insert ear 6726 and the composite face insert 6710 can be of the type described in U.S. patent application Ser. Nos. 11/642,310, 11/825,138, 11/960,609, 11/960,610 and U.S. Pat. Nos. 7,267,620, RE42,544, 7,874,936, 7,874,937, and 7,985,146, which are incorporated by reference herein in their entirety.

FIG. 15B further shows a heel opening 6730 located in the heel region 6706 of the club head 6700. A fastening member 6728 is inserted into the heel opening 6730 to secure a sleeve 6708 in a locked position as shown in the various embodiments described herein. In certain embodiments, the sleeve 6708 can have any of the specific design parameters disclosed herein and is capable of providing various face angle and loft angle orientations as described herein.

Figure 16:
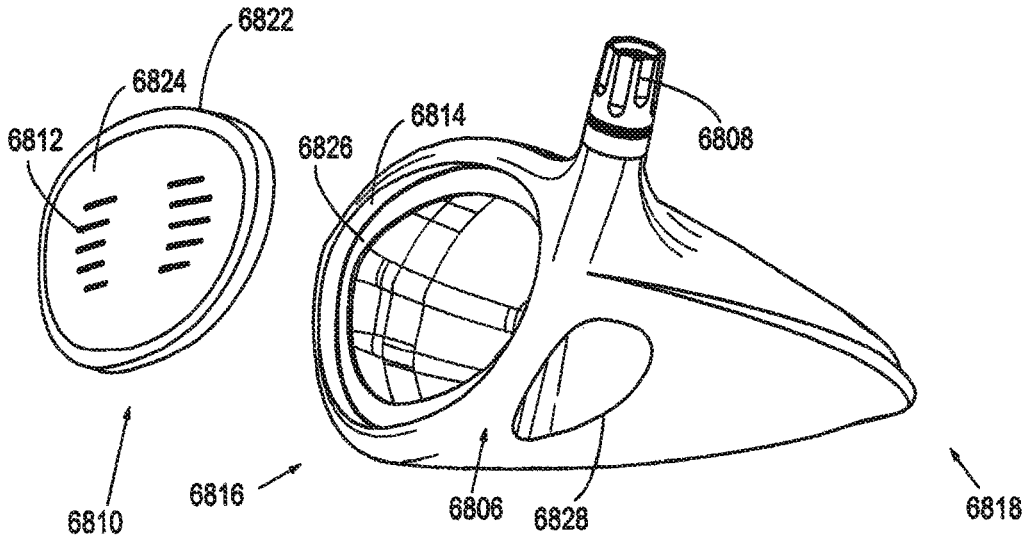
FIG. 16 is an isometric view of a golf club head.

FIG. 16 shows an alternative embodiment having a sleeve 6808, a heel region 6806, a front region 6816, a rear region 6818, a hosel opening 6828, a front opening inner wall 6814, and an insert ear 6826 as fully described herein. However, FIG. 16 shows a face insert 6810 including a composite face insert 6822 with a front cover 6824. In one embodiment, the front cover 6824 is a polymer material. The face insert 6810 can include score lines located on the polymer cover 6824 or the composite face insert 6822.

The club head of the embodiments described in FIGS. 15A-C and FIG. 16 can have a mass of about 200 g to about 210 g or about 190 g to about 200 g. In certain embodiments, the mass of the club head is less than about 205 g. In one embodiment, the mass is at least about 190 g. Additional mass added by the hosel opening and the insert ear in certain embodiments will have an effect on moment of inertia and center of gravity values as shown in Tables 10 and 11.

TABLE 10

| $I_{xx}$ (kg · mm$^2$) | $I_{yy}$ (kg · mm$^2$) | $I_{zz}$ (kg · mm$^2$) |
|---|---|---|
| 330 to 340 | 340 to 350 | 520 to 530 |
| 320 to 350 | 330 to 360 | 510 to 540 |
| 310 to 360 | 320 to 370 | 500 to 550 |

TABLE 11

| CG origin x-axis coordinate (mm) | CG Y origin y-axis coordinate (mm) | CG Z origin z-axis coordinate (mm) |
|---|---|---|
| 5 to 7 | 32 to 34 | −5 to −6 |
| 4 to 8 | 31 to 36 | −4 to −7 |
| 3 to 9 | 30 to 37 | −3 to −8 |

A golf club having an adjustable loft and lie angle with a composite face insert can achieve the moment of inertia and CG locations listed in Table 10 and 11. In certain embodiments, the golf club head can include movable weights in addition to the adjustable sleeve system and composite face. In embodiments where movable weights are implemented, similar moment of inertia and CG values already described herein can be achieved.

The golf club head embodiments described herein provide a solution to the additional weight added by a movable weight system and an adjustable loft, lie, and face angle system. Any undesirable weight added to the golf club head makes it difficult to achieve a desired head size, moment of inertia, and nominal center of gravity location.

In certain embodiments, the combination of ultra-thin wall casting technology, high strength variable face thickness, strategically placed compact and lightweight movable weight ports, and a lightweight adjustable loft, lie, and face angle system make it possible to achieve high performing moment of inertia, center of gravity, and head size values.

Furthermore, an advantage of the discrete positions of the sleeve embodiments described herein allow for an increased amount of durability and more user friendly system.

Rotationally Adjustable Sole Portion

As discussed above, conventional golf clubs do not allow for adjustment of the hosel/shaft loft without causing a corresponding change in the face angle. Configured to "decouple" the relationship between face angle and hosel/shaft loft (and therefore square loft), that is, allow for separate adjustment of square loft and face angle.

In particular embodiments, the combined mass of the screw and the adjustable sole portion is between about 2 and about 11 grams, and desirably between about 4.1 and about 4.9 grams. Furthermore, the recessed cavity and the projection can add about 1 to about 10 grams of additional mass to the sole compared to if the sole had a smooth, 0.6 mm thick, titanium wall in the place of the recessed cavity. In total, the golf club head (including the sole portion) can comprise about 3 to about 21 grams of additional mass compared to if the golf club head had a conventional sole having a smooth, 0.6 mm thick, titanium wall in the place of the recessed cavity, the adjustable sole portion, and the screw.

In other particular embodiments, at least 50% of the crown of the club head body can have a thickness of less than about 0.7 mm.

In still other particular embodiments, the golf club body can define an interior cavity (not shown) and the golf club head can have a center of gravity with a head origin x-axis coordinate greater than about 2 mm and less than about 8 mm and a head origin y-axis coordinate greater than about 25 mm and less than about 40 mm, where a positive y-axis extends toward the interior cavity. In at least these embodiments, the golf club head center of gravity can have a head origin z-axis coordinate less than about 0 mm.

In other particular embodiments, the golf club head can have an moment of inertia about a head center of gravity x-axis generally parallel to an origin x-axis that can be between about 200 and about 500 kg·mm$^2$ and a moment of inertia about a head center of gravity z-axis generally perpendicular to ground, when the golf club head is ideally positioned, that can be between about 350 and about 600 kg-mm$^2$.

In certain embodiments, the golf club head can have a volume greater than about 400 cc and a mass less than about 220 grams.

Table 12 below lists various properties of one particular embodiment of the golf club head.

TABLE 12

| | | | | | |
|---|---|---|---|---|---|
| Address Area | 11369 | mm$^2$ | Bulge Radius | 304.8 | mm |
| CGX | 5.6 | mm | Roll Radius | 304.8 | mm |
| CGZ | −3.2 | mm | Face Height | 62.8 | mm |
| Z Up | 30.8 | mm | Face Width | 88.9 | mm |
| Ixx (axis heel/toe) | 363 | kg · mm$^2$ | Face Area 0.5 mm offset method | 4514 | mm$^2$ |
| Iyy (axis front/back) | 326 | kg · mm$^2$ | Head Height | 68.8 | mm |
| Izz (axis normal to grnd) | 550 | kg · mm$^2$ | Head Length | 119.1 | mm |
| Square Loft | 10° | | Body Density | 4.5 | g/cc |
| Lie | 59° | | Mass | 215.8 | g |
| Face Angle | 3° | | Volume | 438 | cc |

Internal Ribs

Figures 17, 18:
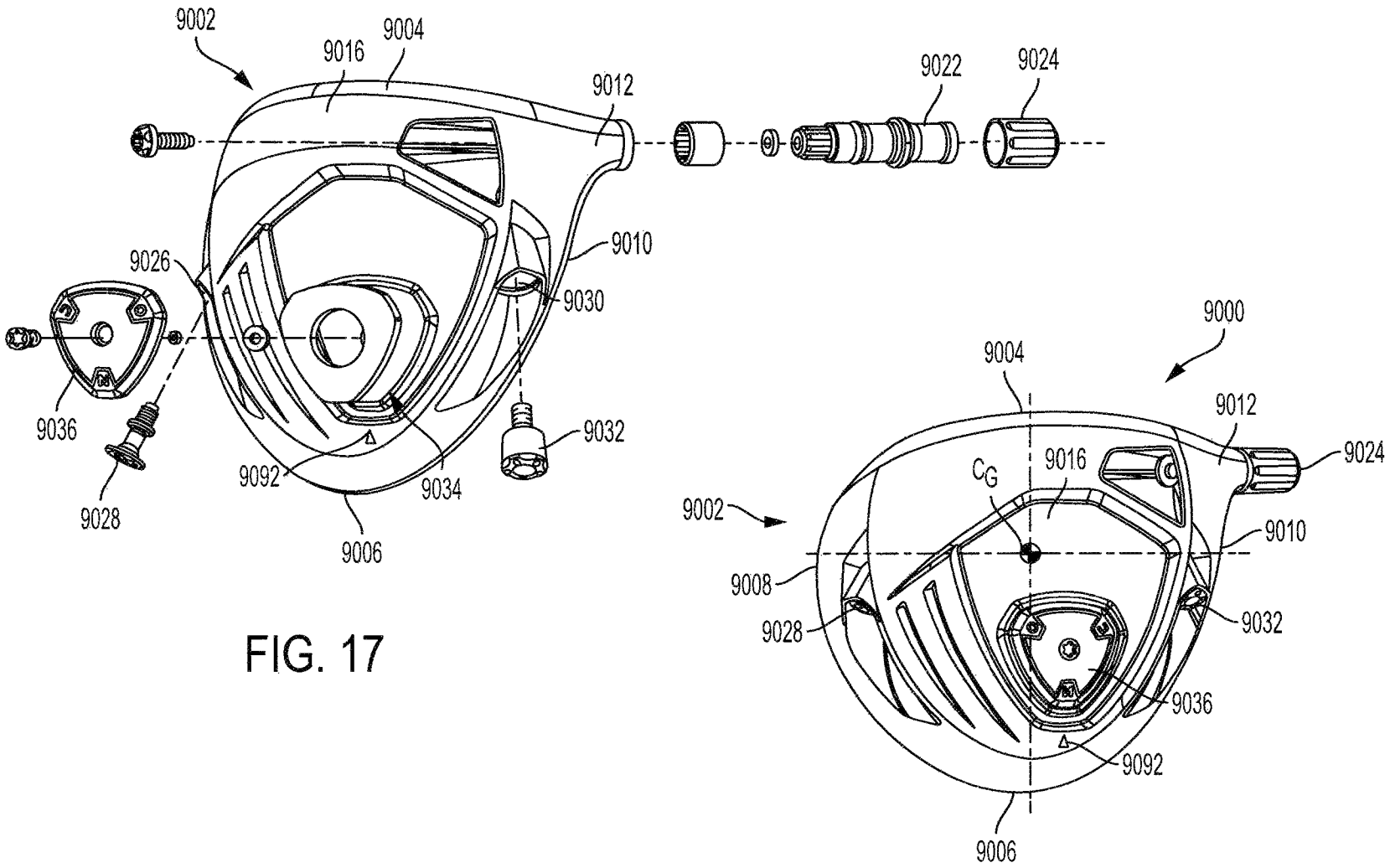
FIG. 17 is an exploded view of a golf club head, according to yet another embodiment.
FIG. 18 is an assembled view of the golf club head of FIG. 17.

FIGS. 17-18 show an exemplary golf club head having an adjustable sole piece, and a plurality of ribs positioned on the inner surface of the sole. The ribs can reinforce and stabilize the sole, especially the area of the sole where the external adjustable sole piece is attached, and can improve the sound the club makes when striking a golf ball.

The addition of a recessed sole port and an attached adjustable sole piece can undesirably change the sound the club makes during impact with a ball. For example, compared to a similar club without an adjustable sole piece, the addition of the sole piece can cause lower sound frequencies, such as first mode sound frequencies below 3,000 Hz and/or below 2,000 Hz, and a longer sound duration, such as 0.09 seconds or longer. The lower and long sound frequencies can be distracting to golfers. The ribs on the internal surface of the sole can be oriented in several different directions and can tie the sole port to other strong structures of the club head body, such as weight ports at the sole and heel of the body and/or the skirt region between the sole and the crown. One or more ribs can also be tied to the hosel to further stabilize the sole. With the addition of such ribs on the internal surface of the sole, the club head can produce higher sound frequencies when striking a golf ball on the face, such as above 2,500 Hz, above 3,000 Hz, and/or above 3,500 Hz, and with a shorter sound duration, such as less than 0.05 seconds, which can be more desirable for a golfer. In addition, with the described ribs, the sole can have a frequency, such as a natural frequency, of a first fundamental sole mode that is greater than 2,500 Hz and/or greater than 3,000 Hz, wherein the sole mode is a vibration frequency associated with a location on the sole. Typically, this location is the location on the sole that exhibits a largest degree of deflection resulting from striking a golf ball.

As shown in FIGS. 17-28, exemplary golf club heads described herein can include an adjustable sole piece and internal sole ribs. Such exemplary golf club heads can also include adjustable weights at the toe and/or heel of the body, an adjustable shaft attachment system, a variable thickness face plate, thin wall body construction, and/or any other club head features described herein. While this description proceeds with respect to the particular embodiment shown in FIGS. 17-19, this embodiment is only exemplary and should not be considered as a limitation on the scope of the underlying concepts. For example, although the illustrated example includes many described features, alternative embodiments can include various subsets of these features and/or additional features.

FIG. 17 shows an exploded view of an exemplary golf club head 9000, and FIG. 18 shows the head assembled. The head 9000 comprises a hollow body 9002. The body 9002 (and thus the whole club head 9000) includes a front portion 9004, a rear portion 9006, a toe portion 9008, a heel portion 9010, a hosel 9012, a crown and a sole 9016. The front portion 9004 forms an opening that receives a face plate, which can be a variable thickness, composite and/or metal face plate, as described herein. The illustrated club head 9000 can also comprise an adjustable shaft connection system for coupling a shaft to the hosel 9012, the system including various components, such as a sleeve 9022 and a ferrule 9024 (more detail regarding the hosel and the adjustable shaft connection system can be found, for example, in U.S. Pat. No. 7,887,431 and U.S. patent application Ser. Nos. 13/077,825, 12/986,030, 12,687,003, 12/474,973, which are incorporated herein by reference in their entirety). The shaft connection system, in conjunction with the hosel 9012, can be used to adjust the orientation of the club head 9000 with respect to the shaft, as described herein.

The illustrated club head 9000 also comprises an adjustable toe weight 9028 at a toe weight port 9026, an adjustable heel weight 9032 at a heel weight port 9030, and an adjustable sole piece 9036 at a sole port, or pocket, 9034, as described herein.

As shown in FIG. 18, the CG of the golf club head 9000 can divide the club head into four quadrants, a front-heel quadrant that is frontward and heelward of the CG, a front-toe quadrant that is frontward and toeward of the CG, a rear-heel quadrant that is rearward and heelward of the CG, and a rear-toe quadrant that is rearward and toeward of the CG. The center of the sole port 9034, e.g., the aperture, can be positioned heelward and rearward of the CG (as shown in FIG. 18), or in other words, in the rear-heel quadrant of the club head. As such, a majority of the sole piece 9036 and a majority of the sole port 9034 can be positioned in the rear-heal quadrant of the club head, but a portion of the sole piece and/or a portion of the sole port can also be in the rear-toe quadrant of the club head. In some embodiments, all of the sole piece and all of the sole port can be rearward of the CG.

With the aperture is located in a rear-heel quadrant, at least two ribs can converge at a convergence location near the aperture. In some embodiments, at least three ribs or at least four ribs converge at a convergence location located in the rear-heel quadrant of the club head. It is understood that the number of ribs that converge in the rear-heel quadrant can be between two and ten ribs in total.

One or more ribs are disposed on the internal surface of the sole 9016. The ribs can be part of the same material that forms the sole 9016 and/or the rest of the body, such a metal or metal alloy, as describe above in detail. The ribs can be formed as an integral part of the sole, such as by casting, such that the ribs and the sole are of the same monolithic structure. The bottom of the ribs can be integrally connected to sole without the need for welding or other attachment methods. In other embodiments, one or more of the ribs can be formed at least partially separate from the sole and then attached to the sole, such as by welding.

One or more of the ribs can have a width dimension that is constant or nearly constant along the entire length of the rib. In some embodiments, such as the illustrated embodiment, each of the ribs has the same, constant width, such as about 0.8 mm, or greater than 0.5 mm and less than about 1.5 mm. In one embodiment, the rib has a width of about 0.7 mm. In other embodiments, different ribs can have different widths. In some embodiments, the width of one or more of the ribs can vary along the length of the rib, such as being wider nearer to the rib end portions and narrower at an intermediate portion. In general, the width of the ribs is less than the height of the ribs.

One or more of the ribs can form a straight line when projected onto a plane parallel with the ground, when the club head 9000 is in the address position. In other words, one or more of the ribs can extend along a two-dimensional path between its end points. In some embodiments, the ribs can extend in at least four, at least five, or at least six different directions across the sole, as viewed from above. The direction of each of the ribs can help stabilize the sole 9016 in that direction. Thus, having ribs in multiple directions desirably helps to stabilize the sole in multiple directions.

It should be noted that the internal sole ribs described herein are not raised portions of the sole that correspond to recessed grooves in the external surface of sole. Instead, the ribs described herein comprise additional structural material that is positioned above the internal surface of sole. In other words, if the ribs were removed, a smooth internal sole surface would remain.

As shown in FIG. 18, the sole 9016 can include a marker 9092 adjacent the sole port 9034, such as directly behind the sole port. The triangular sole piece 9036 can include three indicators, such as "O", "N" and "C", that indicate that the sole piece is set such that the face angle is "Open", "Neutral" and "Closed", respectively, depending on which indicator is adjacent the marker 9092. Similarly, the bottom surface of the lower wall of the pentagonal sole piece can include five indicators a, b, c, d and e, that indicate a face angle setting. When the pentagonal sole piece is secured to the sole port 9034 (similar to FIG. 18), one of the indicators a, b, c, d, ore can be aligned with the marker 9092, and that indicator can indicate which pair of surfaces A-E, or trio of surfaces, are in contact with the platform, and thus what face angle setting corresponds to that positioning of the sole piece. For example, if the indicator "d" on the bottom of the sole piece is aligned with the marker 9092, that can indicate that the surfaces D are in contact with the platform and that the sole piece is positioned such that the face angle will be closed −2° when in the address position. The indicators a, b, c, d and e can, for example, be "+4°", "+2°", "0°, "−2°", and "−4°", respectively, or any other indicator scheme that represents to a person what face angle setting is caused by aligning a particular indicator with the marker 9092.

Regardless of the configuration of the adjustable sole piece (whether it is circular, elliptical, polygonal, triangular, quadrilateral, pentagonal, hexagonal, heptagonal, octagonal, enneagonal, decagonal, or some other shape), the curvature of the bottom surface of the sole piece can be selected to match the curvature of the front contact surface at the front of the sole 9016. The contact surface and the bottom surface of the sole piece 9036 can be the only two surfaces that contact the ground when the club head is in the address position. The lateral distance between the front contact surface and the center aperture 9086 of the sole piece 9036 can be from about 45 mm to about 60 mm, such as about 52 mm.

I. Concluding Remarks

Having illustrated and described the principles of the illustrated embodiments, it will be apparent to those skilled in the art that the embodiments can be modified in arrangement and detail without departing from such principles. For example, although the embodiments disclosed above are made primarily with reference to drivers and driving-wood-type clubs, any aspect of the disclosed technology can be incorporated into a fairway wood having a smaller volume and/or greater mass. For example, a fairway wood or rescue wood having any of the disclosed low CG and/or static high loft characteristics are considered to be within the scope of this disclosure. For instance, embodiments of fairway woods incorporating any one or more aspects of the disclosed technology have a volume between about 110 and 250 $cm^3$ and a weight of between about 190 and 225 grams, whereas embodiments of hybrid woods incorporating any one or more aspects of the disclosed technology have a volume between about 80 and 150 $cm^3$ and a weight of between about 210 and 240 grams.

The disclosure above encompasses multiple distinct inventions with independent utility. While each of these inventions has been disclosed in a particular form, the specific embodiments disclosed and illustrated above are not to be considered in a limiting sense as numerous variations are possible. The subject matter of the inventions includes all novel and non-obvious combinations and subcombinations of the various elements, features, functions and/or properties disclosed above and inherent to those skilled in the art pertaining to such inventions. Where the disclosure or subsequently filed claims recite "a" element, "a first" element, or any such equivalent term, the disclosure or claims should be understood to incorporate one or more such elements, neither requiring nor excluding two or more such elements.

Applicant(s) reserves the right to submit claims directed to combinations and subcombinations of the disclosed inventions that are believed to be novel and non-obvious. Inventions embodied in other combinations and subcombinations of features, functions, elements and/or properties may be claimed through amendment of those claims or presentation of new claims in the present application or in a related application. Such amended or new claims, whether they are directed to the same invention or a different invention and whether they are different, broader, narrower or equal in scope to the original claims, are to be considered within the subject matter of the inventions described herein.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims and their equivalents. We therefore claim as our invention all that comes within the scope and spirit of these claims and their equivalents.

The invention claimed is:

1. A golf club head comprising:

a club head body having a crown portion, a sole portion, a toe portion, a heel portion, a rear portion, and a front portion together defining an interior cavity, wherein:

the club head body has a striking surface located at the front portion of the club head body, and a head origin defined as a position on the striking surface at approximately a geometric center of the striking surface, the head origin including a head origin x-axis, a head origin y-axis, and a head origin z-axis;

the head origin x-axis is tangential to the striking surface and generally parallel to a ground plane when the head is in an address position and a positive x-axis extends towards a heel portion;

the head origin y-axis extends perpendicular to the head origin x-axis and generally parallel to the ground plane when the head is in the address position and a positive y-axis extends from the striking surface and through the rear portion of the club head body;

the head origin z-axis extends perpendicular to the ground plane, and perpendicular to both the head origin x-axis and y-axis when the head is in the address position and a positive z-axis extends from the head origin and generally upward;

the golf club head has a center of gravity, and the center of gravity has a head origin x-axis (CGx) coordinate greater than about-3 mm and less than about 8 mm, and a head origin y-axis (CGy) coordinate greater than about 22 mm and less than 43 mm;

the golf club head center of gravity has a head origin z-axis (CGz) coordinate less than about 3 mm;

the golf club head has a moment of inertia about a center of gravity x-axis (CG x-axis), the CG x-axis is parallel to the head origin x-axis and passes through the center of gravity of the golf club head;

the golf club head has a moment of inertia about a center of gravity z-axis (CG z-axis), the CG z-axis is parallel to the head origin z-axis and passes through the center of gravity of the golf club head;

the golf club head moment of inertia about the CG x-axis is between about 200 $kg \cdot mm^2$ and 500 $kg \cdot mm^2$ and the moment of inertia about the CG z-axis is between about 350 $kg \cdot mm^2$ and about 600 $kg \cdot mm^2$;

the areal weight of the crown portion is less than about 0.36 $g/cm^2$ over at least about 50% of an entire crown portion surface area, and wherein the crown portion is at least partially formed of a composite material having a density between 1 g/cc and 2 g/cc;

the club head body has a channel located on the sole portion and extending generally from the front portion of the club head body to the rear portion of the club head body;

the club head body further comprises first and second ledges, opposing each other and extending within the channel from the front portion of the club head body to the rear portion the club head body, wherein the first and second ledges are disposed between an outer portion of the channel and an inner portion of the channel; and the club head body has a volume of at least 400 cubic centimeters;

at least one weight member movably positioned within the channel, wherein a position of the at least one weight member within the channel is able to be adjusted, and wherein the at least one weight member comprises:

an outer member retained within the outer portion of the channel and in contact with the first and second ledges, the outer member having a first non-round outer peripheral shape that prevents rotation of the outer member within the channel, wherein the outer member is configured to slide within the outer portion of the channel along an entire length of the channel and wherein the outer member comprises an outer-member central protrusion that extends into a space defined between the first and second ledges;

an inner member retained within the inner portion of the channel and in contact with the first and second ledges, the inner member comprising a threaded bore and having a second non-round outer peripheral shape that prevents rotation of the inner member within the channel, wherein the inner member comprises an inner-member central protrusion that extends into the space defined between the first and second ledges; and a fastening bolt that connects the outer member to the inner member and is threadably connected with the threaded bore of the inner member; and an adjustable head-shaft connection assembly comprising a sleeve secured by a fastening member in a locked position, the head-shaft connection system configured to allow the golf club head to be adjustably attachable to a golf club shaft in a plurality of different positions resulting in different combinations of loft angle, face angle, or lie angle.

2. The golf club head of claim 1, wherein the channel has a channel length between about 30 mm and about 120 mm, a channel width between about 8 mm and about 20 mm, and the channel is offset from the striking surface a minimum distance of at least 12 mm and no more than 50 mm.

3. The golf club head of claim 1, further comprising one or more ribs located on an internal surface of the sole.

4. The golf club head of claim 3, wherein at least one of the one or more ribs extends along the channel in a lengthwise direction.

5. The golf club head of claim 3, wherein at least one of the one or more ribs extends along the channel in a widthwise direction, and wherein the at least one of the one or more ribs that extends along the channel in the widthwise direction intersects the at least one of the one or more ribs that extends along the channel in the lengthwise direction.

6. The golf club head of claim 3, further comprising one or more weight ports and at least one weight removably attached to the one or more weight ports.

7. The golf club head of claim 6, wherein the one or more weight ports comprise a first weight port and a second weight port, and wherein a distance between the first and second weight ports is between 50 mm and 100 mm.

8. The golf club head of claim 6, wherein the channel and the one or more weight ports are an integral part of the body.

9. The golf club head of claim 8, wherein the body, the channel, and the one or more weight ports are made at least in part from a metal material and form an integrated cast structure.

10. The golf club head of claim 9, wherein at least one of the outer member and the inner member have a length between about 8 mm to about 20 mm and a width between about 8 mm to about 20 mm.

11. The golf club head of claim 10, wherein:

the first and second ledges include a plurality of projections located on an exposed surface of the first and second ledges; and the at least one weight member comprises a plurality of recesses adapted to selectively receive the projections located on the first and second ledges include, the recesses being sized relative to the projections such that the at least one weight member can move within the channel a limited amount when one of the projections is received in one of the recesses.

12. The golf club head of claim 10, wherein the body comprises a face opening, and the striking surface is welded to the body thereby closing the face opening.

13. The golf club head of claim 3, wherein the at least one weight member is configured to move between at least a first position and at least a second position, wherein the first position is positioned rearward of the center of gravity and the second position is positioned forward of the center of gravity, and wherein moving the at least one weight member provides a maximum y-axis adjustment range of the position of the center of gravity (Max L1CGy) that is greater than 2 mm.

14. The golf club head of claim 13, wherein the composite material of the crown portion has a density between 1.4 g/cc and 1.6 g/cc.

15. The golf club head of claim 14, wherein at least a portion of the sole portion is formed from a composite material having a density less than 2 g/cc.

16. The golf club head of claim 3, wherein the golf club head further comprises a hosel, having an interior cylindrical portion within the interior cavity, and wherein at least one of the one or more ribs is tied directly to the interior cylindrical portion of the hosel and tied directly to the channel.

17. The golf club head of claim 1, wherein at least a portion of the sole portion is formed from a composite material having a density less than 2 g/cc.

18. The golf club head of claim 1, wherein the club head body comprises a face opening, and the striking surface comprises a composite face plate received in the face opening to thereby close the face opening.

19. A golf club head comprising:

a club head body having a crown portion, a sole portion, a toe portion, a heel portion, a rear portion, and a front portion together defining an interior cavity, wherein:

the club head body has a striking surface located at the front portion of the club head body, and a head origin defined as a position on the striking surface at approximately a geometric center of the striking surface, the head origin including a head origin x-axis, a head origin y-axis, and a head origin z-axis;

the head origin x-axis is tangential to the striking surface and generally parallel to a ground plane when the head is in an address position and a positive x-axis extends towards a heel portion;

the head origin y-axis extends perpendicular to the head origin x-axis and generally parallel to the ground plane when the head is in the address position and a positive y-axis extends from the striking surface and through the rear portion of the club head body;

the head origin z-axis extends perpendicular to the ground plane, and perpendicular to both the head origin x-axis and y-axis when the head is in the address position and a positive z-axis extends from the head origin and generally upward;

the golf club head has a center of gravity, and the center of gravity has a head origin x-axis (CGx) coordinate greater than about-3 mm and less than about 8 mm, and a head origin y-axis (CGy) coordinate greater than about 22 mm and less than 43 mm;

the golf club head center of gravity has a head origin z-axis (CGz) coordinate less than about 3 mm;

the golf club head has a moment of inertia about a center of gravity x-axis (CG x-axis), the CG x-axis is parallel to the head origin x-axis and passes through the center of gravity of the golf club head;

the golf club head has a moment of inertia about a center of gravity z-axis (CG z-axis), the CG z-axis is parallel to the head origin z-axis and passes through the center of gravity of the golf club head;

the golf club head moment of inertia about the CG x-axis is between about 200 $kg \cdot mm^2$ and 500 $kg \cdot mm^2$ and the moment of inertia about the CG z-axis is between about 350 $kg \cdot mm^2$ and about 600 $kg \cdot mm^2$;

the areal weight of the crown portion is less than about 0.36 g/cm$^2$ over at least about 50% of an entire crown portion surface area, and wherein the crown portion is at least partially formed of a composite material having a density between 1 g/cc and 2 g/cc;

the club head body has a channel located on the sole portion and extending generally from the front portion of the club head body to the rear portion of the club head body;

the club head body further comprises first and second ledges, opposing each other and extending within the channel from the front portion of the club head body to the rear portion the club head body, wherein the first and second ledges are disposed between an outer portion of the channel and an inner portion of the channel; and the club head body has a volume of at least 400 cubic centimeters;

at least one weight member movably positioned within the channel, wherein a position of the at least one weight member within the channel is able to be adjusted, and wherein the at least one weight member comprises:

an outer member retained within the outer portion of the channel and in contact with the first and second ledges, the outer member having a first non-round outer peripheral shape that prevents rotation of the outer member within the channel, wherein the outer member is configured to sit within the outer portion of the channel along an entire length of the channel and wherein the outer member comprises an outer-member central protrusion that extends into a space defined between the first and second ledges;

an inner member retained within the inner portion of the channel and in contact with the first and second ledges, the inner member comprising a threaded bore and having a second non-round outer peripheral shape that prevents rotation of the inner member within the channel, wherein the inner member comprises an inner-member central protrusion that extends into the space defined between the first and second ledges; and a fastening bolt that connects the outer member to the inner member and is threadably connected with the threaded bore of the inner member; and an adjustable head-shaft connection assembly comprising a sleeve secured by a fastening member in a locked position, the head-shaft connection system configured to allow the golf club head to be adjustably attachable to a golf club shaft in a plurality of different positions resulting in different combinations of loft angle, face angle, or lie angle.

20. The golf club head of claim 19, wherein the club head body comprises a face opening, and the striking surface comprises a composite face plate received in the face opening to thereby close the face opening.

21. A golf club head comprising:

a club head body having a crown portion, a sole portion, a toe portion, a heel portion, a rear portion, and a front portion together defining an interior cavity, wherein:

the club head body has a striking surface located at the front portion of the club head body, and a head origin defined as a position on the striking surface at approximately a geometric center of the striking surface, the head origin including a head origin x-axis, a head origin y-axis, and a head origin z-axis;

the head origin x-axis is tangential to the striking surface and generally parallel to a ground plane when the head is in an address position and a positive x-axis extends towards a heel portion;

the head origin y-axis extends perpendicular to the head origin x-axis and generally parallel to the ground plane when the head is in the address position and a positive y-axis extends from the striking surface and through the rear portion of the club head body;

the head origin z-axis extends perpendicular to the ground plane, and perpendicular to both the head origin x-axis and y-axis when the head is in the address position and a positive z-axis extends from the head origin and generally upward;

the golf club head has a center of gravity, and the center of gravity has a head origin x-axis (CGx) coordinate greater than about-3 mm and less than about 8 mm, and a head origin y-axis (CGy) coordinate greater than about 22 mm and less than 43 mm;

the golf club head center of gravity has a head origin z-axis (CGz) coordinate less than about 3 mm;

the golf club head has a moment of inertia about a center of gravity x-axis (CGx-axis), the CG x-axis is parallel to the head origin x-axis and passes through the center of gravity of the golf club head;

the golf club head has a moment of inertia about a center of gravity z-axis (CG z-axis), the CG z-axis is parallel to the head origin z-axis and passes through the center of gravity of the golf club head;

the golf club head moment of inertia about the CG x-axis is between about 200 kg·mm$^2$ and 500 kg·mm$^2$ and the moment of inertia about the CG z-axis is between about 350 kg·mm$^2$ and about 600 kg·mm$^2$;

the areal weight of the crown portion is less than about 0.36 g/cm$^2$ over at least about 50% of an entire crown portion surface area, and wherein the crown portion is at least partially formed of a composite material having a density between 1 g/cc and 2 g/cc;

the club head body has a channel located on the sole portion and extending generally from the front portion of the club head body to the rear portion of the club head body;

the club head body further comprises first and second ledges, opposing each other and extending within the channel from the front portion of the club head body to the rear portion the club head body, wherein the first and second ledges are disposed between an outer portion of the channel and an inner portion of the channel; and the club head body has a volume of at least 400 cubic centimeters;

at least one weight member movably positioned within the channel, wherein a position of the at least one weight member within the channel is able to be adjusted, and wherein the at least one weight member comprises:

an outer member retained within the outer portion of the channel and in contact with the first and second ledges, the outer member having a first non-round outer peripheral shape that prevents rotation of the outer member within the channel, wherein the outer portion of the channel is shaped to receive the first non-round outer peripheral shape of the outer member along an entire length of the channel, and wherein the outer member comprises an outer-member central protrusion that extends into a space defined between the first and second ledges;

an inner member retained within the inner portion of the channel, the inner member comprising a threaded bore and having a second non-round outer peripheral shape that prevents rotation of the inner member within the channel and wherein the inner member comprises an inner-member central protrusion that extends into the space defined between the first and second ledges; and a fastening bolt that connects the outer member to the inner member and is threadably connected with the threaded bore of the inner member; and an adjustable head-shaft connection assembly comprising a sleeve secured by a fastening member in a locked position, the head-shaft connection system configured to allow the golf club head to be adjustably attachable to a golf club shaft in a plurality of different positions resulting in different combinations of loft angle, face angle, or lie angle.

22. The golf club head of claim 21, wherein the club head body comprises a face opening, and the striking surface comprises a composite face plate received in the face opening to thereby close the face opening.

* * * * *